United States Patent [19]

Nishikawa et al.

[11] 4,094,342

[45] June 13, 1978

[54] AUTOMATIC BINDER

[75] Inventors: Mitsuo Nishikawa; Hideo Hosaka; Jun Maemori, all of Takasaki, Japan

[73] Assignee: Max Co., Ltd., Tokyo, Japan

[21] Appl. No.: 770,898

[22] Filed: Feb. 22, 1977

[30] Foreign Application Priority Data

| | | |
|---|---|---|
| Feb. 23, 1976 | Japan | 51-17984 |
| Mar. 6, 1976 | Japan | 51-24438 |
| Mar. 12, 1976 | Japan | 51-26039 |
| Mar. 12, 1976 | Japan | 51-28596[U] |
| Mar. 13, 1976 | Japan | 51-27266 |
| Mar. 12, 1976 | Japan | 51-26040 |
| May 20, 1976 | Japan | 51-58300 |
| May 20, 1976 | Japan | 51-63382[U] |
| Jun. 5, 1976 | Japan | 51-65788 |
| Oct. 28, 1976 | Japan | 51-144078[U] |
| Nov. 4, 1976 | Japan | 51-131637 |
| Dec. 18, 1976 | Japan | 51-152601 |
| Feb. 21, 1976 | Japan | 51-18328 |

[51] Int. Cl.[2] ..... B21F 9/02

[52] U.S. Cl. ..... 140/93.2

[58] Field of Search ..... 100/25, 26; 140/57, 140/93 A, 93.2, 93.6, 101; 245/1.5

[56] References Cited

U.S. PATENT DOCUMENTS

| | | | |
|---|---|---|---|
| 876,573 | 1/1908 | Myers | 140/101 |
| 1,320,515 | 11/1919 | Warwick | 140/93 A |
| 2,913,270 | 11/1959 | Sachsenroder et al. | 100/26 UX |
| 3,057,648 | 10/1962 | Schwarze et al. | 100/26 X |
| 3,323,558 | 6/1967 | Collins | 140/93.6 |
| 3,391,440 | 7/1968 | Harms | 140/93.2 X |
| 3,891,012 | 6/1975 | Bakermans | 140/93 A |

FOREIGN PATENT DOCUMENTS

| | | | |
|---|---|---|---|
| 520,041 | 10/1956 | Germany | 100/26 |
| 470,138 | 1/1929 | Germany | 100/26 |
| 165,657 | 12/1964 | U.S.S.R. | 140/93 A |

*Primary Examiner*—E. M. Combs

[57] ABSTRACT

An automatic binding device or binder for binding a long material such as a bundle of electric wires with a lace by actuating the mechanisms associated therewtih according to pilot signals produced when the lace passes through the mechanisms. In this respect, a lace used should afford given rigidity and flexibility. This binder includes a guide member which may be opened and closed, and is formed with guide channels running along its inner peripheral surface for guiding a lace for use in binding. The guide member is formed with a lead-in hole for a lace on one side and a lead-out hole on the opposite side. For smooth guiding of a lace through guide channels, there is used a reversibly rotatable roller mechanism or a combination of the roller mechanism with a vibrating mechanism for vibrating a lace being guided through the guide channels. The lace paid out through the lead-out hole from the guide member is gripped by a lace gripping mechanism on the tip portion of the lace. According to a signal produced in association with the movement of the lace gripping and portion thereof, the primary tightening operation due to the reverse rotation of the roller mechanism is effected, followed by the secondary tightening operation due to the movement of the lace gripping mechanism. Thereafter, the lace is cut in the opposite portions of a knot or a bound portion thereof by means of cutters, and then waste lace thus cut off or chip is removed by suitable means.

17 Claims, 76 Drawing Figures

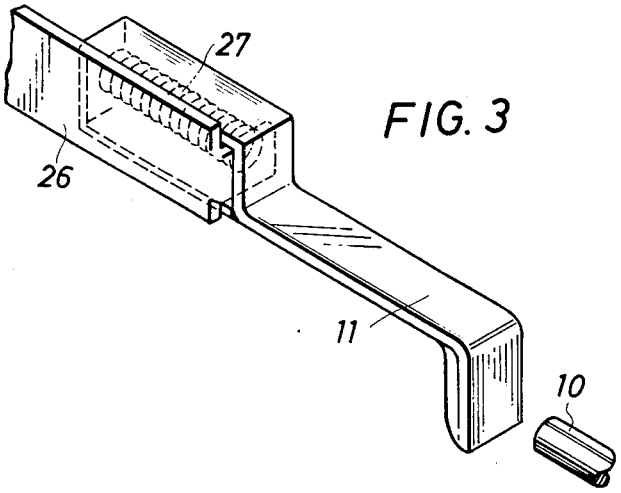
FIG. 3
FIG. 8
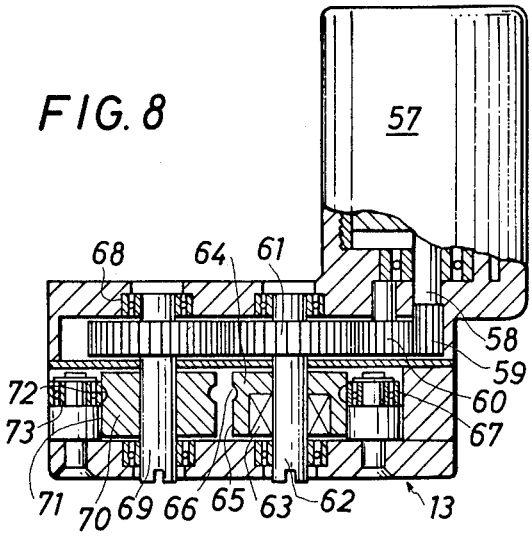

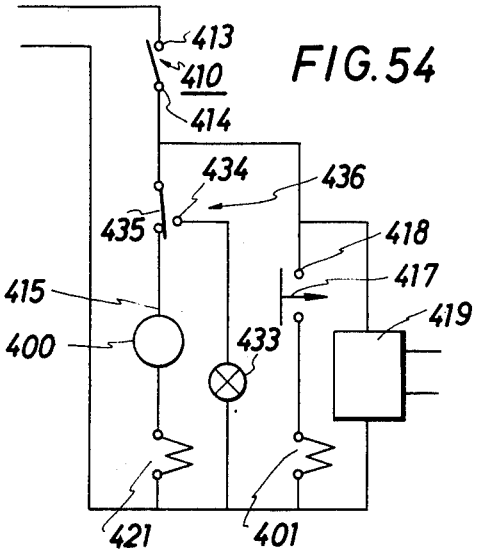
FIG. 54
FIG. 55
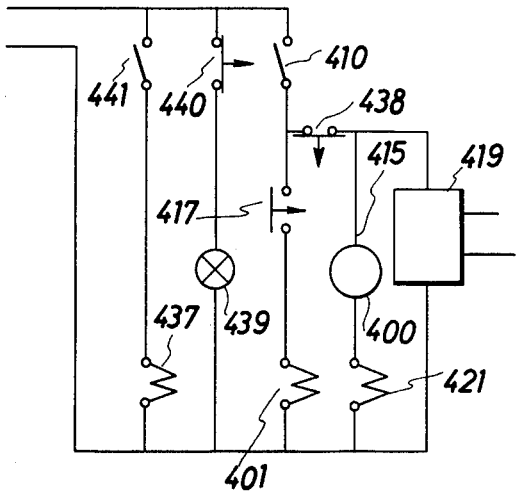

476
479
478
481
473
482
483
485
480
488
474
475
472
471
487
486
484
492
560
490
491
493
470
465
466
463
468
469
495
453
451
494
557
457
452
458
314

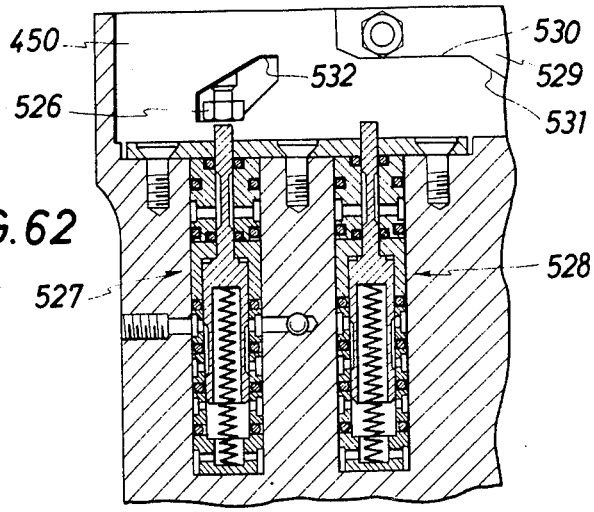
FIG.62
FIG.63
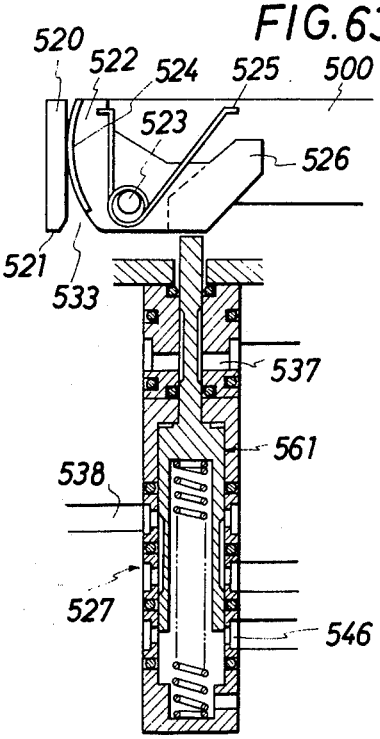
FIG.64
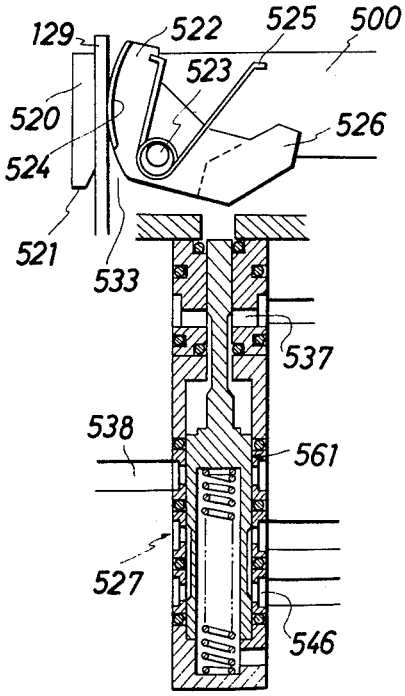

AUTOMATIC BINDER

BACKGROUND OF THE INVENTION

1. Field of the Invention

This invention relates to a binding device or binder for use in binding a long or endless material with a lace having suitable rigidity and flexibility, and more particularly to a binder for binding a bundle of electric wires, steel wires or fibers with laces.

2. Description of the Prior Art

Cable harnesses are used for electric connection in electric equipments in automatic telephone switchboards, air planes, or automobiles. At the present time, these cable harnesses are manually prepared by using nyron laces or braids, or knite strings. In other words, a lace is wound around a long material at least two turns, and then tightened fast at to form a knot by pulling the opposite free ends of the lace. In this respect, each binding or tightening operation requires a force of over 5 to 10 kg, so that hands of an operator is sometimes injured and in addition there results a large range of vibrations in the conditions of the lace thus bound, with the accompanying shortcoming of poor operational efficiency. For avoiding these shortcomings, there has been proposed a binding or tightening tool which tightens around a long material a plastic tape having tightening portions at its opposite ends. More particularly, the plastic tape is wound around a long material one turn, and then, tightening ring portions, through which the ends of the tape are pierced, are tightened together by means of a tightening force. This tyoe tool could meet a partial sucess in improvements on operational efficiency and consistent quality of bound portions or knots, but the plastic tapes are costly, so so that in case binding portions are tremendously large in number, an increase in expense is no longer negligible an presents a critical economical problem, unlike the less expensive use of the prior art kite string, nyron lace and the like.

There is known an electric wire binder which has been disclosed by the U.S. Pat. No. 3,670,783 patented on June 20, 1972 for John T. Goodwill. According to the John's patent, a cable is gripped by a jaw in the position which is to provide a knot, while a bobbin having a lace wound thereon rotates around a cable. As a result, a lace is paid out from the bobbin and passes around the cable, whereupon the lace is placed on a loop forming mechanism positioned adjacent to the cable on a path of the lace. As the bobbin rotates around the cable, the loop forming machine is lifted and rotated through an angle of 270°, whereby the lace is formed into a loop, and the lace itself is twisted at the bottom of the loop. Upon the completion of rotation of the loop forming machine an open portion of this loop is positioned at a point on a path of a rotating bobbin so as to allow the bobbin to pass through the open portion of the loop, so that there is formed a loose knot of a lace.

After passing through this loop, the bobbin is displaced a small distance further, and then stopped. At this point, the bobbin is cut off from the rotating mechanism and coupled to other mechanism which rotates the bobbin positively, whereby an excessive portion of the lace is re-wound, and the knot is tightened around the cable, after which the lace is released from the loop forming machine. After the knot is tightened, the cable is advanced to a subsequent knot-forming position, of the cable remains still, and a binding tool is displaced relative thereto. However, the John's patent only relates to a technique, by which a single lace is continuously wound around a cable in several positions, rather than to a technique, by which a lace is bound in an individual knot-forming position and tightened fast thereat. Accordingly, the John's patent cannot be applied to a single knot forming portion, and in addition, the starting and terminating ends of a lace should be bound manually.

SUMMARY OF THE INVENTION

It is an object of the present invention to provide an automatic binding device or binder which is less costly, as compared with prior art machines of the type described, and which is adapted to automatically bind a bundle of wires and the like with a lace having suitable rigidity and flexibility, much as a nyron lace and the like.

It is another object of the present invention to provide an automatic binder which provides a large binding force and long lasting, consistent quality of knots formed, after the lace has been bound.

It is a further object of the present invention to provide an automatic binder, in which a long flexible material or lace is fed from its tip into the binder and automatically wound around a bundle of wires or the like, and then tightened so as to be bound fast there-around, while an excessive portion of the long flexible material is cut.

It is still further object of the present invention to provide an automatic binder which is provided with a guide means allowing quick threading or feeding of a lace through guide channels defined in a guide member, thereby forming multiple loops around a bundle of a material to be bound.

It is a yet further object of the present invention to provide an automatic binder, in which a loop or loops are formed around a bundle of a material, then a flexible material or lace is threaded back to a lead-in portion or hole in the binder to form a knot, so that consumption of a flexible material or lace may be minimized.

It is a further object of the present invention to provide an automatic binder which is provided with a primary tightening means and a secondary tightening means, thereby presenting a long lasting, consistent quality of knots which are free of looseness.

It is a further object of the present invention to provide an automatic binder which enables accurate controls by utilizing tension and rigidity of a flexible material or lace.

These and other objects and features of the present invention may be readily attained in an automatic binder of the present invention. According to the automatic binder of the present invention, there is provided a ring-shaped guide member in a tip portion of a body proper of a binder. The ring-shaped guide member consists of a stationary guide element which is secured to the body proper of the binder and a movable guide element which may be opened or closed relative to the stationary guide element, such that a flexible material or lace is introduced through a lead-in hole in the binder so as to go around a bundle of a material to be bound, after which the flexible material is led out from a lead-out hole in the binder for binding. In addition, a feed-in, primary tightening roller mechanism is provided in the close vicinity of a flexible-material-lead-in hole, so that when the roller mechanism is rotated in a normal direction relative to the ring-shaped guide member, then a flexible long material may be fed into the lead-in hole, and when the roller mechanism is rotated in the reverse direction, the flexible long material is re-wound for effecting primary tightening of the flexible material. The long flexible material is led along the ring-shaped guide member by means of the feed-in, primary tightening roller mechanism, and then a tip portion of a long flexible material peeps out from a lead-out hole in the guide member so as to be gripped by a flexible material gripping mechanism immediately thereafter. After the flexible material has been tightened according to the primary tightening operation due to the reverse rotation of the feed-in primary tightening mechanism, the flexible material gripping mechanism is shifted away from the lead-out hole in the ring-shaped guide member, so that a long flexible material is further tightened faster around a bundle of a material, thereby effecting the so-called secondary tightening operation. Thereafter, an excessive portion of a long flexible material after it has been used for binding a bundle of a material is cut off from the other portion of the flexible material by means of a cutter mechanism. A cut waste of flexible material remaining in the flexible material gripping mechanism are blown away with pressurized air, thereby presenting a stand-by condition for the subsequent binding operation.

Meanwhile, for feeding a long flexible material or lace around a bundle of a material along guide channels in a ring-shaped guide member, the long flexible material may be forcibly introduced through a flexible-material-lead-in hole in the guide member by means of the feed-in, primary tightening roller mechanism, or alternatively, the flexible material may be fed into the guide member, while the movable guide element is intermittently or cyclically moved relative to the stationary guide element for smooth threading of the long flexible material through guide channels in the guide member.

BRIEF DESCRIPTION OF THE DRAWINGS

FIG. 3 is a perspective view illustrative of an operating mechanism for a trigger and an operating arm of a ring-shaped guide member;

FIG. 8 is a cross-sectional view, partly broken away, of a feed-in primary tightening mechanism;

FIGS. 9 to 12 are views illustrative of the operation of a flexible material gripping mechanism, in which FIG. 9 shows a condition where the tip of a flexible material is not fed into a flexible-material-lead-in channel, FIG. 10 shows a condition wherein the tip portion of a flexible material is gripped by a stationary pawl and a rotatable pawl therebetween, and FIG. 11 shows a condition where a piston rod has been retracted to its rearmost position, after the completion of the secondary tightening operation;

FIG. 12 is a plan view of the condition of FIG. 11;

FIGS. 15 to 17 are longitudinal cross-sectional views illustrative of the operation of the secondary tightening cylinder mechanism, in which FIG. 15 is a view showing a condition where working air is supplied through an advancing air port and then the primary tightening operation has been completed, FIG. 16 is a condition where working air is supplied through a retracting air port and the secondary tightening operation has been completed, followed by the retraction of the piston rod to its rearmost position, and FIG. 17 is a view showing a condition where working air is supplied again into the advancing air port due to the release of a trigger, and a waste of a flexible material are being blown away;

FIGS. 22 to 34 are views showing the actual binding operations of air pressure circuit diagrams illustrative of the driving and controlling conditions of a binder according to the present invention, in which FIG. 22 shows a condition where a binder is connected by way of an air plug to a working air source, FIG. 23 shows a condition where a bundle of a material to be bound has not yet been introduced into the ring-shaped guide member, FIG. 24 shows a condition, where a trigger is actuated, after which a flexible material is fed therein, FIG. 25 shows a condition where a flexible material is being wound around a bundle of a material which has been introduced into the ring-shaped guide member, FIG. 26 shows a condition of a circuit, wherein the feed-in primary tightening roller mechanism is rotated in the reverse direction for effecting the primary tightening operation, FIG. 27 shows a condition where a flexible material is being wound around a bundle of a material in association with the primary tightening operation, FIG. 28 shows a condition of a circuit during the secondary tightening operation by the secondary tightening cylinder mechanism, FIG. 29 shows a condition where a flexible material is being fast bound around a bundle of a material, FIG. 30 shows a condition of a circuit wherein a flexible material is cut after the completion of the secondary tightening operation, FIG. 32 is a condition of a circuit wherein a piston rod assumes its rearmost position, FIG. 33 shows the condition of a circuit wherein a waste cut of the flexible material is blow away from the flexible material gripping mechanism, FIG. 34 shows a condition of parts associated with the ring-shaped guide member;

FIGS. 45 to 48 are circuit diagrams illustrative of respective operating conditions of a binding control circuit, in which FIG. 45 is a view showing an initial condition where a trigger lever has not been actuated, FIG. 46 shows a condition of a flexible material being fed, FIG. 47 shows a condition of the primary tightening operation included in the binding operation, FIG. 48 shows a condition of completion of the cutting operation of a flexible material;

FIG. 52 is a circuit diagram showing the initial condition of a binding drive-control circuit;

FIGS. 53 to 55 are circuit diagrams of other embodiments of binding drive-control circuits;

FIG. 62 is a partial cross sectional view showing the positional relationship of a gripping detecting valve, a cutter actuating valve and an operating piece and the like;

FIG. 63 is a cross sectional view showing a condition where the gripping detecting valve is not actuated;

FIG. 64 is a cross-sectional view showing a condition where the gripping detecting valve has been actuated;

FIGS. 65 to 73 are circuit diagrams showing the operation of the binder and operations of control circuit, in which FIG. 65 is a circuit diagram in case the binder is not connected to a working air source, FIG. 66 is a circuit diagram in case the binder is connected to a working air source, FIG. 67 shows a circuit diagram in case a flexible material is being fed, FIG. 68 is a circuit diagram showing the condition of the primary tightening condition of a flexible material due to the rotation of the feed-in, primary, tightening roller mechanism in the reverse direction, FIG. 69 is a circuit diagram showing the starting conditions of the secondary tightening operation by means of a secondary tightening cylinder, FIG. 70 is a circuit diagram showing a condition where the flexible material is cut after the completion of the secondary tightening operation, FIG. 71 is a circuit diagram wherein the secondary tightening piston assumes its rearmost position, FIG. 72 is a circuit diagram showing a condition wherein a trigger is released, FIG. 73 is a circuit diagram showing the return stroke starting operation of the secondary tightening piston;

DESCRIPTION OF THE PREFERRED EMBODIMENTS

Figure 1:
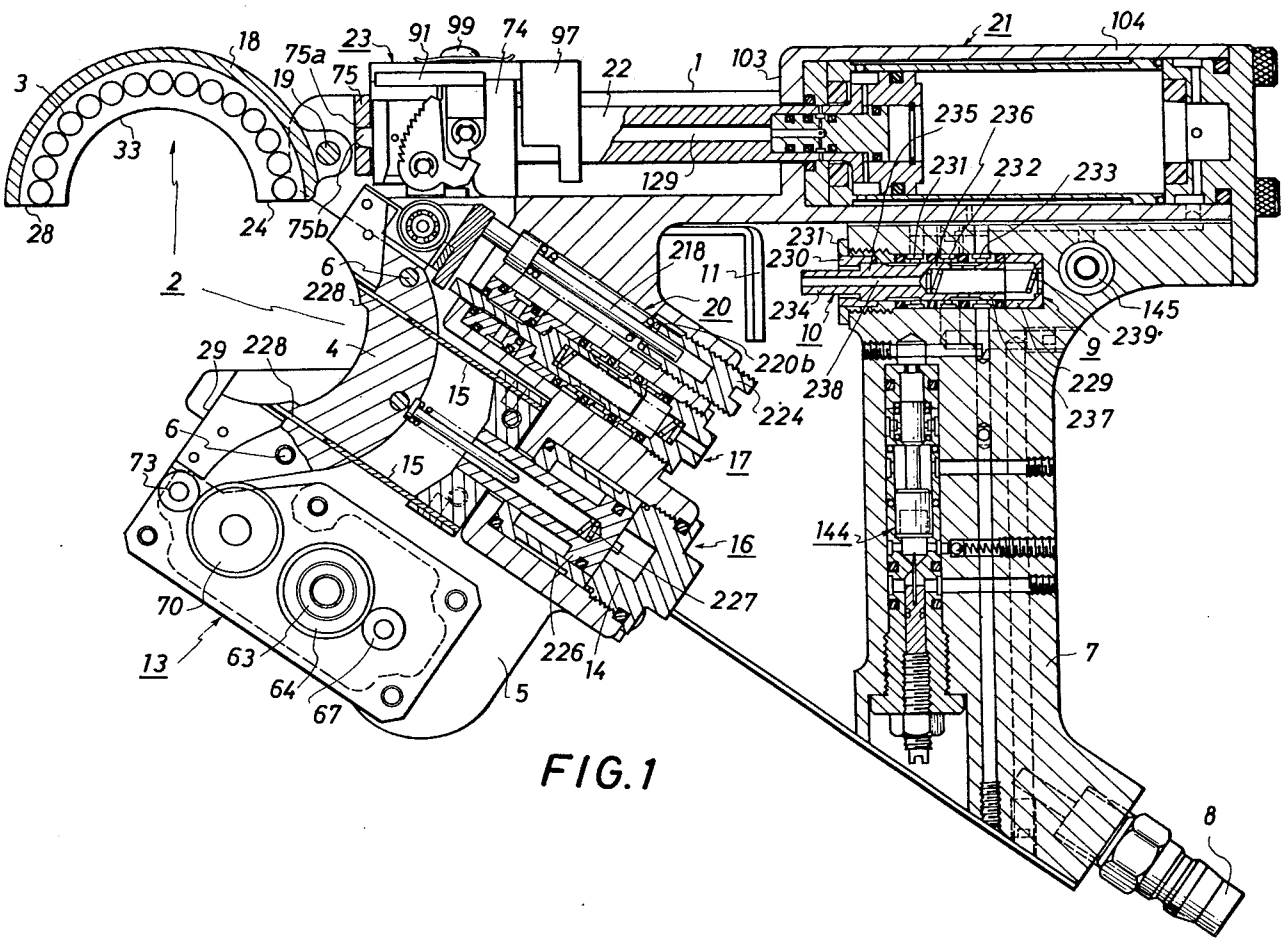
FIG. 1 in a front view, partly in cross section, of the entire construction of a binder according to the present invention.

The preferred embodiments of the automatic binder according to the present invention will be described in more detail with reference to FIGS. 1 to 36. FIG. 1 shows the entire construction of the binder, into which a binding drive and control circuits are built. As shown in FIG. 1, a ring shaped guide member 2 is attached to the tip portion of a body proper 1 of the binder of a gun type. The ring shaped guide member 2 consists of a movable guide element 3 and a stationary guide element 4.

The movable guide element 3 is integral with a guide casing 18, which is rotatably supported by the body proper 1 by means of a pivot 19. The stationary guide element 4 is secured through the medium of an attaching pin 6 to a supporting portion 5 depending from the tip portion of the body proper 1 downwards. The rear portion of the body proper 1 is formed with a grip portion 7 projecting downwards. The tail portion of the grip portion 7 is formed with an air plug 8, through which working air is introduced. A trigger valve stem 10 of a trigger valve 9 projects towards the side of the supporting portion 5 of the grip portion 7, while a trigger 11 is provided in opposing relation to the trigger valve stem 10 on the side of the supporting portion 5.

Formed on the lowermost portion of the supporting portion 5 but adjacent to the stationary guide element 4 is a feed-in, primary roller mechanism 13 which is adapted to feed a long flexible material 12, such as a nyron lace serving as a binding material, into the stationary guide element 4 from a flexible material source such as a bobbin not shown. The roller mechanism 13 further effects the primary tightening operation of a lace. Provided adjacent to the roller mechanism 13 is a cutter mechanism 16 for cutting the flexible material 12, and the mechanism 16 consists of a cutter drive cylinder 14 and two cutters 15.

A cutter actuating valve 17 is positioned adjacent to the cutter mechanism 16, while a tightening force adjusting mechanism 20 adapted to adjust a tightening force required for the secondary tightening operation is positioned adjacent to the cutter actuating valve 17 between the stationary guide element 4 and the supporting portion 5.

Positioned on an upper portion of the grip portion 7 on the body proper 1 to a secondary tightening cylinder mechanism 21 is projecting relation towards the movable guide element 3, and the mechanism 21 is adapted to effect the secondary tightening of the flexible material 12. Provided on the tip portion of a piston rod 22 in the secondary tightening cylinder mechanism 21 is a flexible material gripping mechanism 23 adapted to grip a tip portion 12*a* of the flexible material, upon the secondary tightening operation of the flexible material 12.

The movable guide element 3 and the stationary guide element 4 are coupled to each other by means of a connecting rod (not shown) disposed between an attaching pin 6 for the stationary guide element 4 and the pivot 19 for the movable guide element 3. A drive shaft 25 is positioned closer to the root portion mating surface 24 of the movable guide element 3 than the position of the pivot 19. Provided on the drive shaft 25 is a drive arm 26 which is coupled through the medium of a compression spring 27 to the trigger 11 as shown in FIG. 3. When the trigger 11 is pulled, the drive arm 26 is first drawn towards the grip portion 7, so that the movable guide element 3 is rotated towards the stationary guide element 4 and the tip end mating surface 28 of the movable guide element 3 mates with the tip end mating surface 29 of the stationary guide element 4. In other words, the ring shaped guide member 2 assumes its closed position.

Figure 2:
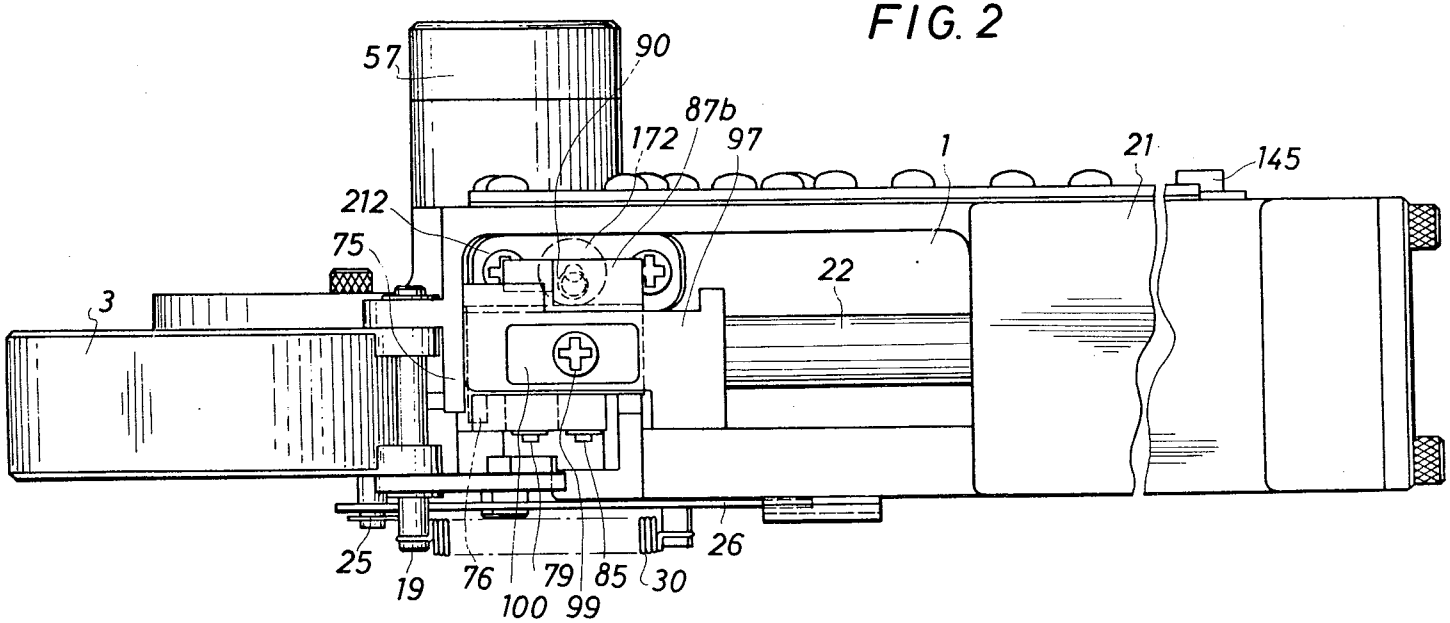
FIG. 2 is a plan view of the binder of FIG. 1.

The closing operation of the ring shaped guide member 2 causes the drive arm 26 to be fixed rigidly, so that when the trigger 11 is pulled, then the compression spring 27 is compressed. When the trigger 11 is further drawn towards the grip portion 7, the trigger valve stem 10 is pressed thereby. After the completion of a binding operation, when the trigger 11 is released, then the ring shaped guide member 2 is opened under the action of a tension spring 30 attached between the drive arm 26 and the pivot 19 as shown in FIG. 2. The opening operation of the ring shaped guide member 2 by a force of the spring is shown as one of examples.

The movable guide element and stationary guide element 4 are of a semi-circular shape, while the shape of the elements 3 and 4 should not be construed in a limitative sense. The movable guide element 3 may be smaller than the stationary guide element 4, or vice versa.

Guide channels 32 are defined over the entire inner peripheral surface 33 of the ring shaped guide member 2. The guide channels 32 are adapted to guide the flexible material 12 being introduced which serves as a binding material for a bundle of a material 35 such as wires, around the outer periphery of the material 35 which is to be inserted into a central hole 34 provided in the ring shaped guide member 2. In this respect, the radii of curvatures of the guide channels 32 should preferably vary smoothly over the entire inner peripheral surface 33 of the guide member 2.

Figure 4:
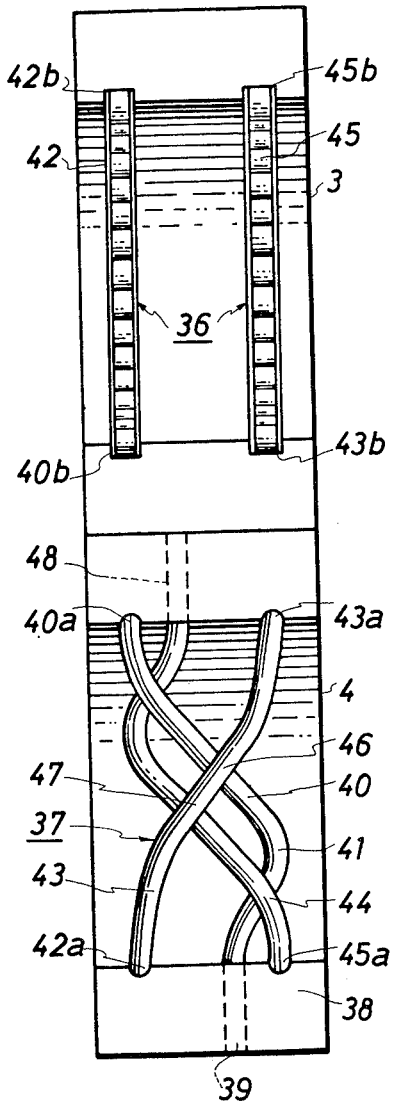
FIG. 4 is a developed view illustrative of guide channels defined in the ring-shaped guide member constituting the essential part of the binding.

The guide channels 32, as shown in FIG. 4, are composed of parallel channel portions 36 defined in the movable guide element 3, and intersecting channel portions 37 defined in the stationary guide element 4. A flexible material lead-in hole 39 extends through a thickness-increased portion 38 of the stationary guide element 4 and is continuous with a first intersecting channel element 40. The first intersecting channel element 49 is formed with a curved portion 41 which projects to the right and runs to the left upper portion of the stationary guide element 4 and then from end opening 40*a* to an end opening 40*b* in the movable guide element 3. The intersecting channel element 40 is continuous by way of the end openings 40*a*, 40*b* with the first parallel channel element 42 in the movable guide element 3. The first parallel channel element 42 is continuous by way of an end opening 42*b* positioned in the left upper portion of the movable guide element 3 with an end opening 42*a* in the second intersecting channel element 43 in the stationary guide element 4. The second intersecting channel element 43 runs aslant towards the right upper portion of the stationary guide element 4 in the drawing, and intersects with a third intersecting channel element 44 in its deep position, and then with the first intersecting channel element 40 in a deeper position than the former, while being continuous by way of an end opening 43*a* in the second intersecting channel element 43 and an end opening 43*b* in the second parallel channel element 45, with a second parallel channel element 45 in the movable guide element 3. The second parallel channel element 45 is continuous by way of an end opening 45*b* positioned in the right upper portion of the movable guide element 3 as well as by way of an end opening 45*a* positioned in the right lower portion of the stationary guide element 4 with the third intersecting channel element 44. The third intersecting channel element 44 intersects with the first intersecting channel element 40 in its deeper position, and then with the second intersecting channel element 43 in less deeper position, and then with the first intersecting channel element 40 in much less deeper position, and is continuous with the flexible material lead-out hole 48.

In this manner, the guide channels 32 are defined in the movable guide element 3 and stationary guide element 4 in such a manner that the first intersecting channel element 40 and third intersecting channel element 44 are shallow, as compared with the second intersecting channel element 43 and thus discontinued at the first intersection 46 and the second intersection 47 of the intersecting channel elements 40, 43, 44. Accordingly, a radius of curvature of the second intersecting channel element 43 in the direction to lead a flexible material outside, which radius is associated with the depth of the channel, is increased in a range covering the first intersection 46 and the second intersection 47. However, a variation in radius of curvature of the second intersecting channel element 43 is extremely small, i.e., the curvature thereof is quite smooth. Thus, it may be said that the guide channels 32 in the ring-shaped guide member 2 provide substantially uniform radius of curvatures, with the guide surfaces being smoothly continuous with each other at a substantially uniform radius of curvature. As a result, the flexible material 12 will not be peeled off any portions of the guide channels 32 in the ring shaped guide member 2, towards the central hole 34 therein.

Figure 5:
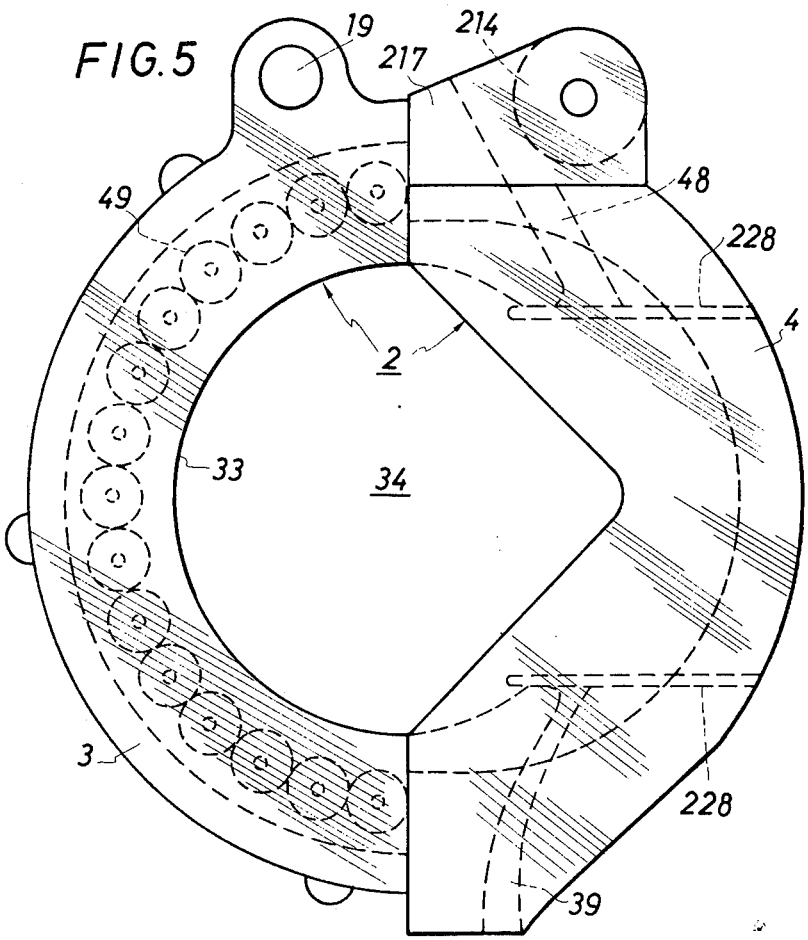
FIG. 5 is a front view of a ring-shaped guide member alone.
Figure 6:
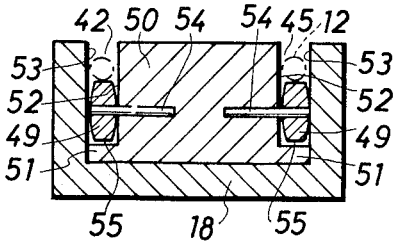
FIG. 6 is a transverse cross-sectional view of a movable guide element of the ring-shaped guide member.

As shown in FIG. 5, a plurality of feed-rollers 49 are provided within the respective parallel channels 42, 45 in the parallel channel portion 36 defined in the movable guide element 3, with the axes of the rollers 49 running at a right angle to the lead-out direction of the flexible material 12. The cross-sectional construction of the movable guide element 3 is shown in FIG. 6, in which a feed-roller receiving body 50 of an inverted 'T' shape is fitted in a guide casing 18 having a rectanular recess, with flange portions 51 extending from the lower portions of the feed-roller receiving body 50 and abutting the inner wall surfaces 53 of the guide casing 18 on the opposite sides thereof. In this manner, the parallel guide channels 42, 45 are defined by the opposite inner wall surfaces 53 of the guide casing 18, flange portions 51 and opposite side walls 52 of the feed-roller receiving body 50. As a result, feed-rollers 49 may be readily attached to the movable guide element 3, presenting considerable convenience for the manufacture of the binder according to the present invention.

Spanning over the opposite side walls 52 of the roller receiving body 50 are a plurality of pivots 54 which are positioned at a given spacing within the parallel channels 42, 45, while the feed rollers 49 are rotatably fitted on the pivots 54, respectively.

Figure 7:
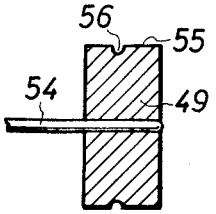
FIG. 7 is a cross-sectional view of a feed roller provided in the movable guide element of the guide member.

With the embodiment of FIG. 6, peripheral surfaces 55 of feed rollers 49 are shown flat in cross section, although the peripheral surfaces 55 may be provided with feed guide channels 56 as shown in FIG. 7 in an attempt to prevent the zig-zag travelling of the flexible material 12 in the flexible-material-lead-out direction. In this embodiment, the pivot 54 for the feed roller 49 in the first parallel channel 42 is provided in the feed roller receiving body 50, independently of the pivot 54 for the feed roller 49. Alternatively, an elongated pivot may be provided in a manner to pierce through the feed roller receiving body 50 transversely, and then feed rollers 49 may be rotatably fitted on the pivot thus provided on the opposite sides thereof.

The test results reveal that smooth travelling of the flexible material 12 may be achieved in case the diameter of the feed rollers 49 is about 5 mm and the diameter of the pivots 54 is 0.7 mm.

In addition, with this embodiment, the feed rollers 49 are provided only within the parallel channel portion 36 in the movable guide element 3. However, a plurality of additional feed rollers 49 may be provided within the second intersecting channel 43 having the greatest depth, thereby insuring positive travelling of the flexible material on the side of the stationary guide element 4.

As shown in FIG. 8, a feed-in, primary tightening roller mechanism 13 is positioned close to the flexible-material-lead-in hole 39 in the stationary guide element 4, thus feeds the flexible material 12 into the ring shaped guide member 2 and effects the primary tightening operation. A drive gear 59 is secured to the tip portion of a drive shaft 58 of a pneumatic motor 57 which is driven with pressurized air. The pneumatic motor 57 permits the rotation in the normal direction (in which the flexible material 12 is fed into the stationary guide element 4) as well as the rotation in the reverse direction (in which the flexible material 12 is tightened against the stationary guide element 4.). A drive gear portion 59 meshes through the medium of an intermediate deceleration pinion 80 with a first gear 61. The first gear 61 is integrally secured to a first roller shaft 62. A first roller 64 is secured through the medium of a one-way clutch 63 to a first roller shaft 62 in a manner to be free or rigid with respect to the first roller shaft 62. When the first roller 64 rotates in the normal direction under the action of the one-way clutch 63, and the first roller 64 is free to rotate relative to the first roller shaft 62.

A guide channel 66 is defined in an outer peripheral surface 65 of the first roller 64, thereby providing a space, through which the flexible material is to pass. The depth of the guide channel 66 is smaller in dimension than the diameter of the flexible material 12. A first-hold down roller 67 is positioned adjacent to the first roller 64. The flexible material 12 is paid out from a bobbin not shown and inserted into between the guide channel 66 and the first hold-down roller 67 in a manner that the material 12 is somewhat squeezed together. At this time, a resistance produced in the flexible material 12 against the aforesaid squeezing force causes a tension in the flexible material 12.

A second gear 68 is positioned in a manner to mesh with the first gear 61. The second gear 68 is secured to a second roller shaft 69, while a second roller 70 is also secured to the second roller shaft 69. A guide channel 72 is defined in an outer peripheral surface 71 of the second roller 70, while a second hold-down roller 73 is positioned adjacent to the second roller 70. The depth of the guide channel 72 is smaller in dimension than the diameter of the flexible material 12, so that the flexible material 12 may pass between the rollers 64 and 70.

For feeding the flexible material 12 into the ring-shaped guide member 2 by means of the feed-in, primary tightening roller mechanism 13, the tip portion of the flexible material 12 is first led through the guide channel 66 in the first roller 64 and the guide channel 72 in the second roller 70, then into the flexible-material-lead-in hole 39, beforehand, and then the pneumatic motor 57 is put into operation in the normal direction. The rotation of the motor 57 in the normal direction causes the drive gear 59, intermediate deceleration pinion 60, first gear 61 and second gear 68 to rotate in the normal direction, so that a torque is transmitted to the second roller 70 to feed the flexible material 12 along the guide channel 32 in the ring-shaped guide member 2. The first roller 64 is free relative to the first roller shaft 62 under the action of the one-way clutch 63 and cooperates with the first hold-down roller 67 to impart a resistance produced when the flexible material 12 is pressed, to the second roller 70 as a load to cause a tension in the flexible material 12. As a result, the flexible material 12 is not allowed to stand still between the rollers 64 and 70, and thus smoothly fed into the stationary guide element 4 so as to travel along the guide channel 32, then out of the flexible-material-lead-out hole 48, then through the tightening force adjusting mechanism 20, to be gripped by means of the flexible-material-gripping mechanism 23 on its tip portion 12*a*.

When the flexible material 12 is threaded around a bundle of a material 35 to form a loop therearound and then tightened, the pneumatic motor 57 reverses its rotation. The reverse rotation of the pnumatic motor 57 causes the reverse rotation in the second roller 70, while the first roller 64 causes the reverse rotation along with the first roller shaft 64 under the action of the one way clutch 63. As a result, the flexible material 12 which has been fed a given length along the guide channel 32 in the ring-shaped guide member 2 may be pulled back so as to be tightened around a bundle of a material 35, while an unwanted portion of the flexible material may be wound back. At the same time, the flexible material 12 is tightened fast by means of two rollers 64, 70, while the pneumatic motor 57 is forcibly stopped due to an increase in tension of the flexible material 12 thus caused, and maintained in a condition where a reversing torque is being applied thereto, thereby holding the end of the flexible material 12 for the subsequent secondary tightening operation. In addition, this results in the fact that the flexible material 12 is tightened by means of the first roller 64 and the second roller 70, so that the areas of the flexible material 12 contacting the respective rollers 64, 70 may be increased, and this a tightening force may be increased for the flexible material 12. In addition, even in case there takes places a slip between the second roller 70 and the flexible material 12 during the secondary tightening operation due to simultaneous rotation of the first roller 64 and the second roller 70, the first roller 64 may well compensate for a decrease in a tightening force arising from the aforesaid slip.

A flexible material gripping mechanism 23 grips the tip portion 12*a* of the flexible material 12 which has been guided so as to run along the guide channel 32 in the ring-shaped guide member 2 and then to peep out from the flexible-material-lead-out hole 48. The gripping mechanism 23 is positioned on the tip portion of a piston rod 22 in a secondary tightening cylinder mechanism 21. The construction and operation of the flexible-material-gripping mechanism 23 will be described with reference to FIGS. 1 and 9 to 13. A casing of the flexible-material-gripping mechanism 23 is fitted on and secured to the tip portion of the piston rod 22. When the piston rod 22 assumes the most advanced position from the secondary tightening cylinder 21, the casing 74 assumes a postion closest to a front frame 75 upright on the front and portion of the body proper 1. A locating hole 75*a* is provided in the frmae 75. On the other hand, a locating pin 85*b* extends from the left end portion of the casing 74 which is to be inserted into the locating hole 75*a*, when the piston rod 22 assumes the most advanced position, so that the piston rod 22 may be prevented from moving up and down, or leftwards and rightwards. A rectangular stationary pawl 76 is provided on the front portion of the casing 74 in projecting relation transversely of the body proper 1. The stationary pawl 76 is formed with a tapered guide surface 78 in its lower portion, which surface is adapted to guide the tip portion 12*a* of the flexible material 12, when the tip portion 12*a* is introduced. A rotatable pawl 77 is positioned in a manner to oppose to the stationary pawl 76 and rotatably supported by the casing 74 by means of a pivot 79 extending transversely of the body proper 1. The surface of the rotatable pawl 7 facing the stationary pawl is of an arcuate shape and formed with a flexible material-holding serration 80 which is adapted to hold the flexible material 12 in cooperation with the stationary pawl 76, therebetween. There is provided a some clearance between the stationary pawl 76 and the flexible-material-holding serration 80, thereby providing a lead-in path 81 for the flexible material-lead-in path 81 in the transverse direction of the body proper 1 is a waste blowing hole 82. Projecting from the rear end of the rotatable pawl 77 is a 'L' shaped engaging piece 83.

Figure 13:
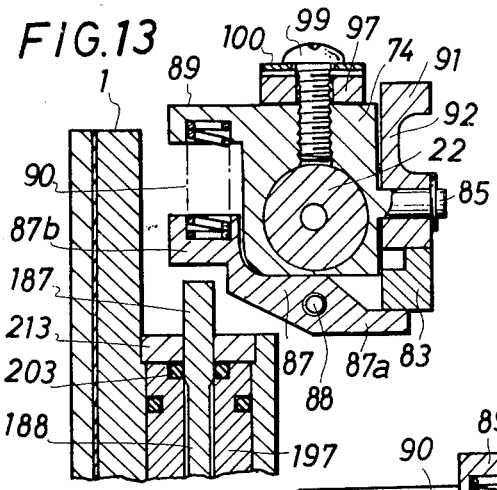
FIG. 13 is a transverse cross-sectional view showing a flexible material gripping mechanism.

One end 87*a* of link 87, as shown in FIG. 13, abuts the lowermost portion 86 of the 'L' shaped engaging piece 83 all the times. An intermediate portion of the link 87 is rotatably supported by the casing 74 by means of a pivot 88 secured to the casing 74, while the other end portion 87*b* of the link 87 is positioned on the back side of the casing 74. As shown in FIG. 13, a compression spring 90 is confined between the other end portion 87*b* and a spring receiving portion 89 which projects rearwards from the upper end portion of the casing 74. The link 87 is so loaded as to rotate in the counter-clockwise direction under the action of the compression spring 90 all the time, as viewed in FIG. 13, so that the end portion 87*a* of the link 87 tends to lift the 'L' shaped engaging piece 83, and the rotatable pawl 77 is urged so as to rotate in the counter-clockwise direction all the times as viewed in FIGS. 9 to 11. As a result, the width of the flexible material-lead-in path 81 is maintained so as to be narrowed.

An actuating lever 84 is positioned above the rotatable pawl 77 and rotatably supported by the casing 74 by means of a pivot 85. The pivot 85 is positioned above and rearwardly of the pivot 79 provided for the rotatable pawl 77. The actuating lever 84 is of a 'L' shape and consists of a flexible-material-tip detecting piece 91 and an engaging piece 92. The flexible-material-tip-detecting piece 91 extends in parallel with the piston rod 22, when the actuating lever 84 is closed, and positioned above the flexible-material-lead-in path 81, while the engaging piece 92 extends downwards from the flexible-material tip-detecting piece 91. The lower end of the engaging piece 92 is formed with an arcuate portion or projecting portion 93 which is formed with an engaging-rear surface 94 and engaging-lower-end surface 95, the former presenting a radius and the latter presenting an arcuate shape.

Figure 9:
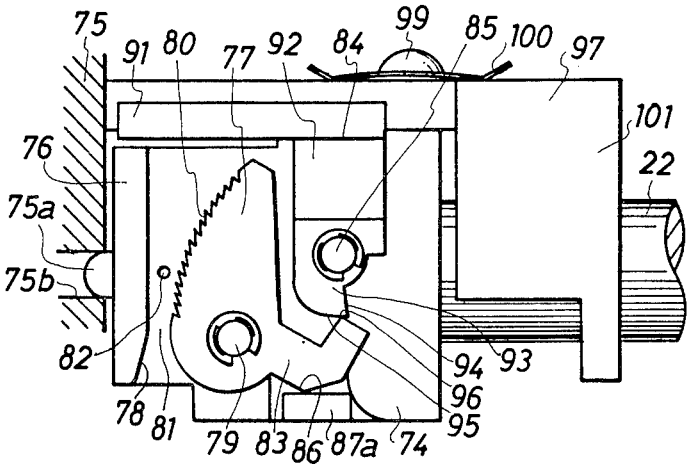

As shown in FIG. 9, when the tip of the flexible material 12 does not make ingress into the flexible-material-lead-in path 81, the engaging lower-surface 95 of the actuating lever 84 contacts the engaging piece 83 of the rotatable pawl 77 at a contacting point 96. In this case, the engaging piece 83 is given a moment so as to rotate in the counter-clockwise direction by an upward force of the link 87, so that a force directed towards the pivot 85 acts on the actuating lever 84 from the contacting point 96. As a result, a tendency to rotate the actuating lever 84 by the weight of the flexible material-tip-detecting piece 91 may be eliminated by friction produced at yhe contacting point 96 between the two members, so that a closed condition as shown in FIG. 9 is maintained. At the same time, the rotatable pawl 77 is prevented from being rotated by the downward reaction from the engaging lower surface 95, because the pivot 85 is fixed in the vertical direction as shown.

Figure 12:
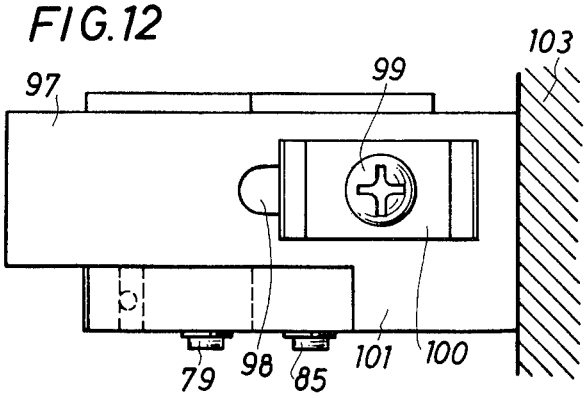

A slide plate 97 is slidably mounted on the top surface of the casing 74, with a rivet 99 fitted in an elongated hole 98. A slike hold down piece 100 is interposed between a head of the rivet 99 and the slide plate 97, thereby guiding the lateral movement of the slide plate 97. As shown in FIG. 12, an actuating-lever-return-drive portion 101 projects from the rear end portion of the slide plate 97. As shown in FIG. 12, an actuating-lever-return-drive portion 101 projects from the rear end portion of the slide plate 97 in the transverse direction of the body proper. The front half of the slide plate 97 is positioned to the rear of the actuating lever 84, so that slide plate 97 does not interfere with the opening and closing operations of the actuating lever 84. The actuating lever-return-drive portion 101 abuts the rear end side of the actuating lever 84 so as to prevent the actuating lever 84 from being turned backwards. On the other hand, the drive portion 101 urges the actuating lever 84 front by abutting a front wall portion 103 of a housing portion 104 of the secondary tightening cylinder mechanism 21 on the retracting stroke of the piston rod 22.

Figure 10:
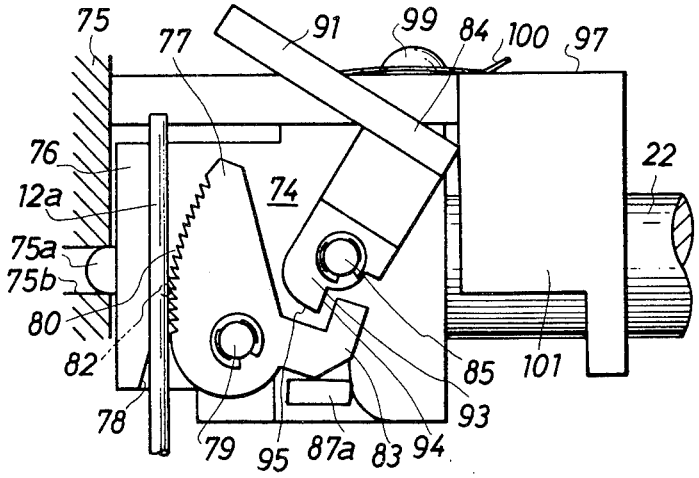

When the flexible material 12, which has been led out from the flexible material-lead-out hole 48 in the ring-shaped guide member 2, is fed into the flexible material gripping mechanism 23 as shown in FIG. 9, and the tip 12*a* of the flexible material 12 is introduced into the flexible-material-lead-in path 81, then the tip 12*a* of the flexible material 12 abuts the flexible-material-tip detecting piece 91, so that, as shown in FIG. 10, the flexible-material-tip-detecting piece 91 is lifted. As a result, a lower engaging surface 95 of the actuating lever 84 is rotated in the clockwise direction, thereby releasing its engagement with the engaging piece 83 of the rotatable pawl 77. On the other hand, the engaging piece 83 engages the rear end surface 94 of the actuating lever 84, and pushes the end surface 94 forwards due to a lifting force of the end portion 87*a* of the link 87, which force is produced by the compression spring 90, so that the actuating lever 84 may be rotated in the clockwise direction to a large extent. Simultaneously with the rotation of the actuating lever 84, the rotatable pawl 77 as well is rotated in the counter-clockwise direction by a lifting force of the end portion 87*a* of the link 87, so as to hold the tip portion 12*a* of the flexible material 12, in cooperation with the stationary pawl 76.

Figure 11:
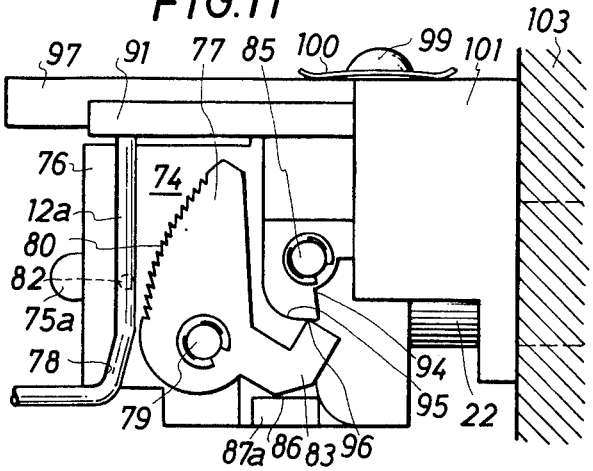

The piston rod 22 begins retracting from this condition according to the secondary tightening operation by the secondary tightening cylinder mechanism 21. Then, in the course of the retracting stroke of the piston rod 22, the flexible material 12, which has been wound around the bundle of a material 35, is cut off by means of a cutter mechanism 16. Then, the piston rod 22 further retracts, so that as shown in FIG. 11 the actuating-lever-return-drive portion 101 for the slide plate 97 abuts the front wall portion 103 of the housing portion 104 in the secondary tightening cylinder mechanism 21, and thus the drive portion 101 can no longer retract. When the piston rod 22 further retracts, then the slide plate 97 slides in the front direction relative to the casing 74, so that the actuating-lever-return-drive portion 101 forces the actuating lever 84 forwards to rotate the lever 84 in the counter-clockwise direction. As a result, the engaging rear end surface 94 is disengaged from the 'L' shaped engaging piece 83, whereupon the engaging lower end surface 95 is brought into engagement with the 'L' shaped engaging piece 83. This produces at the contacing point 96 a force for the rotatable pawl 77 to urge the actuating lever 84 towards the pivot 85. During this time, the rotatable pawl 77 is rotated in the clockwise direction by means of the engaging rear end surface 94 against a force of the compression spring 90, thereby enlarging the width of the flexible-material-lead-in path 81.

When the piston rod 22 is advanced, i.e., moved to the left as viewed in the drawing, from this condition, then the actuating lever 84 may be positively returned to a condition shown in FIG. 9, with the rear end of the lever 84 bein in abutment with the actuating-lever-return-drive portion 101. In this respect, the rear end of the lever 84 is not detached from the drive portion 101 due to vibrations or an impact acting on the casing 74 inadvertently. During the course, in which the width of the flexible-material-lead-in path 81 is being enlarged and the piston rod 22 is being advanced to the left, air is injected through the waste-blowing hole 82 to blow away the tip portion 12*a* of the flexible material 12 which has been cut off.

As is apparent from the foregoing description, the width of the flexible material lead-in path 81 which is to be defined between the stationary pawl 76 and the rotatable pawl 77 in the flexible material gripping mechanism 23 is enlarged to an extent larger than the diameter of the flexible material 12, so that the tip of the flexible material 12 may strongly force the flexible-material-tip-detecting piece 91 upwards, and thus there results positive gripping of the flexible material 12. In addition, a stable or reliable operation may be achieved for the actuating lever 84 which tends to respond to an external force sensitively, because of the provision of the slide plate 97 which protects the actuating lever 84 from the influence of an external force. In addition, this prevents a danger of the flexible-material-lead-in path 81 being closed, due to vibrations and an impact acting on the piston rod, before the tip portion 12*a* of the flexible material 12 is introduced into the flexible-material-lead-in path 81 on the advancing stroke of the piston rod 22. As a result, the flexible material 12 may be positively gripped and a waste cut of the flexible material 12 may be blown away positively.

In this manner, the flexible material tip portion 12*a* is strongly gripped by the flexible material gripping mechanism 23 and then the primary tightening operation is completed due to a reverse rotation of the feed-in primary tightening roller mechanism 13. This is then followed by the secondary tightening operation by the secondary tightening cylinder mechanism 21, whose construction and operation will be described with reference to FIGS. 15 to 17, hereinafter. The secondary tightening mechanism 21 includes a front wall member 108, a main cylinder 106 and a cylinder cap 107, all of which are fitted in a hollow portion 105 defined in a housing 104 positioned on top of the grip portion 7 of the body proper 1. The front wall member 108 disposed at the left and of the hollow portion 105 is of a ring shape, while an O-ring 110 is fitted in a central annular recess 109.

The hollow portion 105 extends from the left end to the right end of the housing portion 104, while an opening portion 111 is defined at the left end of the housing portion 104 so as to admit the piston rod 22 therein.

The left end portion of the main cylinder 105 intimately contacts the front wall member 108, with a front bumper 112 sandwiched between the front wall member 108 and the left end portion of the main cylinder 106. Open in the right portion of the front bumper 112 is an air port 113 which is associated with retraction of the secondary tightening cylinder mechanism 21. Provided in a retracting air passage 114 lef from the retracting air port 113 is a check valve 115, through which working iar may be supplied only through the retracting air passage 114 into the main cylinder 106, while air is prevented from being discharged through the retracting air passage 114 from the interior of the main cylinder 106.

The left end portion of the cylinder cap 107 intimately contacts the main cylinder 106, while the right end portion of the cap 107 protrudes from the hollow portion 105 in the housing portion 104, and closes the hollow portion 106. Positioned to the left of the cylinder cap 107 is ring-shaped bumper 116 which faces the main cylinder 106. In advancing air port 117 is open to the right of the rear bumper 116, and leads to an advancing air passage 118 provided in the housing portion 104.

Positioned within the main piston 121 inwardly of the piston rod 22 integral with the main piston 121 is an air bleed valve 122 which consists of an air bleed valve cylinder 120 defined within the main piston 121 and piston rod 22, and an air bleed valve piston 123 which slidingly moves within the air bleed valve cylinder 120. The air bleed valve cylinder 120 includes a air-bleed-valve-large-diameter-cylinder portion 124 defined in the main piston 121, and an air-bleed-valve-small-diameter-cylinder portion 125 defined in the piston rod 22. The air-bleed-valve-arge-diameter portion 124 is continuous with the interior of the sales cylinder 106. A retaining ring 126 is fitted within the air-bleed-valve-large-diameter portion 124 in the righthand position thereof. A first communicating hole 127 is provided in the left-hand position of the air-bleed-valve-large-diameter-cylinder portion 124 and open to the retracting air port 113 for the main cylinder 106 in the radial direction of the main-piston-small-diameter portion 128 of the main piston 121. A second communicating hole 132 is provided in the middle portion of the air-bleed-valve-small-diameter portion 125 and open in the radial direction of the piston rod 22. As can be seen from FIG. 15, the position of the second communicating hole 132 is to the right of the )-ring 110, when the main piston 121 is displaced leftwards through the main cylinder 106 and abuts the front bumper 112, so that working air will not leak from the interior of the main cylinder 106, i.e., from the housing portion 104 to the exterior. In addition, the provision of the O-ring 110 prevents the leakage of air through the communicating hole 132 by way of an air bleed passage 128 extending through the piston rod 22 axially, and an air bleed passage 131 defined in the air-bleed-valve-small-diameter-piston portion 130 to the exterior of the housing portion 104. Still furthermore, the provision of the O-ring 110 prevents the leakage of air through between the housing portion 104 and the main cylinder 106 and between the housing portion 104 and the front wall member 108.

The air bleed passage 131 is so designed as to communicate with the second communicating hole 132, when the air-bleed-valve piston 123 is urged against the left-hand wall of the air-bleed-valve cylinder 120.

The air-bleed-valve piston 123 consists of the air-bleed-valve-small-diameter piston portion 130 and air-bleed-valve-large diameter-piston portion 133 is axially displaced within the air-bleed-valve-large diameter-cylinder portion 124. An air pressure is applied through the first communicating hole 127 to a shoulder portion 130 between the air-bleed-valve-large-diameter-piston portion 133 and the air-bleed-valve-small-diameter-piston portion 130, even when the air bleed valve piston 123 is urged against the left-hand wall of the air bleed valve cylinder 120.

Figure 15:
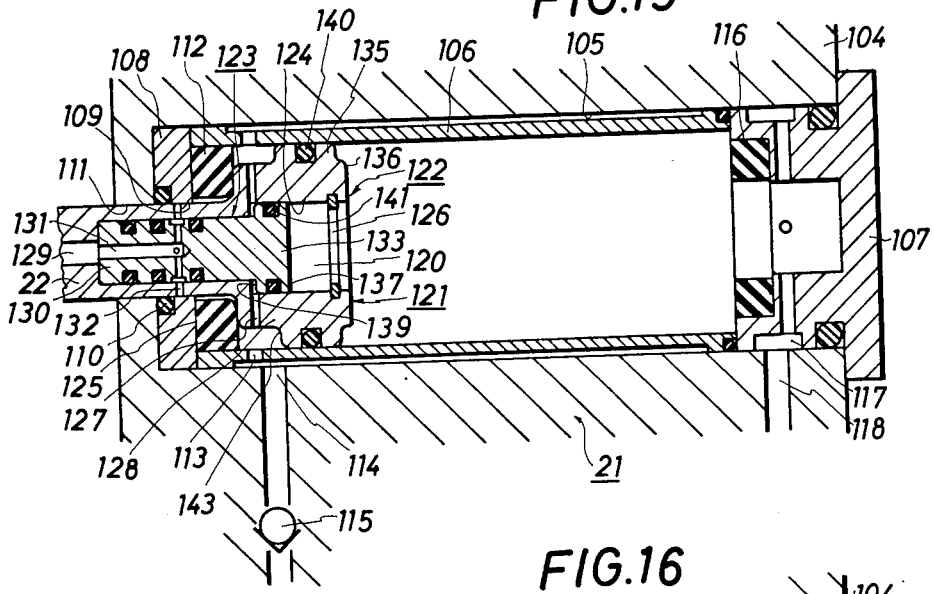
Figure 16:
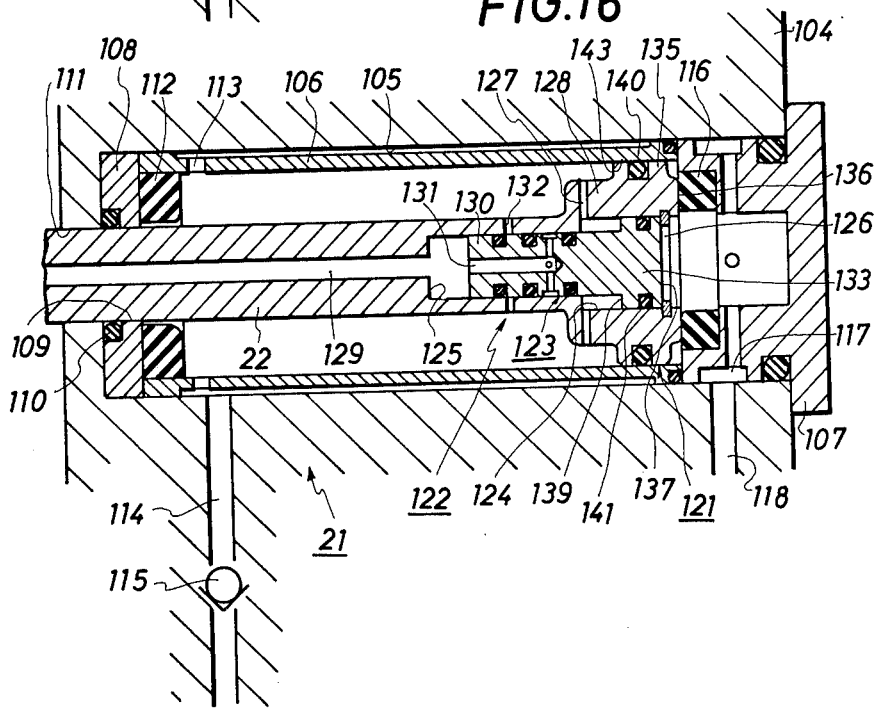
Figure 17:
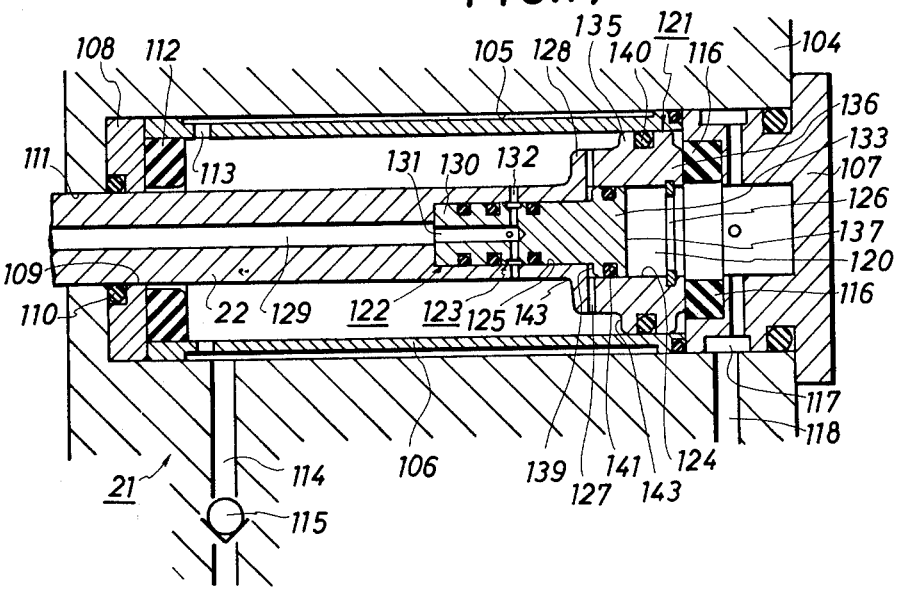

The operational modes of the secondary tightening cylinder mechanism 21 are shown in FIGS. 15 to 17. FIG. 15 shows a condition wherein working air is supplied from the advancing air port 117 into the interior of the main cylinder 106. FIG. 16 shows a condition where working air is supplied from the retracting air port 113 into the interior of the main cylinder 106. FIG. 17 shows a condition where the moving direction of the air bleed valve piston 123 is reversed, immediately after working air has been supplied into the advancing air port 117 from a condition shown in FIG. 16. Under the condition shown in FIG. 15, an air pressure is applied to the right end surface 136 of the main-piston-large-diameter portion 135 of the main piston 121 as well as to the right end surface 137 of the air bleed valve piston 123, so that the main piston 121 abuts the front bumper 112 and the air-bleed-valve piston 123 is urged against the left-hand wall of the air-bleed-valve cylinder 120. At this time, the first communicating hole 127 assumes a position which allows the application of an air pressure to the shoulder portion 139 of the air-bleed-valve piston 123, and is communicated with the retracting air port 113. On the other hand, the second communicaing hole 132 is communicated with the air bleed passages 129 and 131. The working air from the advancing air port 117 is prevented from leaking into the communicating holes 127, 132 by means of an O-ring 140 fitted in the main-piston-large-diameter portion 135 and an O-ring 141 fitted on the air-bleed-valve-large-diameter-piston 133, so that working air will not absolutely leak into the air bleed passage 129.

Subsequently, when the secondary tightening cylinder switching timer 144 is switched and residual air is discharged through the advancing air port 117, working air is supplied into a retracting air port 113. Then, an air pressure is applied to a shoulder portion 143 of the main piston 121 to urge the main piston 121 to the right, while an air pressure is rightwardly applied through the first communicating hole 127 to a shoulder portion 139 of the air bleed valve piston 123, thereby displacing the air bleed valve piston 123 to the right to be urged against the retaining ring 126. As a result, the second communicating hole 132 is shut off from the communication with the air bleed passage 131, so that working air to be supplied through the retracting air port 113 into the interior of the main cylinder 106 is prevented from being bled through the air bleed passage 129. As shown in FIG. 16, the main piston 121 moves to the right to abut the rear bumper 116, with the air bleed valve piston 123 urged against the retaining ring 126.

Subsequently, when the secondary cylinder switching timer 144 is switched and working air is supplied to the advancing air port 117, then as shown in FIG. 17, a pressure is applied to the right end surface 137 of the air bleed valve piston 123 leftwardly, thereby uring the air bleed valve piston 123 against the left end of the air bleed valve cylinder 120. As a result, the second communicating hole 132 is brought into communication with the air bleed passage by way of the air bleed passage 131, so that working air which has been supplied from the retracting air port 113 to the interior of the main cylinder 106 so as to serve as a back pressure on the main piston 121, is injected by way of the air bleed passage 129 through the waste cut blowing hole 82 defined in the tip portion of the piston rod 22. Thereafter, an air pressure is applied to the main piston 121 leftwardly, and thus the piston 121 moves to the left.

The timer 144 is connected to the retracting air port 113 for operating the secondary tightening cylinder mechanism 21 having the aforesaid arrangement, and housed within the grip portion 7 along the length thereof, as shown in FIG. 1. A timer actuating valve 145 for actuating the timer 144 is housed in an intermediate portion between the grip portion 7 and the housing portion 104 in the transverse direction of the body proper 1 therethrough.

Figure 18:
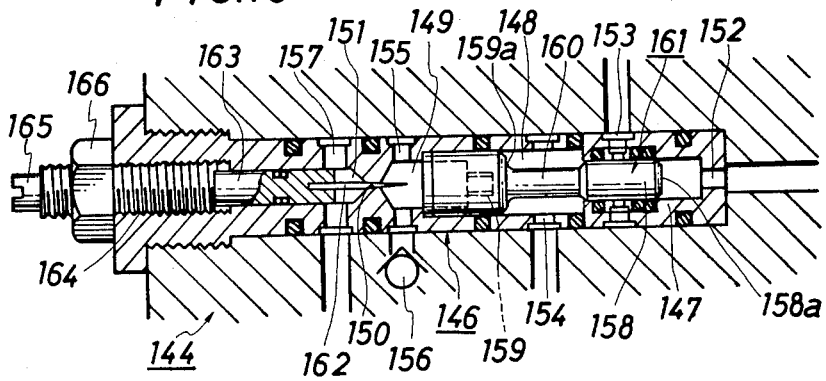
FIG. 18 is a longitudinal cross-sectional view of a timer which produces a signal for starting the secondary tightening operation.

The construction and operations of the timer 144 and timer actuating valve 145 will be described in detail with reference to FIGS. 18 and 19. Referring to FIG. 18, a timer valve cylinder 146 is housed in the grip portion 7. The timer valve cylinder 146 defines from right to left in the axial direction a small diameter chamber 147, a large diameter chamber 149, an accumulator chamber 149, a throttle portion 150 and an adjusting chamber 151. A pilot air input port 152 is open into the small diameter chamber 147 from fight and communicated with a trigger valve 9. An output air port 153 is open into the small diameter chamber 147 from its middle portion and communicated with the retracting air passage 114. An input air port 154 is open into the large diameter chamber 148 from its middle portion and communicated with the timer actuating valve 145. An air port 155 is open into the accumulator chamber 149 provided with a quick discharge valve 156, and communicated with an input air port 154. An input air port 157 is open into the adjusting chamber 151 and communicated with the input air port 154.

Fitted and axially movable in the small diameter 147 and large diameter chamber 148 is a timer valve piston 161 which consists of a timer-small-diameter-piston portion 158 and a timer-large-diameter-piston portion 159 that are coupled together by a rod 160. The timer valve piston 161 moves to the left due to the right end surface 158*a* of the timer-small-diameter-piston portion 158 being subjected to a working air pressure, so that the timer-large-diameter-piston portion 159 is urged against the left-hand wall of the diameter chamber 148. There is a difference in diameter between the timer-small-diameter-piston portion 158 and the timer-large-diameter-piston portion 159, so that the timer-large-diameter-piston portion 159 is maintained urged against the left-hand wall of the large diameter chamber 148 due to a working air pressure from the input air port 154. Working air is supplied to the input air port 154 so as to maintain the timer valve piston 161 urged against the left-hand wall of the large diameter chanber 148, even in case working air is shut off from the communication with the pilot air input port 152.

Part of the accumulator chamber 149 may be defined in the timer-large-diameter-piston portion 159 as required. When the pressure of working air which has been introduced through the throttle portion 150 into the accumulator chamber is built up to some pressure level, then the pressure overcomes the a working pressure acting on the right end surfact 159*a* of the timer-large-diameter-piston portion 159, thereby forcing the timer valve piston 161 to the right until the timer-small-diameter-piston portion 158 is urged against the right-hand wall of the small diameter chamber 147. This causes the input air port 154 to be brought into communication with the output air port 153, so that working air is supplied from a compressor not shown by way of a trigger valve 9 and timer actuating valve, to the retracting air port 113 in the secondary tightening cylinder mechanism 21, so that the air-bleed-valve piston 123 is moved to the right, and then the main piston 121 is moved to the right, so that the piston rod 22 is retracted into the main cylinder 106. In this manner the secondary tightening operation is carried out.

A period of time during which a pressure of working air is built up in the accumulator chamber 149 to a given pressure level corresponds to a delay of time between the time when working air is introduced into the input air port 154 and the time when the working air appears at the output air port 153. During this period of time, the primary tightening operation is accomplished due to the reverse rotation of the feed-in, primary tightening roller mechanism 13. A flow-passage-area-adjusting needle 162 is provided in the throttle portion 150 so as to move towards or from the accumulator chamber 149. The flow-passage-area-adjusting needle 162 projects from the right end of the adjusting rod 163. A male-thread portion 164 is provided on the left portion of the adjusting rod 163. The male-thread portion 164 projects to the left from the left end of the timer valve cylinder 146 and is provided with a throttling adjusting level 165 on its left end portion. The throttling adjusting portion 165 is positioned in the lower portion of the grip portion 7 as shown in FIG. 1. The throttling adjusting portion 165 is rotated by means of a screw-driver or the like, so that the extent of the flow-passage-area-adjusting needle 162 to make ingress into the accumulator chamber 149 may be determined, and the air passing area in the throttle portion 150 is determined accordingly. In this manner, a time delay from the starting of the primary tightening operation until the starting of the secondary tightening operation may be adjusted.

The male-thread portion 164 is secured to the timer valve cylinder 146 with the aid of a lock nut 166. The timer 144 is novel in that respective components of the time are assembled in coaxial relation.

Figure 19:
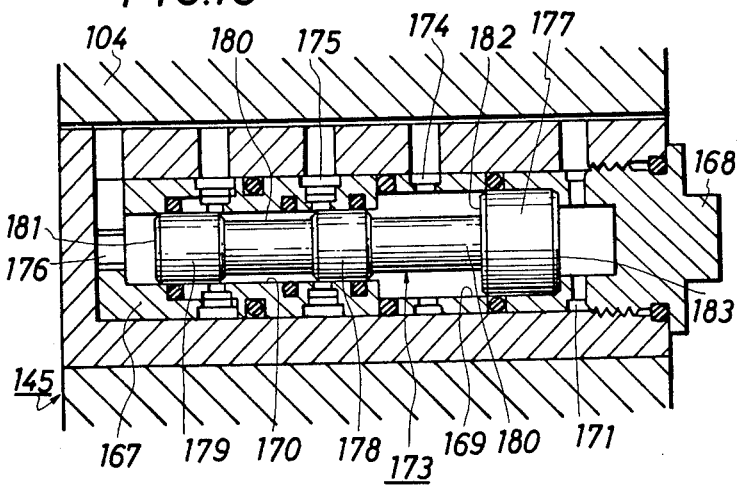
FIG. 19 is a longitudinal cross-sectional view of a timer-actuating valve.

Referring to FIG. 19, a timer actuating valve cylinder 167 extends through the body proper 1 transversely therethrough. A timer actuating valve piston 173 is slidingly fitted in the timer actuating valve cylinder 167. A cylinder cap 168 is threaded in the right end portion of the timer actuating valve cylinder 167, and the cylinder 167 includes a large diameter chamber 169 and a small diameter chamber 170. A pilot air input port 171 is open into the large diameter chamber 169 from the right-hand end, and the pilot air input port 171 is communicated with a port 201 for a pneumatic-motor-normal-reverse rotation switching valve 172 as well as with a cutter actuating valve 17. A self-maintaining air input port 174 is open into the large diameter chamber 169 in its middle portion and adapted to admit working air for maintaining the timer actuating valve piston 173 urged against the right-hand wall of the chamber 173.

An output air port 175 is open into the small diameter chamber 170 from its right portion and communicated with an input air port 154 in the timer 144.

A pilot air input port 176 is open into the small diameter chamber 170 from the left end thereof and communicated with an air output port 233 in the trigger valve 9, a pilot air input port 152 in the timer 144 and an advancing air port 117 in the secondary tightening cylinder mechanism 21.

The timer actuating valve piston 173 includes a large diameter piston portion 177 adapted to move through the large diameter chamber 169, a right-hand small diameter piston portion 178 and a left-hand small diameter piston portion 179 having the same diameter of that of the piston 178 movable through the small diameter chamber 170. Large diameter piston portion 177, and small diameter piston portions 178, 179, are integrally coupled together by means of a connecting rod 180.

An air plug 8 is connected to a compressor not shown, and working air is supplied by way of a trigger valve 9 to a pilot air input port 176, so that a pressure of working air is applied to a left and surface 181 of a left-hand small diameter piston portion 179 and hence a timer actuating valve piston 173 is biased to the right end position. As a result, a self-maintaining air input port 174 is shut off from the communication with an output air port 175, and working air is not supplied to an input air port 154, so that the timer 144 is not actuated.

Subsequently, when the trigger 11 is pulled, then the supply of working air to the pilot air input port 176 is interrupted, and working air is discharged. Simultaneously therewith, the working air is supplied from a compressor by way of the trigger valve 9 to the self-maintaining air input port 174. As a result, the timer actuating valve piston 173 remains urged to the right end position. When working air is supplied by way of a pneumatic motor normal-reverse rotation switching valve 172 to the pilot air input port, since a pressure acting through the self-maintaining air input port 174 on the left end surface 182 of the large diameter piston portion 177 is lower than a pressure acting on the right end surface 183 of the large diameter piston portion 177, the timer actuating valve piston 173 will move to the left. As a result, the self-maintaining air input port 174 is communicated with an output air port 175, so the working air is supplied by way of the trigger valve 9 to the input air port 157 in the timer 144 to actuate the timer 144.

Figure 14:
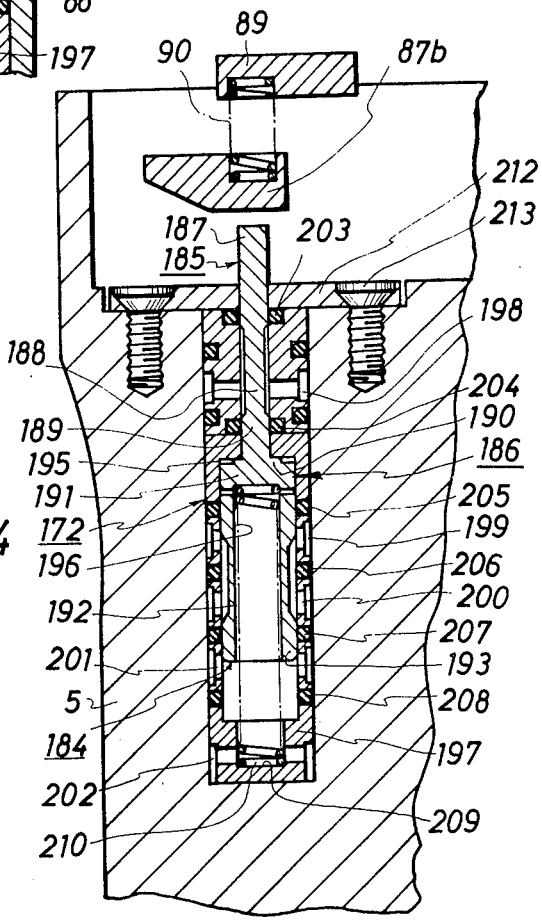
FIG. 14 is a longitudinal cross-sectional view of a cutting actuating valve.

As can be seen from FIG. 2, the pneumatic motor normal-reverse rotation switching valve 172 is positioned on the back side of the piston rod, and is mechanically actuated by means of the other end portion 87*b* of the link, which the tip portion of the flexible material 12 is gripped by the flexible material gripping mechanism 23. The pneumatic motor normal-reverse rotation switching valve 172 produces a pilot signal for starting the primary tightening operation, and is actuated by a low-load and low-stroke mechanical operation. A valve of the same type as that of the pneumatic motor normal-reverse rotation switching valve 172 is used as a cutter actuating valve 17. Thus the construction and operation of the pneumatic motor normal-reverse rotation switching valve 172 are described with reference to FIGS. 13 and 14. FIG. 14 shows a condition before the other end portion 87*b* of the link 87 is operated. The pneumatic motor normal-reverse rotation switching valve 172 is fitted in the supporting portion 5 of the body proper 1, and the top end of the valve 172 is held by a hold-down plate 212 and two screws 213. A valve stem 184 in the pneumatic motor normal-reverse rotation switching valve 172 is connected to a main valve stem 186 and a pilot valve stem 185 coaxially. The pilot valve stem 185 consists from above downwards an operating tip portion 187, a small diameter portion 188 of a diameter smaller than the diameter of the operating tip portion 187, an operating lower end portion 189 of the same diameter as that of the operating tip end portion 187, and a stopper portion 190 of a diameter larger than that of the operating lower end portion 189. The main valve stem 186 is of a cylindrical shape and continuous with the stopper portion 190. The main valve stem 186 is formed from above downwards with the stopper portion 190, a main-valve-stem-large-diameter portion 191, a main-valve stem-small-diameter portion 191, a main-valve stem-small-diameter portion 192 of a diameter portion 192 of a diameter smaller than the diameter of the main-valve-stem-large-diameter portion 191, and a main-valve-stem-lower-end portion 193 of the same diameter as that of the main-valve stem-large-diameter portion 191. There is provided a stepped portion between the stopper portion 190 and the main valve-stem-large-diameter portion 191. The stopper portion 190 and main-valve-stem-large-diameter-portion-top surface 194 provide abutting surfaces 195. A hollow portion 196 is defined through and the main-valve-stem-lower-end portion 193 of the main valve stem 186.

A valve cylinder, which is slidingly fitted the valve stem 186, is provided from above downwards with a pilot air port 198 communicated with the self maintaining air input port 174 in the timer actuating valve 145, an output port 199 communicated with a normal rotation air input port 211 in the pneumatic motor 57, an input port 200 communicated with a pilot air port 198, an output port 201 communicated with a pilot air input port 171 in the timer actuating valve 145, and a discharge port 202. Working air is supplied to the pilot iar port 198 all the times. The pilot air port 198 is open in the position to face the small diameter portion 188 of the pilot valve stem 185, while the ports 199, 200 are open in the positions to face the main-valve-stem-small-diameter portion 192 so as to be communicated with each other. The port 201 is open in the position lower than the main-valve-stem-lower-end portion 193. Accordingly, in the condition shown in FIG. 14, the port 301 is communicated with the discharge port 202.

An O-ring 203 is fitted on a connecting portion between the operating tip portion 187 of the pilot valve stem 185 and the small diameter portion 188, an O-ring 204 is fitted on a connecting portion between the small diameter portion 188 and the operating lower end portion 189, in contact with the operating lower end portion 189, an O-ring 205 is positioned right above the port 199, an O-ring 206 is positioned between the port 199 and the port 200, an O-ring 207 is positioned between the port 200 and the port 201, anO-ring 208 is positioned immediately under the port 201, the aforesaid O-rings being fitted in the valve cylinder 197 for sealing purpose. In the above positional relationship, there is a minute clearance between the operating lower end portion 189 and the valve cylinder 197, so that if a seal is removed, then the pilot air may be introduced from the pilot air port 198 by way of the trigger valve 9. A compression coil spring 210 is confined between the bottom of the hollow portion 196 in the main valve stem 186 and a bottom surface 209 of the valve cylinder 197, thereby uring the valve stem 184 upwards all the times.

The pneumatic motor normal-reverse rotation switching valve 172 is ready for the primary tightening operation in the aforesaid condition. When the tip portion of the flexible material 12 makes ingress into the flexible material lead-in path 81, then the actuating lever 84 is first rotated in the clockwise direction by means of the tip portion of the flexible material 12, thereby releasing the 'L' shaped engaging piece 83 of the rotatable pawl 77. As a result, the rotatable pawl 77 is rotated in the counter-clockwise direction by means of the link as shown in FIG. 10, while the link 87 is rotated in the counter-clockwise direction about the pivot 88 as shown in FIG. 13, thereby depressing the operating tip portion 187 of the pneumatic motor normal-reverse rotation switching valve 172. At this time, a vertical stroke of the other end portion 87*b* of the link 87 due to the rotation thereof is quite small. However, when the operating lower end portion 189 is shifted away from the O-ring 204 and the pilot-valve-stem-small-diameter portion 188 comes to face the O-ring, the stopper portion 190 is detached from the valve cylinder 197, so that working air pressure is applied from the pilot air port 198 through a clearance between the operating lower end portion 189 and the valve cylinder 197 on the abutting surface 195, thereby lowering the valve stem 184 up to the lowermost end of a stroke against a force of the compression coil spring 210. As a result, the portion 199 is closed with the main-valve-stem-large diameter portion 191, while the ports 200 and 201 are maintained communicated with each other by way of a passage defined between the main-valves-stem-small-diameter portion 192 and the valve cylinder 197. The communication between the port 201 and the discharge port 202 is shut off by means of the main-valve-stem-lower-end portion 193.

In this manner, valves such as pneumatic motor normal-reverse rotation switch valve 172 and cutter actuating valve 17 may be actuated by an small external force and a small stroke, while an output stroke may be increased, presenting quick and positive operation.

The primary tightening operation is completed by the reverse rotation of the aforesaid feed-in, primary tightening roller mechanism 13 and the gripping of the flexible material tip portion 12*a* by the flexible material gripping mechanism 23, with the piston rod 22 being fixed in its most advanced position. This operation is followed by the secondary tightening operation due in the retraction of the piston rod 22. The tightening-force adjusting mechanism 20 is so provided that the cutter mechanism 16 may be actuated, when a tension of the flexible material 12 reaches a given level in the course of the aforesaid secondary tightening operation.

The construction and operation of the tightening force adjusting mechanism 20 will be described with reference in FIGS. 1, 20 and 21. A pair of slide guide polates 215 are upright on a root portion of the stationary guide element 4 so as to guide the travelling of a flexible material hearing or receiving roller 214, the aforesaid pair of slide guide plates 215 being spaced a distance from each other. Provided in the peripheral surface of the flexible material receiving roller 214 is a flexible material receiving channel 225 of a 'U' shaped cross-section. A roller shaft 216 for the flexible material receiving roller 214 is secured to the bearing slide piston 217 which may be slide along the outer surfaces of the slide guide slates 215 in reciprocable fashion and secured to a back plate 219. An upper end portion 219*a* of the back plate 219 is secured to a tightening force adjusting rod 218 in the vertical direction, and the tightening force adjusting rod 218 is urged in the direction from the supporting portion 5 towards the stationary guide element 4 by means of a tension-setting compression spring 220, all the times. As a result, the flexible material receiving roller 214 is urged so as to be positioned as closer to the flexible material-lead-out hole 48 as possible.

A lower end portion 219*b* of the back plate 219 faces a valve stem operating tip portion 221 of the cutter actuating valve 17 which is housed in the supporting portion 5 and spaced a given distance from the valve stem-operating-tip portion 221. One end 220*a* of the tension setting compression spring 220 is secured to a spring receiving ring member 223 threaded on the tightening force adjusting rod 218, while the other end 220*b* of the spring 220 is secured to a tension adjusting screw 224. The tension adjusting screw 224 projects from the rear end of the supporting portion and thus may be manipulated from externally of the binder, so that a spring force of the tension setting compression spring 220 may be varied.

With the aforesaid tightening force adjusting mechanism 20, in the course of the secondary tightening operation wherein the tip portion 12*a* of the flexible material 12 is moved backwards of the body proper 1 by being gripped by the flexible material gripping mechanism 23, when an external force corresponding to the predetermined tension is applied from the flexible material 12 engaging the flexible material receiving roller 214 to the flexible material receiving roller 214, then the bearing slide plates 217 supporting the flexible material receiving roller 214 are slid from a still condition backwards of the stationary guide element 4 by overcoming the spring force of the tension setting compression spring 220. As a result, the lower end portion 219*b* of the back plate 219 presses the valve-stem-operating tip portion 221 in the cutter actuating valve 17, thereby switching the cutter actuating valve 17 so as to actuate the cutter mechanism 16, so that the flexible material 12 is cut on the opposite sides of a bound portion or a knot of the flexible material 12. At the same time, the supply of working air to the pneumatic motor 57 is interrupted so as to stop the pneumatic motor 57. In this embodiment, the flexible material 12 is cut, only when a tension on the flexible material 12 wound around the bundle of a material 35 is built up to a given level, so that there take place no looseness in a knot formed on a bundle of the material 35, unlike the prior art where a piston rod 22 is retracted a given stroke to cut the flexible material, irrespective of whether the diameter of a bundle of a material 35 is large or small. During this time, the feed-in, primary tightening roller mechanism 13 remains stopped, with a torque applied to the roller mechanism 13 so as to rotate in the reverse direction, so that a bundle of the material 35 remains substantially in the center of a central hole 34 in the ring guide member 2, being kept away from the inner peripheral wall 33 of the ring guide member 2.

The aforesaid cutter mechanism 16 is operated according to a signal from the cutter actuating valve 17. The cutter drive cylinder 14 is of a one way driven type, so that the return movement of the cutter 15 from the flexible material lead-in hole 39 and the flexible material lead-out hole 48 is effected by a force of the compression coil spring 227 confined between the cutter drive piston 226 and the back surface of the stationary guide element 4. The stationary guide element 4 is provided with two cutter guide holes 228, through which the cutters 15 are advanced or retracted across the flexible material lead-in hole 39 and the flexible material lead-out hole 48.

The trigger valve 19 is housed in the grip portion 7 along the length of the body proper as shown in FIG. 1, and includes a trigger valve stem 10 which is slidingly fitted in a trigger valve cylinder 229. A cap 230 having a flange portion 231 is threaded into the front end portion or left end portion of the trigger valve cylinder 229, and the trigger valve 9 in its entirety is fixed in the grip portion 7. The trigger valve cylinder 229 is provided from left to right with an air output port 231, air input port 232 and air output port 233.

Meanwhile, the trigger valve stem 10 is provided with an operating tip end portion 234 projecting in a manner to oppose to the trigger 11, and three piston portions 235, 237, in addition to a hollow portion 238 extending from the front end to the rear end of the stem 10. The hollow portion 238 serves as an air bleed hole for air which dwells within the trigger valve 9 for accelerating the operation of the trigger valve 9. When the trigger 11 is not pulled, the air output port 231 is shut off from the communication with the air input port 232 by means of the piston portion 236, while the air input port 232 and air output port 233 are both open between the piston portions 236 and 237 for mutual communication. At this time, the air output port 233 is communicated with the valve stem hollow portion 238, because the air output port 233 is shut off from the communication with the air input port 232 by means of the piston portion 236, and the piston portion 237 is detached from the O-ring 237*a*.

Figure 22:
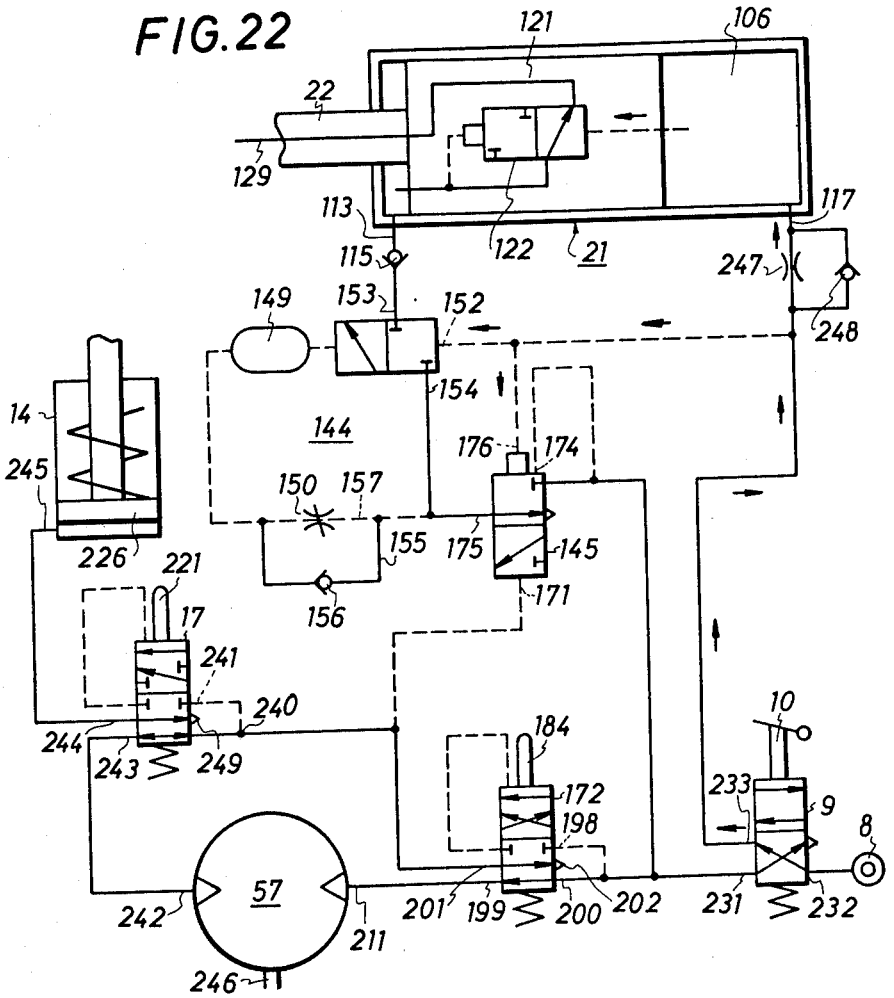

The returning movement of the trigger valve stem 10 is accomplished by the compression coil spring 239. Description has been thus far given of the components constituting the binder. Now, the construction and operation of the air-pressure-driven control circuits with reference to FIGS. 22 35. As shown in FIG. 22, an air input port 232 in the trigger valve 9 is communicated with the air plug 8. Working air is supplied by way of the air plug 8 from an air source not shown. The air output port 233 in the trigger valve 9 is communicated with the pilot air input port 176 in the timer actuating valve 145, pilot air input port 152 in the timer 144 and advancing air port 117 in the secondary tightening cylinder mechanism 21. The air output port 231 in the trigger valve 9 is communicated with the port 200 in the pneumatic motor normal-reverse rotation switching valve 172 as well as with the self-maintaining air input port 174 in the timer actuating valve 145.

The air port in the pneumatic motor normal-reverse rotation switching valve 172 is communicated with air output port 231 in the aforesaid trigger valve 9, as well as with the pilot air port 198 in the pneumatic normal-reverse rotation switching valve 172. The air port 199 in the pneumatic motor normal-reverse rotation switching valve 172 is communicated with the normal rotation air input port in the pneumatic motor 57. The air port 201 is communicated with the air port 240 in the cutter actuating valve 17, and the air port 240 is also communicated with the pilot air input port 241 in the cutter actuating valve 17.

The normal rotation input port 211 in the pneumatic motor 57 is communicated with the air port 199 in the pneumatic motor normal-reverse rotation switching valve 172, while the reverse-rotation-air input port 242 is communicated with the air port 243 in the cutter actuating valve 17. The pneumatic motor 57 is provided with a discharge air port 246.

The air port 240 in the cutter actuating valve 17 which has been communicated with the reverse-rotation-air-input port 242 in the pneumatic motor 57 is communicated with the port 201 in the pneumatic motor normal-reverse rotation switching valve 172 as well as with the pilot air input 171 in the timer actuating valve 145. The air port 240 is also communicated with the self-maintaining air input port 241 in the cutter actuating valve 17. The air port in the cutter actuating valve 17 is communicated with the advancing air port 245 in the cutter drive cylinder 14. The cutter actuating valve 17 is provided with a discharge port 249.

The self-maintaining air input port 174 in the timer actuating valve 145 is communicated with the air port 200 in the pneumatic motor normal-reverse rotation switching valve 172, while the pilot air input port 171 is communicated with the air port 201 in the pneumatic motor normal-reverse rotation switching valve 172. The output port 175 in the timer actuating valve 145 is communicated with the input air port 154 in the timer 144, and the input air port 154 is also communicated with a quick-discharge valve 156 leading to the air port 155, and with the input air port 157. The pilot air input port 176 in the timer actuating valve 145 is communicated with the air output port 233 in the trigger valve 9.

The pilot air input port 152 is communicated with an air output port 233 in the trigger valve 9 as well as with the pilot air input port 176 in the timer actuating valve 145. The output air port 153 to the timer 144 is communicated by way of a check valve 115 with a retracting air port 113 in the secondary tightening cylinder mechanism 21. The input air port 154 to the timer 144 is communicated with the air port 155, an input air port 157, and an output air port 175 in the timer actuating valve 145. The output air port 153 in the timer 144 is communicated by way of a check valve 115 with a retracting air port 113 in the secondary tightening cylinder mechanism 21. The input air port 154 in the timer 144 is communicated with the air port 155, an input air port 157, and an output air port 175 in the timer actuating valve 145.

The advancing air port 117 in the secondary tightening cylinder mechanism 21 is communicated with the throttle portion 247 and a check valve 248 in parallel relation.

Figure 23:
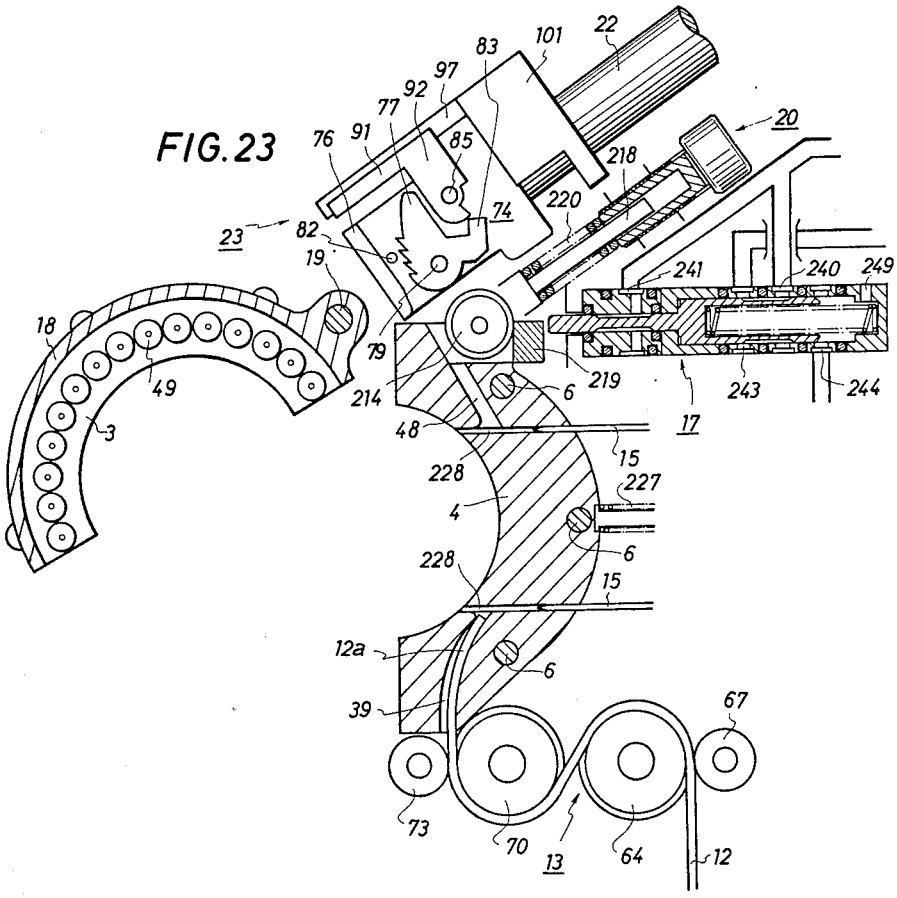

The initial condition of the binding-drive and control circuit thus arranged is shown in FIG. 22, in which when the air plug 8 is connected to a working air source such as a compressor or the like, working air is supplied by way of a trigger valve 9 to the advancing air port 117 in the secondary tightening cylinder mechanism 21 as well as to the pilot air input port 176 in the timer actuating valve 145 and the pilot air input port 152 in the timer 144. In the condition there the cylinder mechanism 21 is connected to a working air source, the main piston 121 in the secondary tightening cylinder mechanism 21 is biased to the left extermity as viewed in FIG. 22, and the air bleed valve piston 123 is biased to the left extermity. The self-maintaining air input port 174 is shut off from the communication with the input air port 154 in the timer 144, and thus the timer is not in operation. As shown in FIG. 23, during this time, the movable guide element 3 is open relative to the stationary guide element 4, while the flexible material tip portion 12*a* is inserted into the flexible material lead-in hole 39 in the stationary guide element 4. The flexible material gripping mechanism 23 is positioned above the flexible material lead-out hole 48 in the stationary guide element 4, and the actuating lever 84 remains closed.

Figure 24:
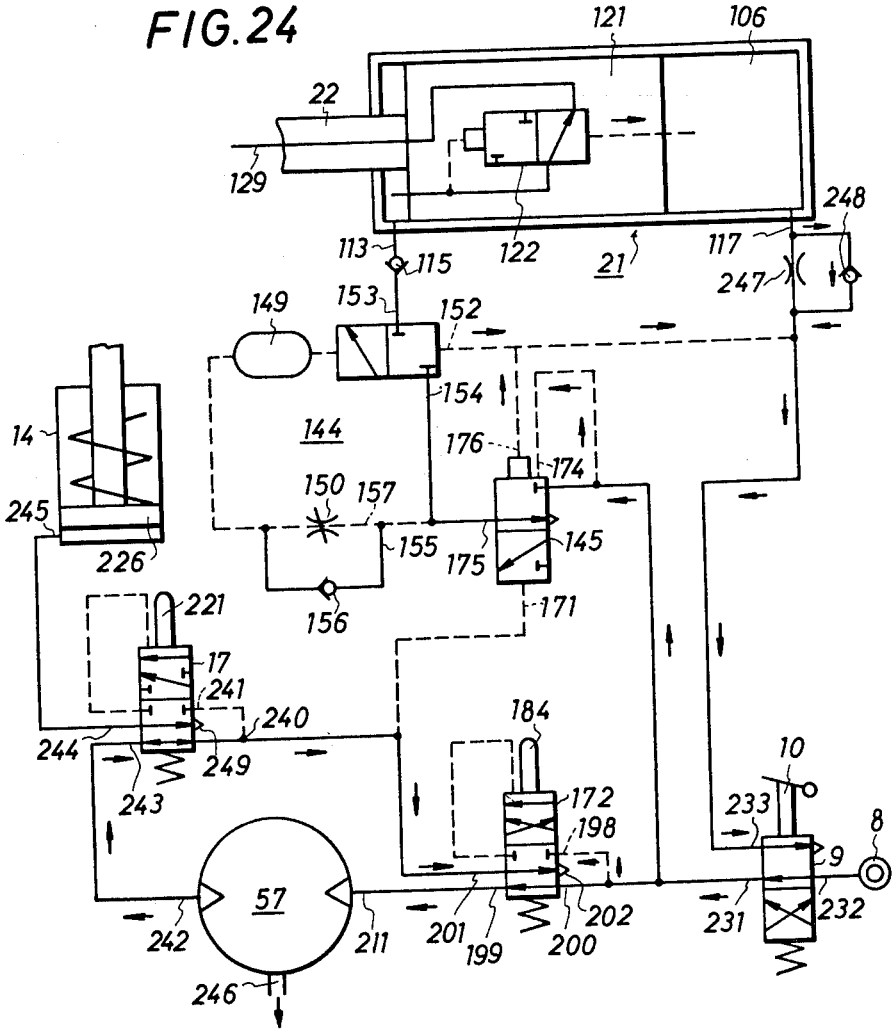
Figure 25:
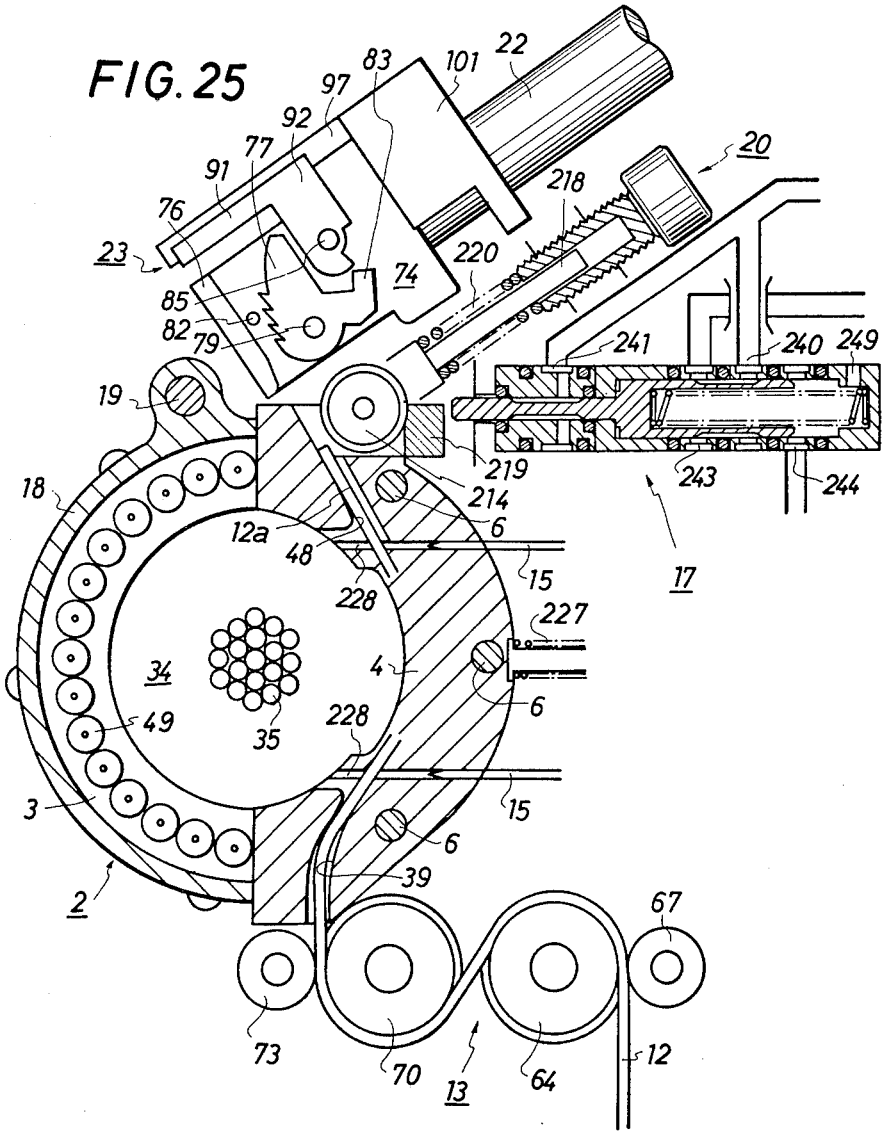

As shown in FIG. 25, when a bundle of the material 35 is introduced into the central hole 34 in the ring-shaped guide member 2 and the trigger 11 is pulled in the conditions shown in FIGS. 22 and 23, the movable guide element 3 is rotated towards the stationary guide element 4, thereby closing the ring shaped guide member 2. Thereafter, when the trigger 11 is pulled towards the grip portion 7, then the trigger 11 compresses the actuating compression spring 27, and then the trigger 11 presses the trigger valve stem 10, thereby switching the trigger valve 9. As can be seen from FIG. 24, the air input port 232 in the trigger valve 9 is in turn communicated with air output port 231, air port 200 in the pneumatic motor normal-reverse rotation switching valve 172, air port 199, and then the normal rotation air input port 211 in the pneumatic-motor 57, so that working air is supplied to the pneumatic motor 57, thereby causing the normal rotation in the motor 57. A majority of working air which has been consumed in the pneumatic motor 57 is discharged through an exhaust port 246 in the pneumatic motor 57. Part of residual air is discharged by way of reverse rotation input port 242, air ports 243, 240 in the cutter actuating valve, and air port 201 in the pneumatic motor normal-reverse rotation switching valve 172, and then through an exhaust port 202 to the atmosphere. Part of residual air in the pneumatic motor 57 is supplied to the pilot air input port 171 in the timer actuating valve 145, although the timer actuating valve 145 will not be switched. This is because working air supplied to the self-maintaining input port 174 in the cutter actuating valve 145 from the air output port 231 in the trigger valve 9. The feed-in primary tightening roller mechanism 14 is rotated in the normal direction due to the drive of the pneumatic motor 57 in the normal direction, so that the flexible material 12 may go around a bundle of the material 35 along the guide channel 32 in the ring-shaped guide member 2 and led out from the flexible material lead out hole, by way of the flexible material receiving roller 214, then into the flexible material lead-in path 81.

FIG. 24 shows the connection of a circuit for use in feeding operation of the flexible material 12, while the operation of the mechanisms is shown in FIG. 25.

Figure 27:
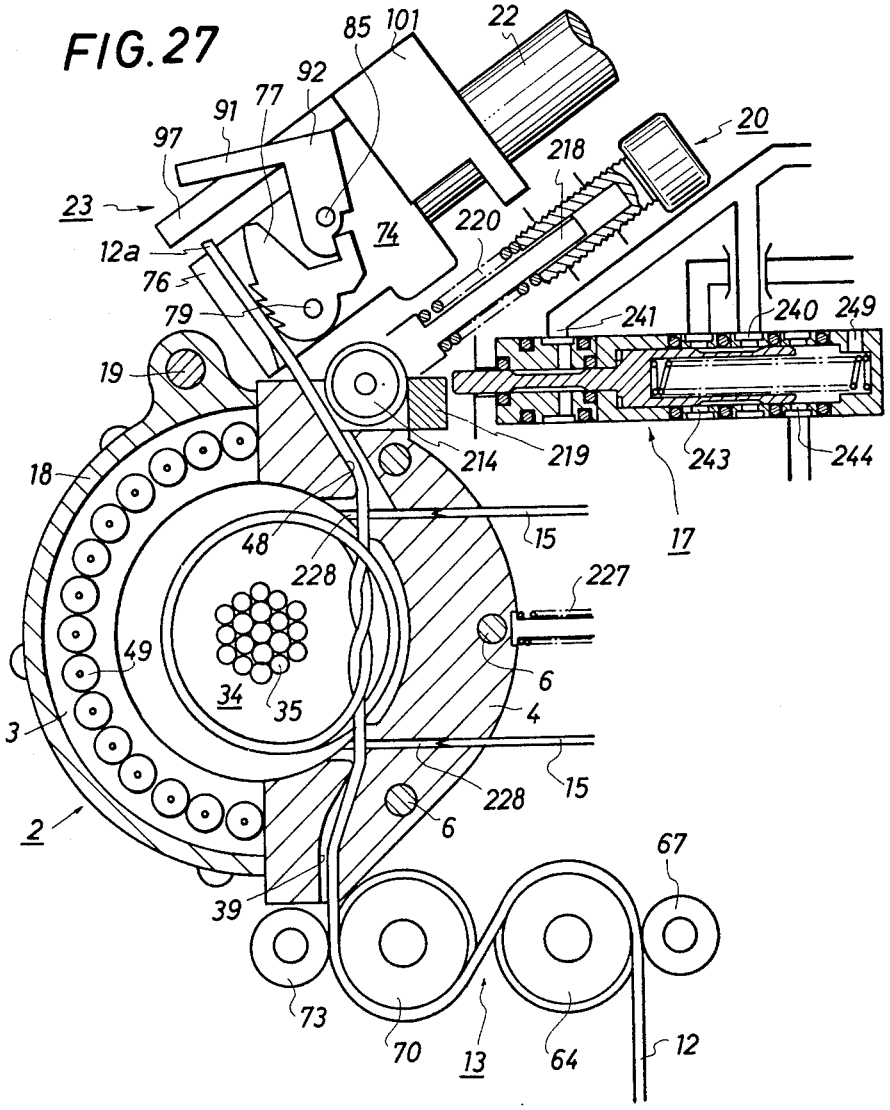

As shown in FIG. 27, the tip portion 12*a* of the flexible material is inserted into the flexible material lead-in path. When the tip portion 12*a* of the flexible material lifts the flexible material tip detecting piece 91 of the actuating lever 84, then the actuating lever 84 is slightly rotated in the clockwise direction, so that the engaging lower end surface 95 of the actuating lever 84 is disengaged from the 'L' shaped engaging piece 83 of the rotatable pawl 77, and thus the rotatable pawl 77 is rotated in the counter-clockwise direction. As a result, the operating tip portion 187 of the pneumatic motor normal-reverse rotation switching valve 172 is pressed by the link 87, thereby switching the pneumatic motor normal-reverse rotation switching valve 172. Due to the above switching of the pneumatic motor switching valve 172, working air which has been supplied through the self-maintaining air input port 174 maintains the valve stem 184 in position. When the pneumatic motor normal-reverse rotation switching valve 172 is self-maintained, working air is supplied by way of the air plug 8, air input port 232 in the trigger valve 9, air output port 231, air ports 200, 201 in the pneumatic motor normal-reverse rotation switching valve 172, and air ports 240, 243 in the cutter, actuating valve 17, to the reverse rotation air input port 242 for the air motor 57, thereby causing the reverse rotation in the pneumatic motor 57. The reverse rotation of the pneumatic motor 57 causes the feed-in primary tightening roller mechanism 13 to rotate in the reverse direction, so that the primary tightening operation is started, with the flexible tip portion 12*a* gripped by the flexible gripping mechanism 23 fast. In other words , the flexible material 12 is drawn back through the flexible material lead-in hole 39 so as to be wound or bound around a bundle of the material 35.

With the ring shaped guide member 2, the flexible material is threaded through the guide channesl 32 defined in the inner peripheral surface of the ring shaped guide member 2, so that the flexible material may be bound around a bundle of a material, irrespective of the diameter of a bundle of the material to be bound, as far as the diameter of the material is less than the diameter of the central hole defined in the ring-shaped guide member 2. Accordingly, a single guide member 2 may be use for a bundle of a material having diameters of a wide range. In addition, after the flexible material or lace has been wound around a bundle of a material, the lace is tightened fast by being drawn back according to the primary tightening operation due to the reverse rotation of the primary tightening roller mechanism 13, and then an unwanted waste cut of the flexible material or lace may be recovered, thus saving the amount of the flexible material to be used and presenting a considerable economy for the binding operation.

On the other hand, a working air signal produced due to the switching of the pneumatic motor normal-reverse rotation switching valve 172 is supplied from the air port 201 to the pilot air input port 171 in the timer actuating valve 145, thereby switching the timer actuating valve 145, so that the self-maintaining air input port 174 in the timer actuating valve 145 is brought into communcation with the output air port 175. Due to the operation of the timer actuating valve 145, working air is supplied through the air output port 231 in the trigger valve, and through the self-maintaining air input port 174 in the timer actuating valve 145, to the input air port 154 in the timer, so that timer 144 starts operating.

Figure 26:
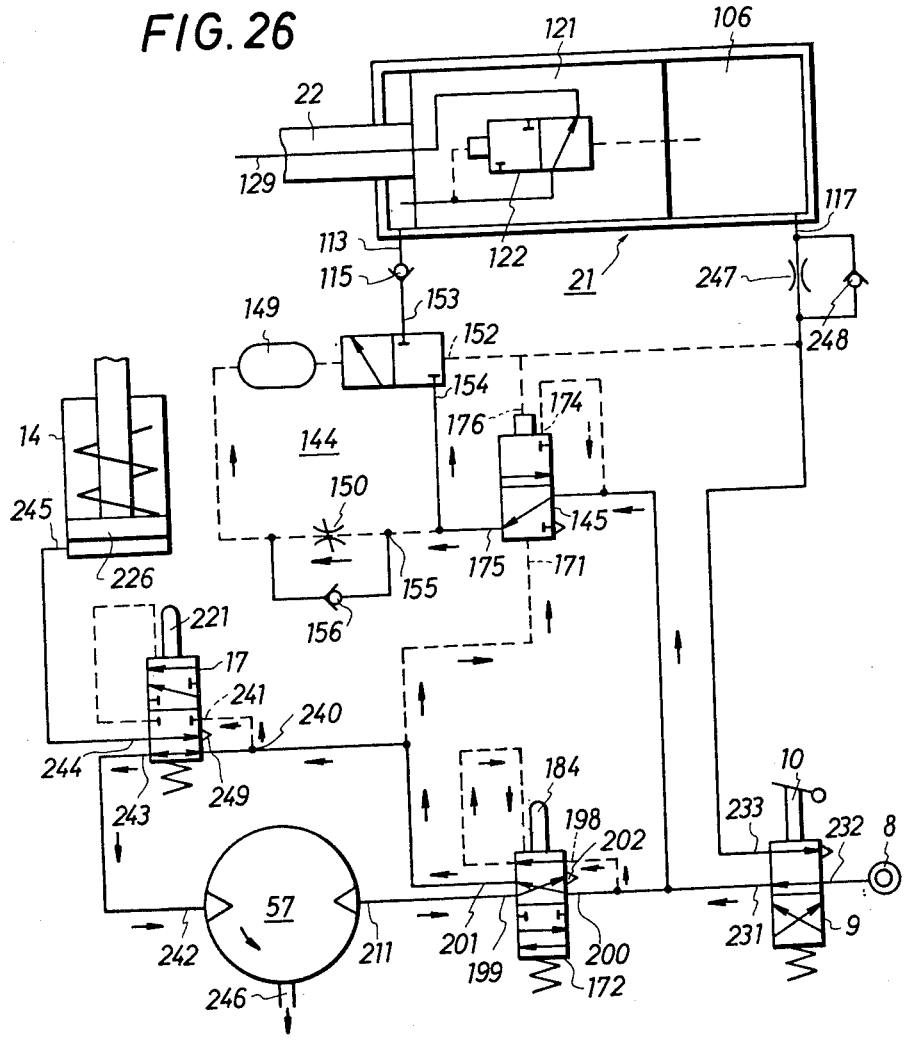

The connection of the circuit for the primary tightening operation is shown in FIG. 26, while the operation of the mechanisms is shown in FIG. 27.

During the time, in which the pneumatic motor 57 is being in the reversed rotational mode and the primary tightening operation is being under way, working air which has been supplied to the input air port 154 in the timer, may be supplied to the input air port 157 as well, and then the working air thus supplied is passed through the throttle portion 150, with the amount of air being restricted, and then into the accumulator chamber 149. A given period of time after, when air pressure is built up in the accumulator chamber 149, then the position of the timer actuating valve piston 161 is switched, so that working air is supplied through the input air port 154 in the timer 144, and through the output air port 153, to the retracting air port 113 in the secondary tightening cylinder mechanism 21. The working air first causes the air bleed valve piston 123 against the retaining ring 126 on the right-hand, and the second communicating hole 132 is shut off from the communication with the air bleed passage 131, with the result that the main piston 121 is moved to the right, thereby retracting the piston rod 22 integral with the main piston 121, thereby carrying out the secondary tightening operation. As a result, a fast bound knot of the flexible material 12 is formed around a bundle of a material, and so maintained thereafter. The working air which has been supplied to the side of the advancing air port 117, with respect to the main cylinder 121 in the main cylinder 106, is discharged by way of the advancing air port 117, check valve 248 and trigger valve 9 to atmosphere.

During the secondary tightening operation, working air is still being supplied to the reverse rotation air input port in the pneumatic motor 57, so that the pneumatic motor 57 remains stopped, with a torque applied thereto in the reverse direction, and hence a bundle of a material 35 may be positioned substantially in the center of the ring-shaped guide member 2.

Figure 20:
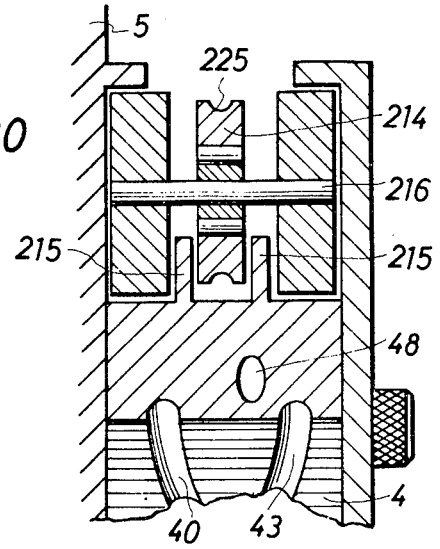
FIG. 20 is a cross-sectional view of a combination of a flexible material receiving roller and a stationary guide element in a tightening adjusting mechanism.
Figure 21:
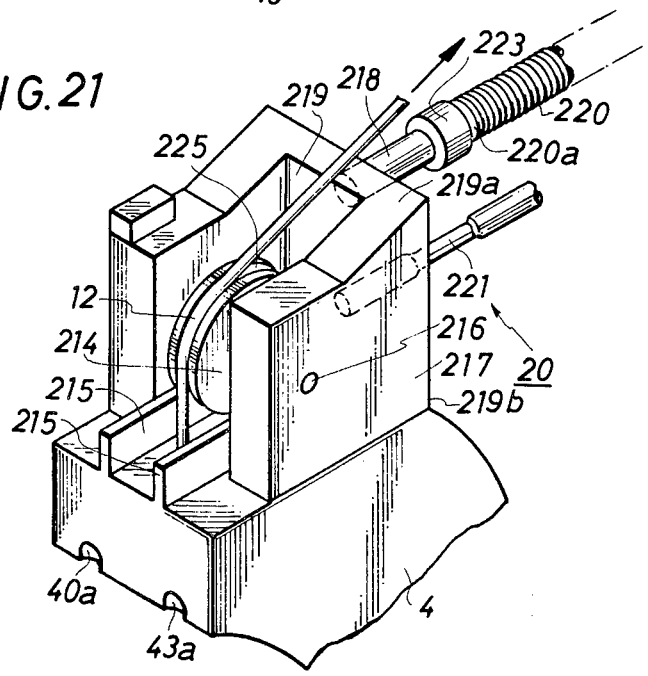
FIG. 21 is a perspective view showing the essential portion of the tightening adjusting mechanism.
Figure 28:
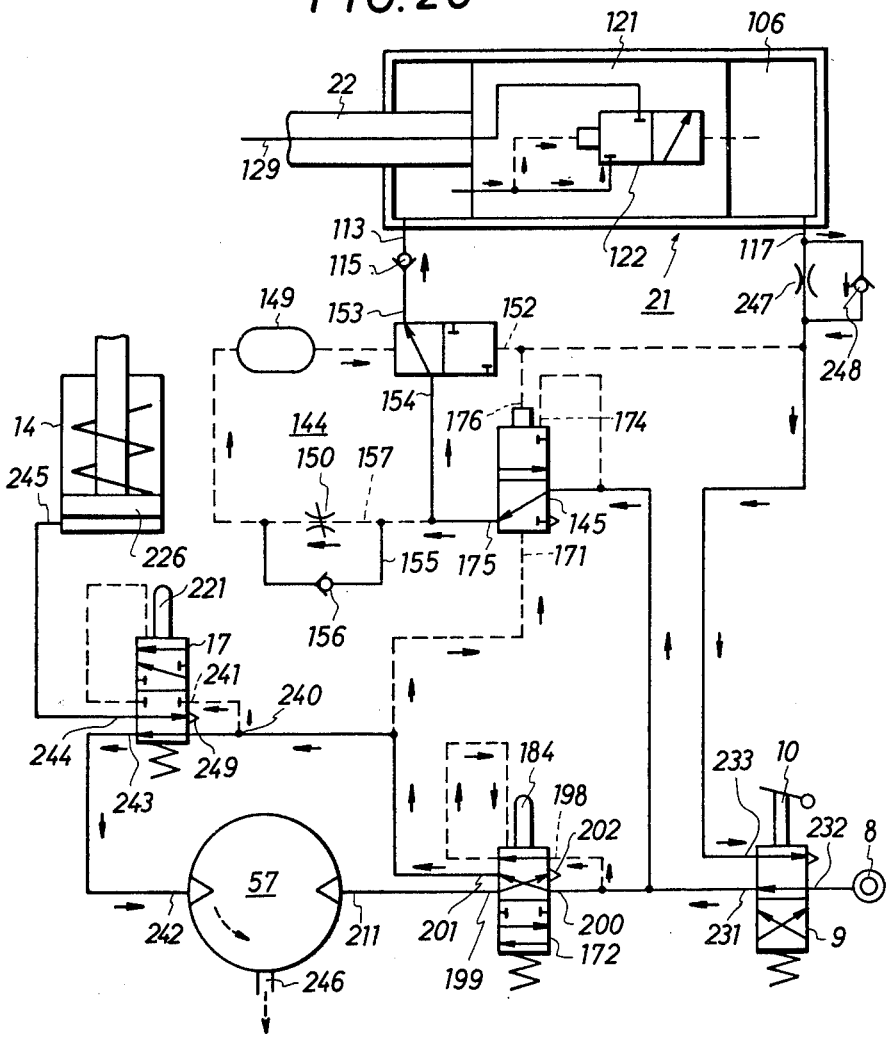
Figure 29:
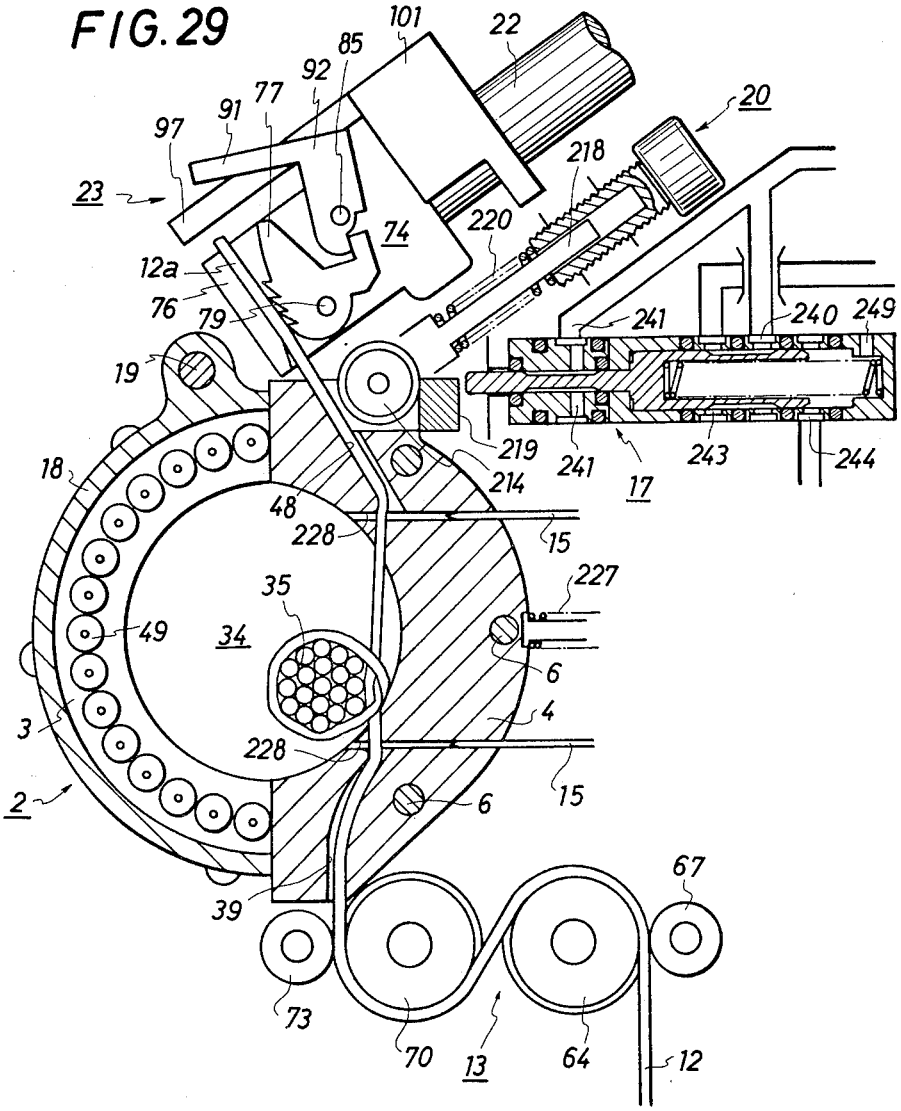

FIG. 28 shows the connection of the circuit for the secondary tightening operation thus described, and FIG. 20 refers to the operation of the mechanisms.

During the retracting movement of the piston rod 22, the flexible material 12 is applied a tension by means of the flexible material gripping mechanism 23 and the feed-in, primary tightening roller mechanism 13. When a tension is increased to a given level of a tension, then the bearing slide plate 217 is slidingly moved along the side guide plates 215 in the stationary guide element 4 by overcoming a force of the tension setting compression spring 220, so that the back plate 219 presses the valve stem operating tip portion 221 of the cutter actuating valve 17. As a result, working air is supplied to the self-maintaining air input port 241 in the cutter actuating valve 17, self-maintaining the valve stem 251 in a depressed condition. Accordingly, the working air which has been supplied by way of the trigger valve 9 and the pneumatic motor normal-reverse rotation switching valve 172 to the air port 240 in the cutter actuating valve 17 is supplied through the air port to the advancing air input port 245 in the cutter drive cylinder 14, with the result that the cutter piston 226 is advanced so as to cut the flexible material 12 at two points by means of the cutters 15. As a result, the tip portion 12*a* of the flexible material 12 remains held within the flexible material lead-in path 81.

On the other hand, during the cutting operation, the air port 240 in the cutter actuating valve 17 is shut off from the communication with the air port 243 due to the switching of the cutter actuating valve 17, so that the pneumatic motor 57 is prevented from rotating in the normal direction and thus the flexible material 12 is also prevented from being fed into the ring-shaped guide member 2. After the completion of the cutting operation, as well, the main piston 121 continues retracting to abut the rear portion bumper 116 in the main cylinder and stop thereat.

Figure 30:
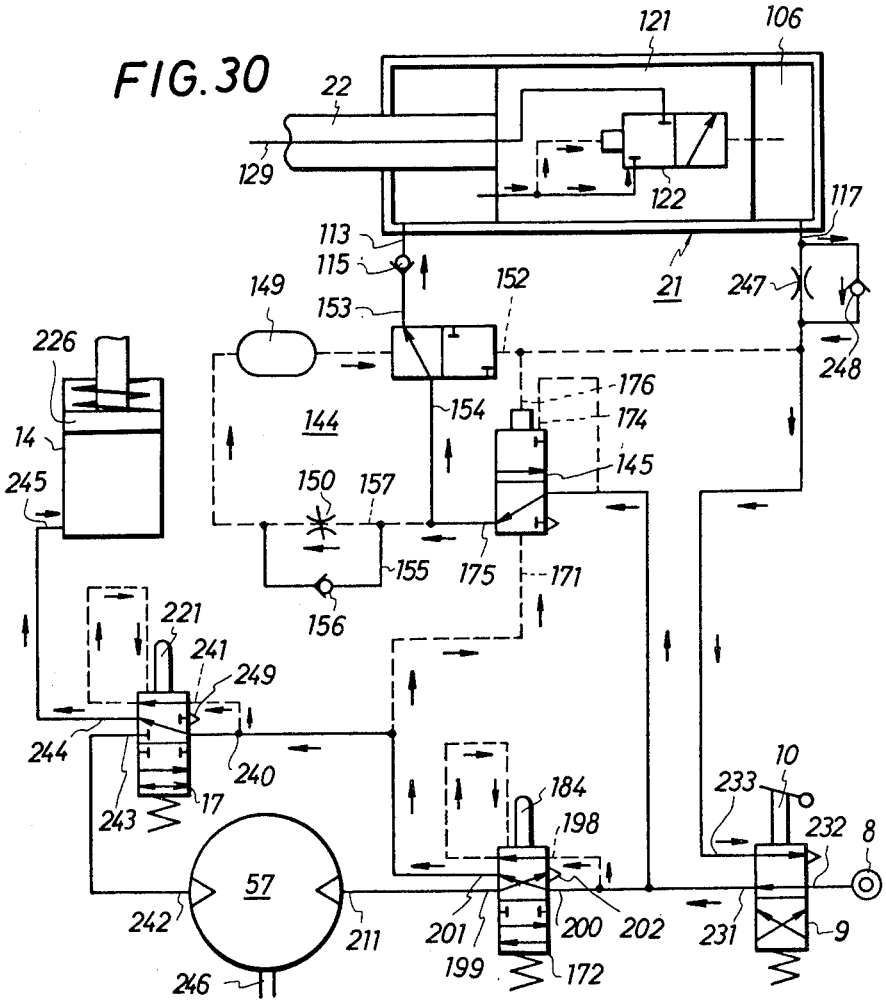
Figure 31:
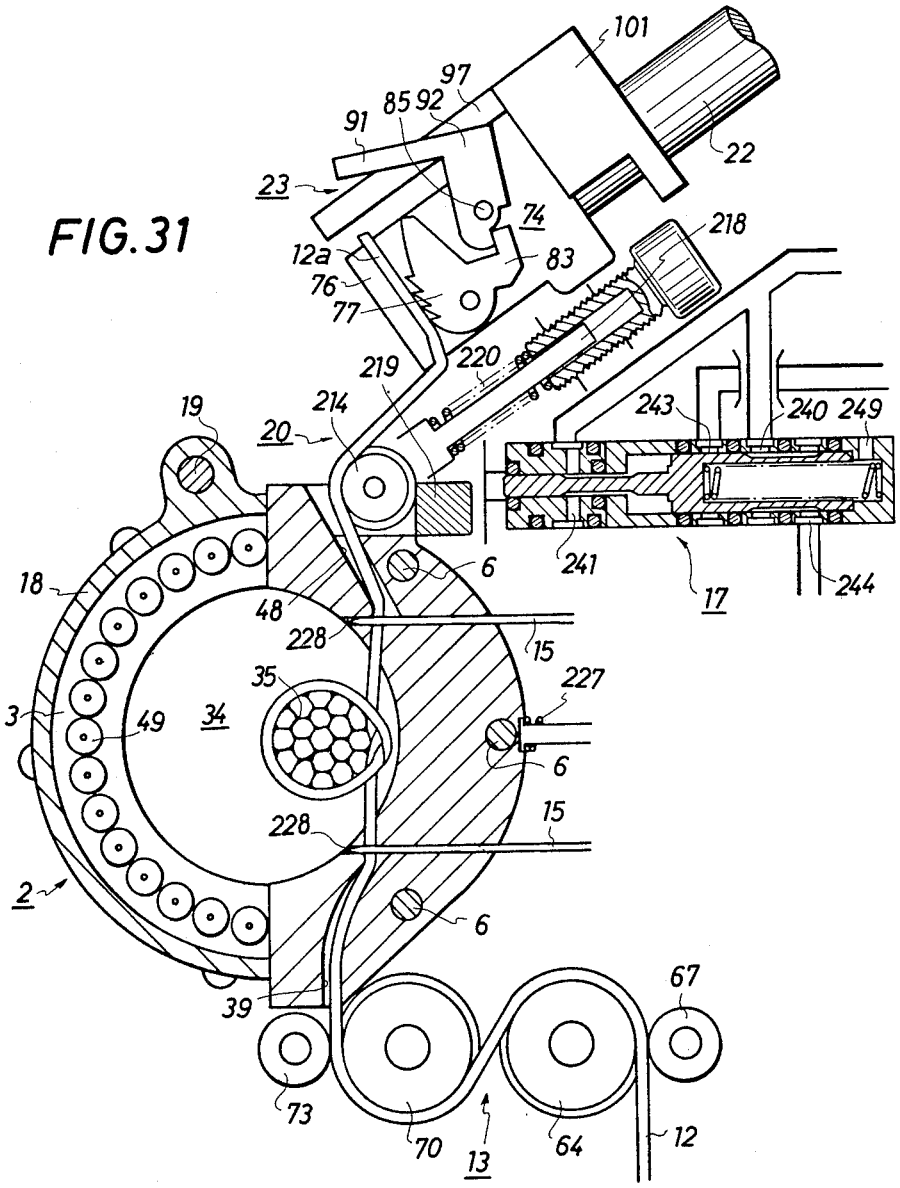
Figure 32:
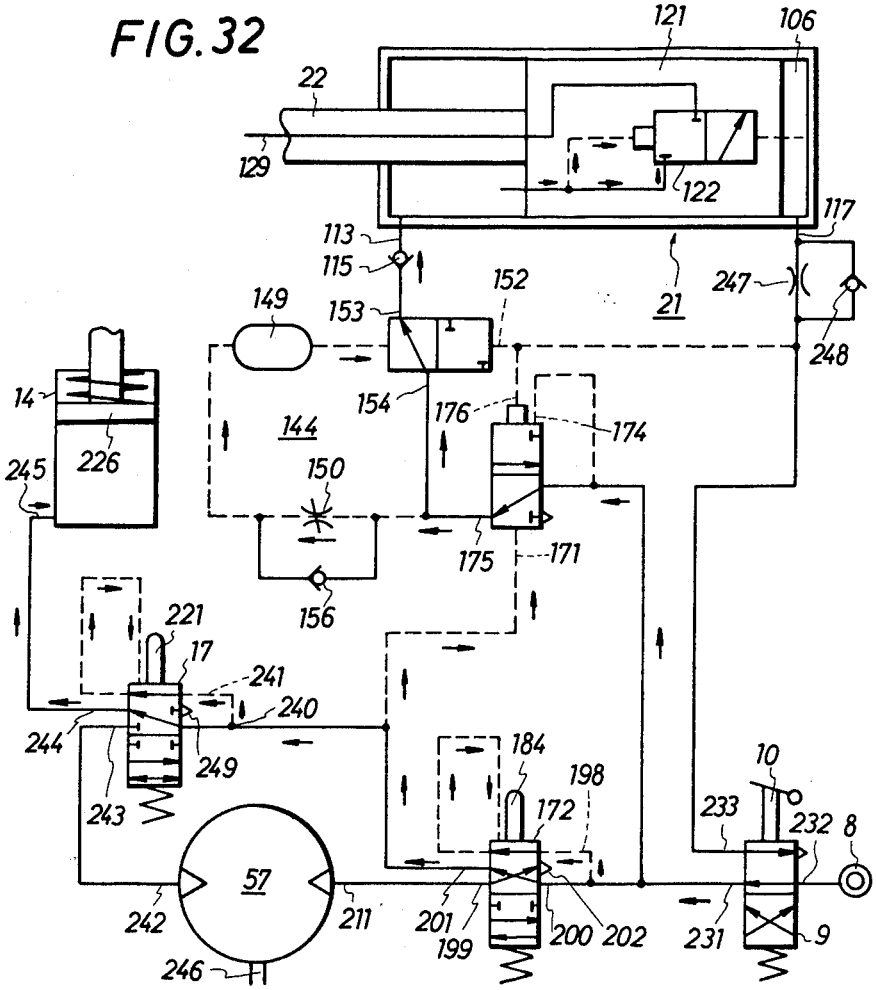
Figure 33:
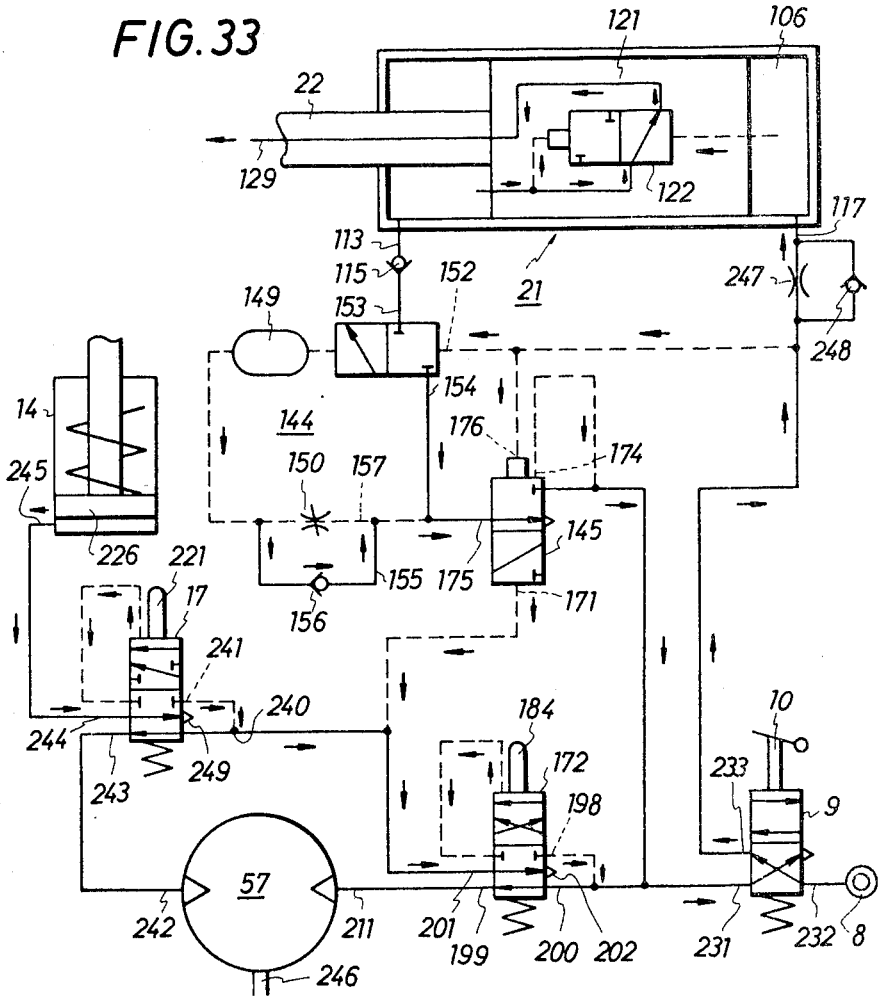
Figure 34:
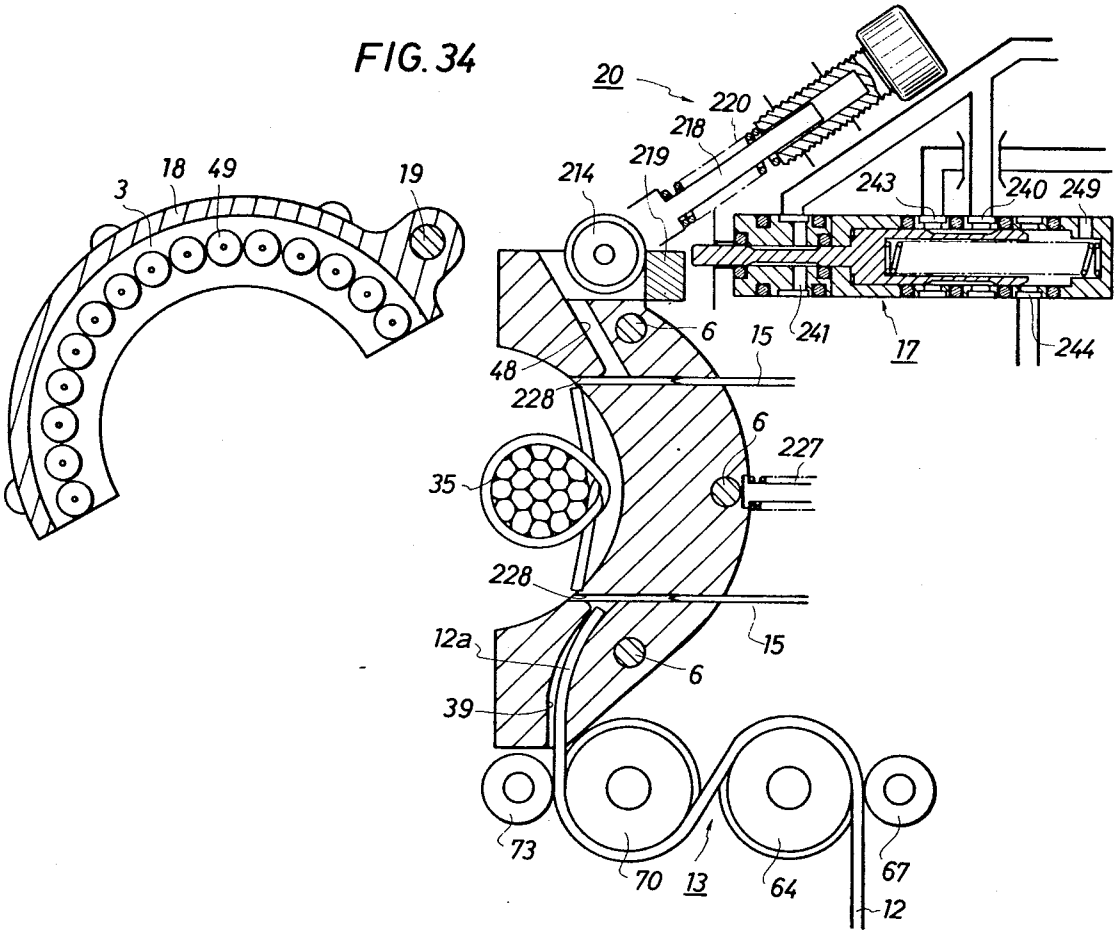
Figure 35:
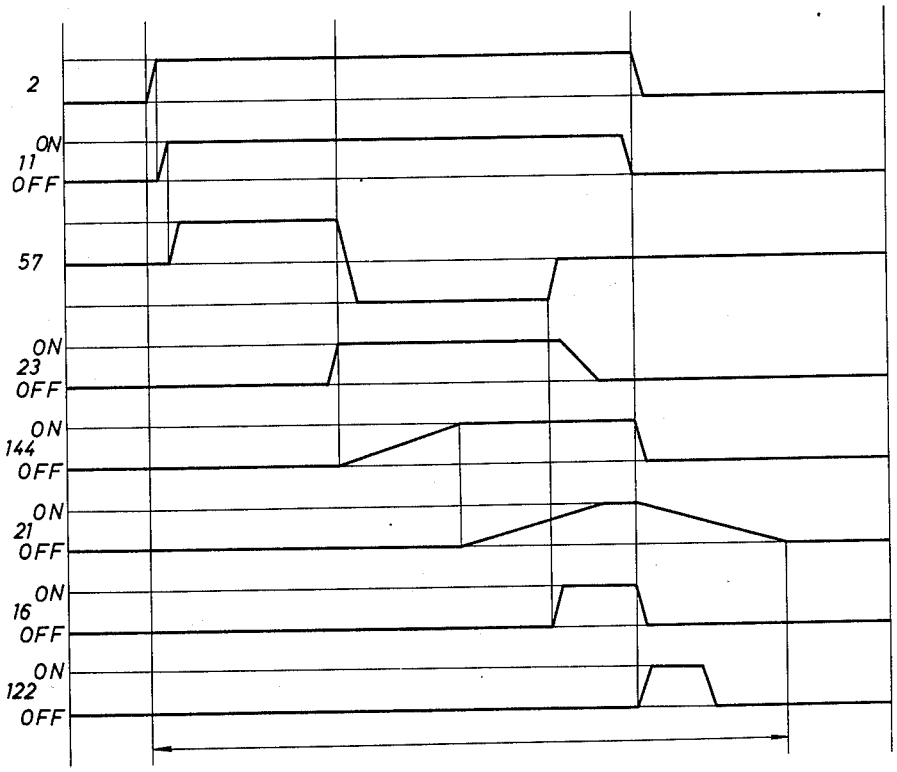
FIG. 35 is a plot showing the operating timings of respective parts constituting the binder according to the present invention.

The connection of the circuit for cutting operation for the flexible material 12 is shown in FIG. 30, while the operation of the mechanisms is shown in FIGS. 31 and 32.

After the completion of the cutting operation, when the main piston 121 is retracted to the rear extremity, to release the trigger 11 which has been held pulled during a binding operation, so that the trigger valve stem 10 in the trigger valve 9 is returned to the initial condition by a force of the compression spring 239, so the trigger valve 9 is switched. As a result, the working air which has been supplied from the air output port 231 in the trigger valve 9 to the air port 200 in the pneumatic motor normal-reverse rotation switching valve 172 is discharged by way of the trigger valve 9 to atmosphere, while the pilot air which has been supplied from the self-maintaining air input port 198 in the pneumatic motor normal-reverse rotation switching valve 172 is discharged through the air port 200 to atmosphere, so that the normal-reverse rotation switching valve 172 is returned to the initial condition by a force of the compression spring 210. When the pneumatic motor normal-reverse rotation switching valve 172 is returned to the initial position, then the air port 201 in the pneumatic motor normal-reverse rotation switching valve 172 is brought into communication with the exhaust port 202, and the air port 240 in the cutter actuating valve 17 is communicated with the air port 201, so that working air, which has been supplied from the pneumatic motor normal-reverse rotation switching valve 172 to the cutter actuating valve 17, is discharged to the atmosphere. The pilot air, which has been supplied to the self-maintaining air input port 241, is discharged from the pneumatic motor normal-reverse rotation switching valve 172 to the atmosphere.

On the other hand, the pilot air, which has been supplied through the air port in the pneumatic motor normal-reverse rotation switching valve 172 to the pilot air input port 171 in the cutter actuating valve 145 as well is discharged through the exhaust port 202 in the pneumatic motor normal-reverse rotation switching valve to the atmosphere.

The working air, which has been supplied to the advancing air port 245 in the cutter drive cylinder 14 due to the returning movement of the cutter actuating valve 17, is discharged by way of the air port 244 in the cutter actuating valve 17 and exhaust port 249 to the atmosphere, while the cutter piston 226 is returned to its initial position under the action of the compression spring 227, while the cutters 17 are retracted or moved away from the central hole 34 in the ring shaped guide member 2. Meanwhile, working air is supplied by way of the air plug 8, input port 232 in trigger valve 9, and air output port 233, to the pilot air input port 176 in the timer actuating valve 145, so that the timer actuating valve 145 is returned to its initial position. Due to the return movement of the timer actuating valve 145, the air residual within the accumulator chamber 149 is discharged by way of the quick dischage valve 156 and exhaust port 249 in the timer actuating valve 145 to the atmosphere, whereupon working air is supplied through the air output port 233 provided in the trigger valve 9 to the pilot air input port 152 in the timer 144, so that the timer 144 may be returned to the initial position.

In addition, working air is supplied from the air output port 233 in the trigger valve 9 by way of the throttle portion to the advancing air port 117 in the secondary tightening cylinder mechanism 21, so that the valve piston 123 is biased to the left, whereby the retracting air port 113 in the main cylinder 106 is brought into communication with the second communicating hole 132 and air bleed passages 129 and 131. As a result, the residual air on the side of the retracting air port 113, which provides a back pressure, is fed by way of the air bleed passage 131 into the waste out blowing hole for blowing a waste cut or the tip portion 12*a* therethrough.

During this time, after the air bleed valve piston 123 has been moved to the left, the main piston 121 is moved to the left to its initial position by the working air supplied from the advancing air port 117.

Figure 36:
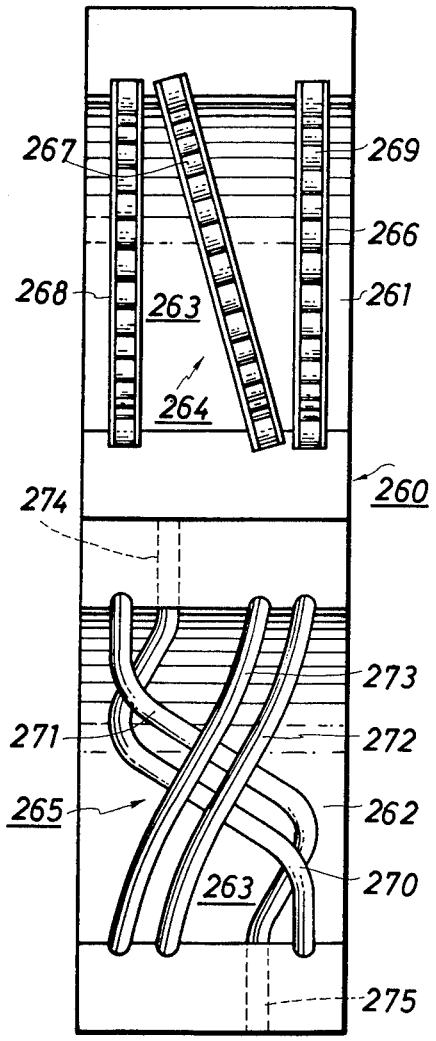
FIG. 36 is an explanatory view of another embodiment of the ring-shaped guide member.

The embodiments described thus far refer to the case where the flexible material 12 is wound around a bundle of the material 35 so as to form a double loops or knot. FIG. 36 shows a case where the flexible material 12 is wound around a bundle of the material 35 so as to provide tripple loops or knots by means of a ring-shaped member 260. The ring-shaped guide member 260 consists of a movable guide element 261 and a stationary guide element 262. Non-intersecting guide channels 264 are provided in an inner peripheral surface 263 of the movable guide element 261, while intersecting guide channels 265 are provided in the stationary guide element 262. Provided in the first parallel guide channel 266, a slant guide channel 267 and the second intersecting guide 268 are a plurality of feed rollers 269. The arrangement of the feed rollers 269 is the same as that of the case of the ring-shaped guide member 2. The intersecting guide channel portion 265 consists of the first and second intersecting channels 270, 271, and the third and fourth intersecting guide channels 272, 273 perpendicular to the first, and second intersecting guide channels 270, 271. After the ring-shaped guide member 260 has been closed, the flexible material 12, which has been introduced through a flexible material lead-in hole 274 provided in the top end portion of the first intersecting guide channel 270, travels in turn along the first intersecting guide channel 270, the first parallel guide channel 262 in the movable guide element 261, the third intersecting guide channel 272 in the stationary guide element 262, the second parallel guide channel 268 in the movable guide element 261, and eventually the second intersecting guide channel 271 in the stationary guide element 262, and out from a flexible material lead-out hole 275, so that the tip portion 12*a* of the flexible material 12 is gripped by the flexible material gripping mechanism 23. The ring-shaped guide member 260 is used when tripple knots are required.

As is apparent from the foregoing description of the binder according to the present invention, the cable harness operation which has been confronted with many difficulties may be completely automated, and the binding operation may be carried out in an efficient manner with minimized consumption of a binding or flexible material, in addition to the consistent quality of knots and economical use and operation of the flexible material.

Figure 37:
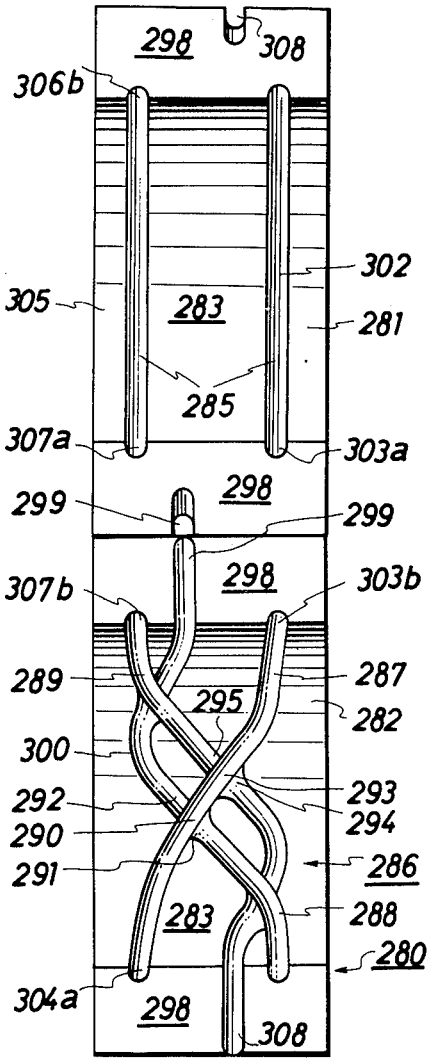
FIG. 37 is a view showing another embodiment of the ring-shaped guide member, as viewed through a central hole in the open position of the guide member.
Figure 38:
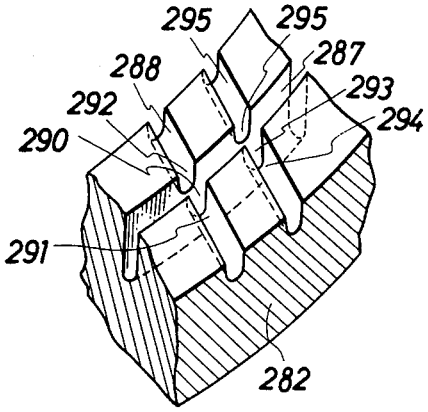
FIG. 38 is a perspective view showing a part of a condition where guide channels intersect with each other.
Figure 39A:
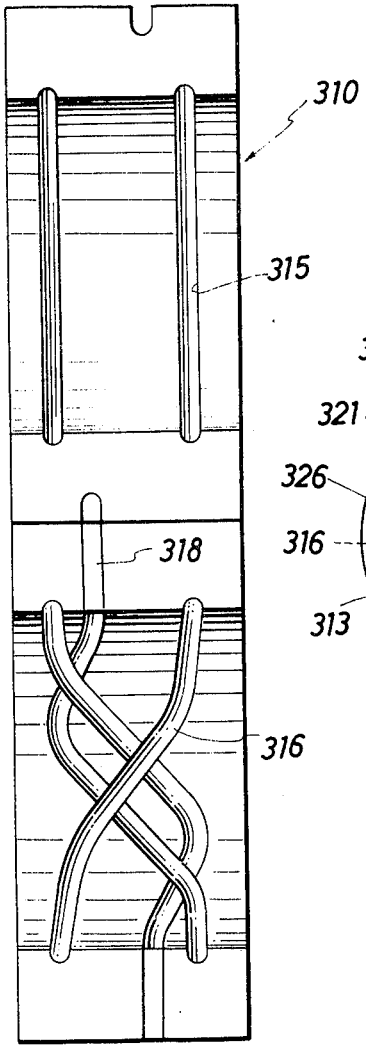
FIG. 39*a* is view of a further embodiment of the ring-shaped guide member.
Figure 39B:
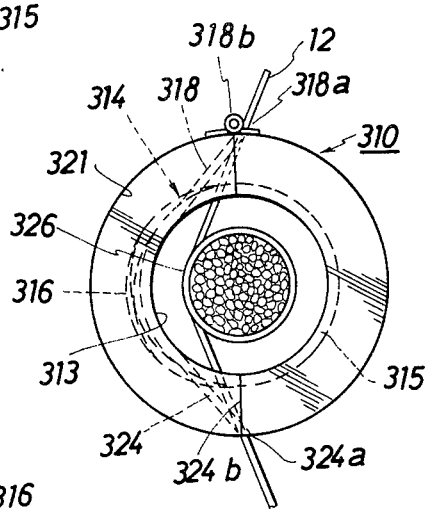
FIG. 39*b* is a front view showing a condition where a bundle of a material is bound within the central hole, after which a long flexible material is tightened in the opposite directions.

FIG. 37 shows another embodiment of a ring-shaped guide member 280 which is the improvements on the guide performance or threading performance of the flexible member 12 by the ring shaped guide member 2 including guide channel 32. The ring-shaped guide member 280 consists of a first semi-circular guide element 281 and a second semi-circular guide element 282, as in the ring shaped guide member 2. Parallel guide channel portion 285 included in guide channels 284 defined in an inner peripheral surface 283 of the ring-shaped guide member 280 are defined on the side of the semi-circular guide element 281, while the intersecting guide channel portion 286 is defined on the side of the second semi-circular guide element 282.

In the intersecting guide channel portion 286, the second guide channel 288 and third guide channel 289 intersect with the first guide channel 287 crosswise, while the flexible-material-guiding paths are discontinued at a first intersection 290 between the second guide channel 288 and the first guide channel 287. The flexible material guiding paths are provided with a flexible material lead-in opening 291 on the front side as viewed in the travelling direction of the flexible material, and a lead-out opening 291 on the rear side. The diameter of the lead-in side opening 291 is relatively larger than that of the lead-out-side opening 292, and the wall of the opening 291 is smoothly blended into the wall of the second guide channel 287 in a converging manner. With the embodiment as shown in FIG. 37, the lead-in side opening 291 is larger in diameter than the second guide channel 287. Alternatively, the diameter of the lead-out-side opening 292 may be larger than that of the second guide channel 288, while the diameter of the lead-in-side opening may be the same as that of the second guide channel 287. The shape of the lead-in-side opening 291 should not be such as to hold the tip portion **12*a* of the flexible material, i.e., to cause jamming of the tip portion 12*a*** of the flexible material, for instance, due to a stepped portion.

The description given of the second guide channel 288 and first guide channel 287 may go for the third guide channel 289 and the first guide channel 287. In other words, the diameter of the lead-in-side opening 294 is relatively larger than the diameter of the lead-out-side opening 295 at the second intersection 293 of the third guide channel 289 with the first guide channel 287. FIG. 37 shows the relationship between the lead-in-side opening for the flexible material 12 and the diameter of the lead-out-side opening for the flexible material through out the entire surfaces of the intersecting channel portion 286. With this arrangement of the guide channels, the tip portion **12*a* of the flexible material 12 will not be guided into a deeper channel at an intersection of one guide channel with another guide channel having a less deeper bottom, so that the tip portion of the flexible material may be guided from the lead-out-side opening 292, 295 to the lead-in-side openings 291, 294**.

Detailed description will be given of the guide channel 284 with reference to FIG. 37.

A flexible material lead-in hole 299 runs through an increased thickness portion 298 from an outer peripheral surface 296 of the stationary guide element 282 towards an inner peripheral surface 297. The lead-in hole 299 is provided with a leftwardly curved portion 300 as viewed in FIG. 37, and is continuous with the second guide channel 287 leading to the right-hand lower portion of a central hole 301. The second guide channel 287 is continuous with the first parallel guide channel 302 in the movable guide element 281. The first guide channel 302 is continuous by way of an opening **303*a* positioned in the right-hand lower portion in the stationary guide element 282 with an opening in the first guide channel 287 in the movable guide element 281. The first guide channel 287 is directed aslant to the left-hand portion of the guide element 282 and intersects with the third guide channel 289, with its bottom surface being deeper than that of the guide channel 289, and then with the second guide channel 287, with its bottom surface being deeper than that of the second guide channel 287. Then, the first guide channel 287 is connected to an opening 305 of the second parallel channel 305 in the movable guide element 281. The second parallel channel 305 is continuous by way of an opening 307*a* with an opening 307*b* of the third guide channel 289 positioned in the left-hand upper portion of the drawing. The third guide channel 289 intersects with the second guide channel 288, with its bottom surface being less deeper than that of the second guide channel, and then with the first guide channel 287, with its bottom surface being less deeper than that of the first guide channel 287, and eventually with the second guide channel 288, with its bottom surface being less deeper than that of the second guide channel 288, and is then connected to the flexible material lead-out hole 308**.

With the ring shaped guide member 280 of the aforesaid arrangement, the guiding of the flexible material through an intersecting portion in the ring-shaped guide member 280 for use in binding a bundle of a material may be smoothly accomplished, so that even in case the flexible material is of less rigidity, the tip portion thereof will not be deflected into another guide channel nor cling to the wall of the guide channel. In addition, even in case vibration or intermittent opening-and-closing movements is applied to the ring guide member 280, the the tip portion **12*a*** of the flexible material will not be deflected into an unwanted guide channel at the intersection of guide channels.

FIG. 30 shows a still another embodiment of the ring-shaped guide member 310, in which a bound condition of a bundle of a material and a binding force applied thereto are improved over those given by the aforesaid ring-shaped guide member 2, thereby eliminating the looseness of a knot after being bound. As in the case of the ring-shaped guide member 310 consists of a first semi-circular guide element 311 and a second semi-circular guide element 312. A parallel guide channel portion 315 included in guide channels 314 defined in an inner peripheral surface 313 of the ring shaped guide member 310 are provided on the side of the first semi-circular guide element 311, while an intersecting channel portion 316 is defined on the side of the second guide element 312. A flexible material lead-in path 318 runs aslant through an increased thickness portion 317 of the second semi-circular guide element 312 from the position of a hinge 318 interconnecting the second semi-circular guide element 312 and the first semi-circular guide element 311 in the tangential direction of an inner peripheral surface 313 of the ring shaped guide member 310, while an opening of the flexible material lead-in path 318 is positioned almost on the side of the first semi-circular guide channel 311. The opening 318*a* may be positioned on the side of the second semi-circular guide element 312. As in the embodiment shown in FIG. 37, the flexible material lead-in path 318 is continuous with an intersecting guide channel 28. The intersecting guide channel 319 is continuous with a parallel guide channel 320 in the first semi-circular guide element 311. The parallel guide channel 320 is connected to an intersecting guide channel 321 in the second semi-circular guide element 312. The intersecting guide channel 321 intersects in turn with the intersecting guide channel 322, the intersecting guide channel 319, and is then connected to a parallel guide channel 323 in the first semi-circular guide element 311. The parallel guide channel 323 is connected to an intersecting guide channel 322 in the second semi-circular guide element 312. The intersecting guide channel 322 intersects in turn with the intersection guide channdl 319, an intersecting guide channel 321, an intersecting guide channel 319, and is then continuous with the flexible material lead-out path 324. The flexible material lead-out path 324 runs aslant through an increased thickness portion 317 of the second semi-circular guide element 312 towards opening and-closing end portion or mouth 325 of the second semi-circular guide element 312 but substantially in the tangential direction of the inner peripheral surface 313, with its opening 324*a* being positioned almost on the first semi-circular guide element 311. Alternatively, the opening 324*a* may be provided on the side of the second semi-circular guide element 312.

Description will be given of the functions of the ring-shaped guide member 310 thus described. The flexible material 12 is threaded through the flexible material lead-in path 324 along the guide channel 314 to a flexible material lead-out path 324 smoothly but within a short time. In this respect, the flexible material 12 may be fed, without changing the entire periphery of the guide channel 314, by causing vibrations in the ring shaped guide member 310 or intermittently opening and closing the semi-circular guide elements 311 and 312 about a hinge 318 by suitable means in a manner that the flexible material 12 will not cause buckling.

Figure 40:
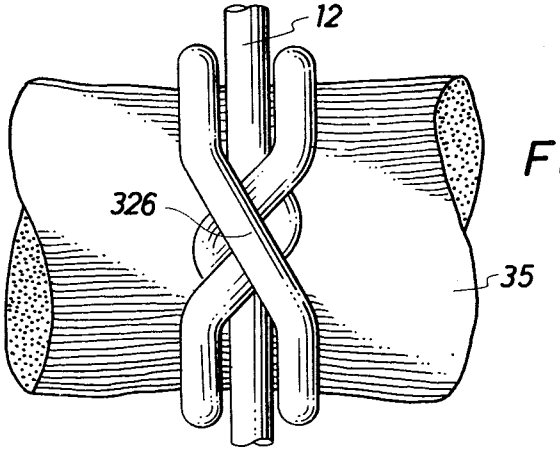
FIG. 40 is a view showing a condition where a bundle of a material has been bound with a flexible material by means of the ring-shaped guide member.
Figure 42:
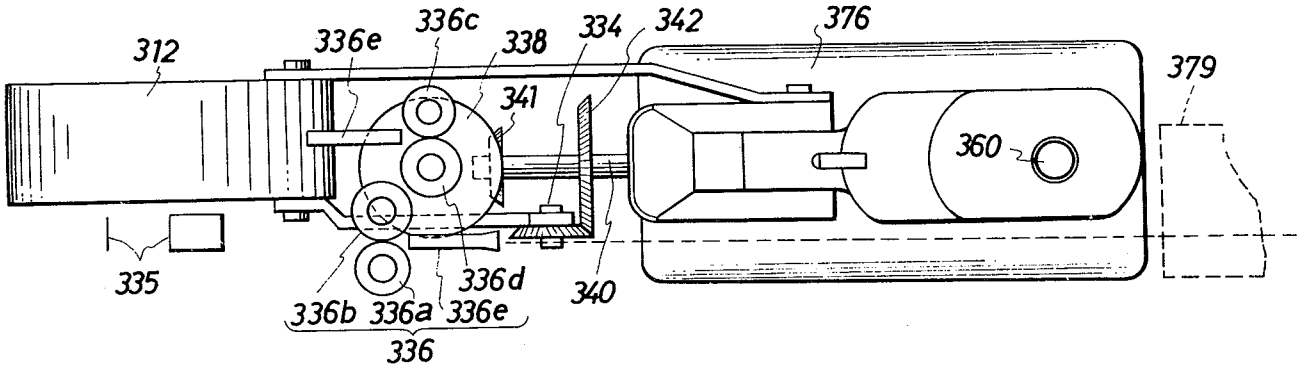
FIG. 42 is a bottom view of the automatic binder.

Subsequently, when the flexible material 12 is tightened in the opposite directions relative to each other along the flexible material lead-in path 318 and flexible material lead-out path 324, then the flexible material 12 is wound tightly around a bundle of a material 35 positioned in a central hole 325, thereby providing an intersecting portion 326. This is best shown in FIG. 30. At this time, an opening 318*a* of the flexible material lead-in path 318 as well as an opening 324*a* of the flexible material lead-out path 324 are positioned on the side of the center of the ring shaped guide member 310 with respect to the tangential line of an intersecting portion 326, so that the flexible material 12 may cling around a bundle of a material 35 and hence may be bound therearound, and there is formed no triangular region in the intersecting portion 326. As shown in FIG. 40, after a bundle of a material 35 has been bound, and the flexible material 12 has been cut on the opposite sides of the intersecting portion 326 with a cutter, the binding of the flexible material 12 takes place, being concentrated on one point effectively, and an increased tightening force may be achieved.

In this manner, the ring shaped guide member of this embodiment provides a fast and long-lasting bound condition for a flexible material having a relatively low rigidity.

Figure 41:
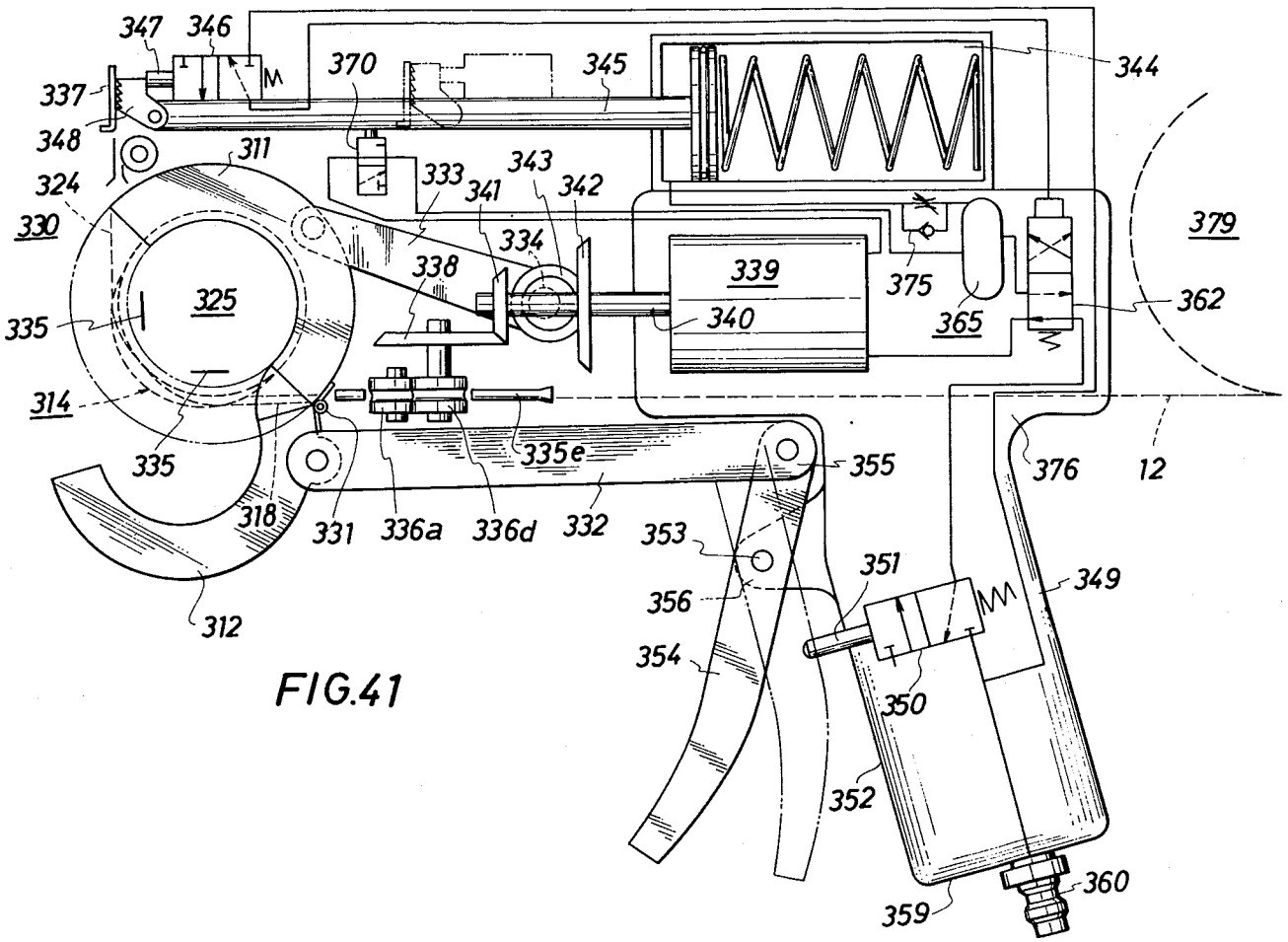
FIG. 41 is a view illustrative of the entire construction of a further embodiment of an automatic binder according to the present invention.
Figure 43:
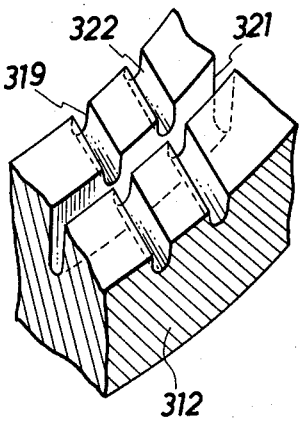
FIG. 43 is a partial perspective view of intersecting guide channels in the ring-shaped guide member.
Figure 48:
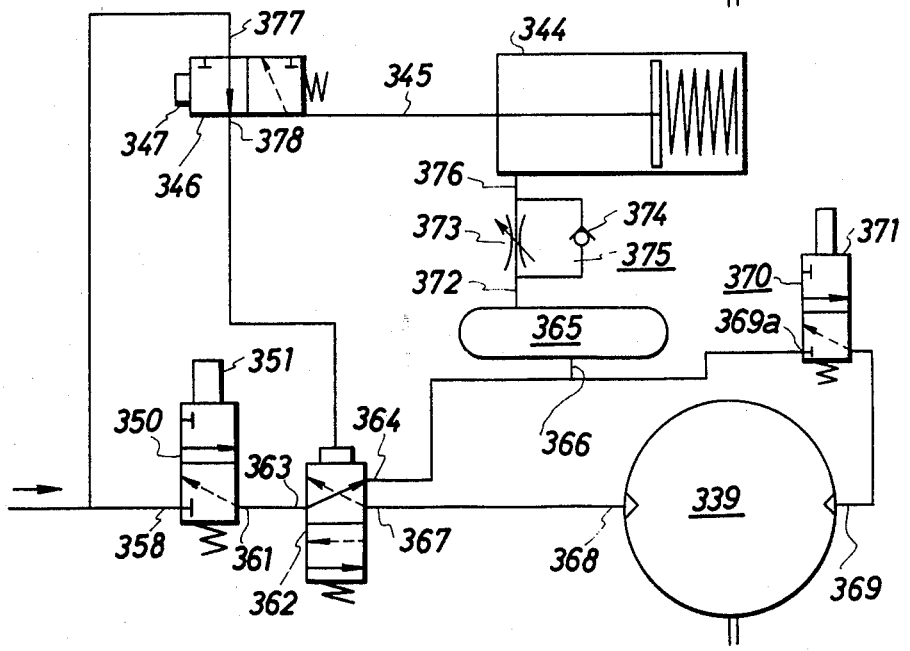

FIGS. 41 and 48 show a yet another embodiment of the automatic binder according to the present invention. A semi-circular guide member 330 shown in this embodiment is the same in construction as that shown in FIG. 37, so that like parts are designated like reference numerals in common therewith. The first semi-circular guide element 311 and the second semi-circular guide element 312 may be opened or closed about the hing 331, while an arm 332 is attached to the second semi-circular guide element 312, so that the semi-circular guide element 312 may be moved to its open position, when a bundle of a material 35 is removed from the central hole 325. An arm 33 is attached to the first semi-circular guide element 311, so that the first semi-circular guide element 311 may be directly vibrated by the arm 33, or the ring shaped guide member 330 may be vibrated in its entirety.

FIG. 41 shows a vibration generating means in the form of an eccentric shaft 334. An endless long material such as a cable harness built in an electric equipment may be admitted in the central hole 325 by opening the second semi-circular guide element 312 about the hinge 331 by means of the arm 332.

The flexible material 12 is transported to a flexible material lead-out path 324 along the guide channel 314 smoothly in a short time, while being vibrated. Cutters 335 may go into or from the central hole 325, and a flexible material is cut at two points after binding. The first semi-circular guide element 311 and second semi-circular guide element 312 should not necessarily be coupled by means of the hinge 331, but may be so arranged that the two elements may be moved in the radial direction by suitable means such as a spring. In this case, an allowable extent of the radial movement of an endless long material when admitting same into the central hole 325 should be larger than an allowable extent of the radial movement of the flexible material when subjected to vibration.

In case a long bundle of a material having ends is to be bound, then it is possible that the ring shaped guide member 330 should not be opened to a large extent. A flexible material lead-out path 324 is positioned in the vicinity of the opening-and-closing ends of the second semi-circular guide element 312 and runs through an increased thickness portion 317 in the tangential direction of the central hole 325, being opened outwardly towards the second semi-circular guide element 312.

Positioned in the vicinity of the flexible material lead-in path 318, i.e., to the right of the hinge 331 in FIG. 41 is a flexible material lead-in mechanism 336 consisting of a combination of rollers 336*a*, 336*b*, 336*c* and 336*d*, and a flexible material lead-in pipe 335*e*. Positioned in the vicinity of the flexible material lead-out path 324 but above the first semi-circular guide element 311 is a pawl mechanism 337 adapted to grip the flexible material 12. Coaxially fitted on the roller 336*d* in the flexible material lead-in mechanism 336 is a bevel gear 338, with which coaxially meshes a bevel gear 341 that is integrally fitted on a drive shaft 340 of a pneumatic motor 339 serving as a fluid motor. A combination of the two gears 338 and 341 is intended to reduce the rotational speed of the pneumatic motor 339. A gear 342 is integrally fitted on the drive shaft 340 and meshes with a vibration-generating bevel gear 343. This combination of gears is intended to increase the rotational speed. Secured to the vibration generating bevel gear 343 is an eccentric shaft 334, to which is secured an arm 333. The first semi-circular guide element 311 is vibrated and driven by means of the arm 333.

Alternatively, a one way clutch not shown may be interposed between the gear 342 and a drive shaft 340, so that in case of the reverse rotation of the pneumatic motor 339, the gear 342 is released from the drive shaft 340 so as to stop the vibratory drive of the ring shaped guide member 330.

A second tightening air cylinder 344 is secured to a body proper 376 above the pneumatic motor 339, and a piston rod 345 is driven back and forth. The secondary air cylinder 344 is of a single acting cylinder, and thus a return stroke is effected by means of a spring.

In the forward extermity or most advanced position of the piston rod 345, the rod 345 is positioned substantially above the flexible material lead-out path 324 provided in the second semi-circular guide element 312. Secured to the tip of the piston rod 345 are a pawl mechanism 337 and flexible material gripping and detecting valve 346. The detecting valve 346 is of a spring offset type, and a operating push rod 347 is passed by a pawl 348. As a result, when the flexible material 12 is gripped by the pawl mechanism 337, then the push rod 347 is so designed as to be retracted, and the flexible material gripping detecting valve 346 is switched.

An operating push rod 351 for a trigger valve 350 projects forwards from a grip portion 349 of the body proper 376. A trigger lever 345 is secured to a front surface 352 of the grip portion 349 through the medium of a bracket 353. A root portion 355 of a trigger lever 354 is spaced some distance from a supporting portion 356 supported by a bracket 353. The root portion 355 is rotatably coupled to an arm 332. Accordingly, when the trigger lever 354 is operated so as to be drawn towards the grip portion 349, then the arm 332 is pushed forwards along the length of the body proper 376, and then pushes a push rod 351 in the trigger valve 350.

Figure 44:
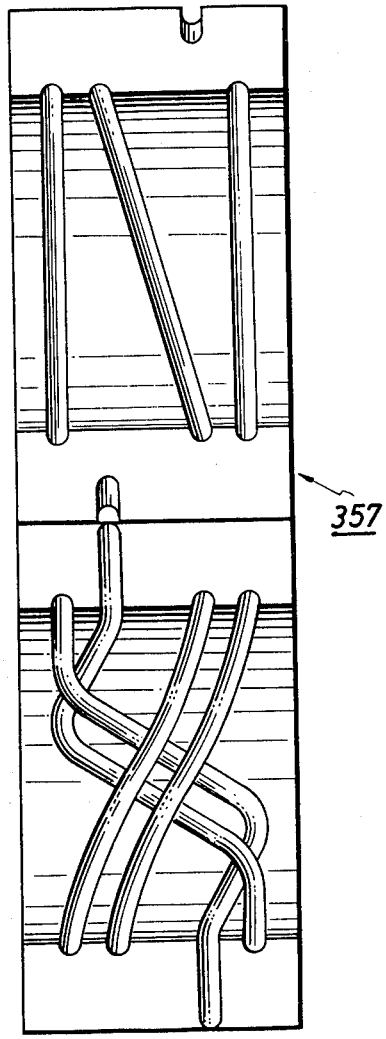
FIG. 44 is a developed view of the ring-shaped guide member for use in triple binding, as viewed from the direction of the central hole.

FIG. 44 shows a ring shaped guide member 357 adapted to provide triple knots.

The ring shaped guide member 357 is similar in construction to the ring-shaped guide member 260 which is devoid of a plurality of feed rollers 269 provided in a non intersecting channel portion 264 in the movable guide element 261. Thus, like parts are designated like reference numerals. The automatic binder according to this embodiment enables quadruple and quituple knots with the aid of vibrations.

Alternatively, the ring shaped guide member may be so designed that a ring shaped guide member is divided into three or four guide elements, and a long bundle of a material of a large diameter may be bound with a binding material or a lace having a relatively low rigidity.

Description has been given thus far of the mechanical phase of the automatic binder according to the present invention. Now, description will be turned to the binding operation and control circuits, hereinafter.

Figure 45:
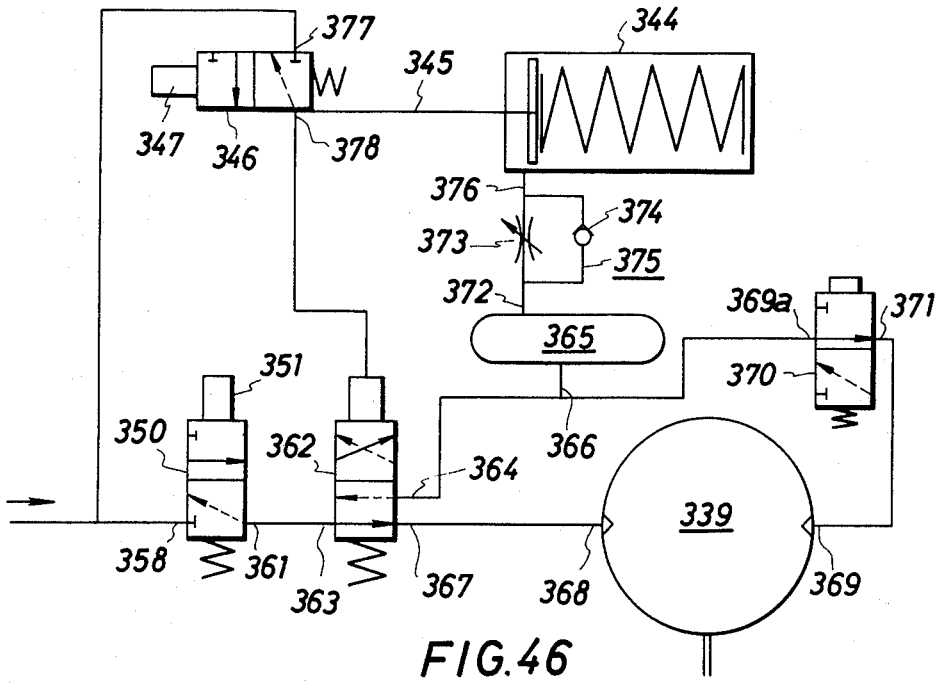
Figure 46:
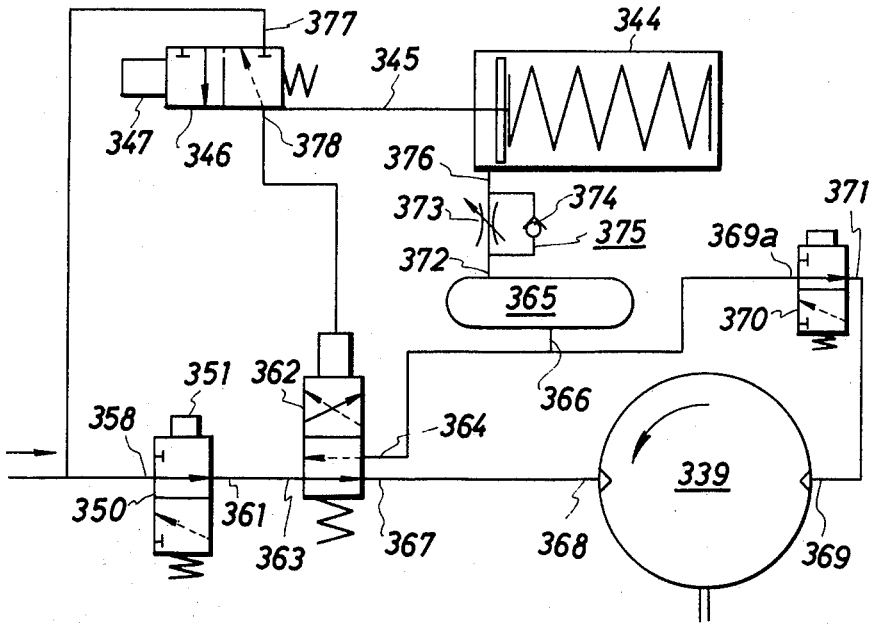

Referring to FIG. 46, the input port 358 in the trigger valve 350 is disposed in a lower end portion 359 of the grip portion 349. Air is supplied by way of an air plug 360 from an air source not shown. An output port 361 in the trigger valve 350 is connected to an input port 363 in an pneumatic motor normal-reverse rotation switching valve 362. The pneumatic motor normal-reverse rotation switching valve 362 is of a two position four port valve type, and switched according to an output signal from the flexible material gripping detecting valve 346. A B output port 364 in the pneumatic motor normal-reverse rotation switching valve 362 is communicated with an input port 366 in the accumulator 365, while an A output port 367 is connected to a normal rotation input port 368 in the pneumatic motor 339. A reverse rotation input port in the pneumatic motor 339 is connected to an output port 371 in a pneumatic motor reverse rotation-stop switching valve 370. The pneumatic motor reverse rotation-stop switching valve 370 is of a two position three port spring offset type. An input port 369 in the pneumatic motor normal-reverse switching valve 362 is connected to a B output port 364 in the pneumatic motor normal-reverse rotation switching valve 362. An output port 372 in the accumulator 365 is connected to a delay circuit 375 consisting of a flow rate control valve 373 and a check valve 374 which are positioned in parallel to each other. The delay circuit 375 is connected to an input port 376 in a secondary tightening air cylinder 344. The delay circuit 375 may consist of a single throttle valve having a check valve. FIGS. 45 to 48 show a variable throttle valve serving as a flow rate control valve 373. However, if delay time is known beforehand, then non-variable throttle valve may be used. In addition, the accumulator 365 is used for delaying time. However, a suitable throttle valve is used in the delay circuit 375, then the accumulator 365 may be eliminated.

As has been described earlier, the flexible material gripping detecting valve 346 is attached to the tip of the piston rod 345 in the secondary tightening air cylinder 344. The flexible material gripping detecting valve 346 is of a two-position three-port-valve spring-offset type. An input port 377 is communicated with air plug 360. The output port 378 serves to supply air to the valve 362 so as to directly switch the position of a valve body in the pneumatic motor normal-reverse rotation switching valve 362. Description will now be described of the operation of a binding control circuit by referring to the steps of the binding operation. FIG. 45 shows the initial condition of the binding control circuit. When a bundle of a material 35 is admitted in the central hole 325 and the trigger lever 354 is pulled towards the grip 349 from the aforesaid initial condition, then the trigger lever 354 is rotated about the supporting portion 356, the arm 332 is pushed forwards along the length of the body proper 376, and the second semi-circular guide element 312 is rotated about the hinge 331 so as to close the ring-shaped guide member 330. During this time, when the trigger lever 354 pushes the trigger valve actuating push rod 351, then the trigger valve 350 is switched. At this time, the input port 359 in the trigger valve 350 is communicated in turn with the output port 361, the input port 363 in the pneumatic motor normal-reverse rotation switching valve 362, the A output port 368 and the normal rotation input port 368 in the pneumatic motor, so that working air is supplied by way of the air plug 360. As a result, the pneumatic motor 339 rotates in the normal direction, i.e., in the counter-clockwise direction as viewed in the drawing. The rotation of the pneumatic motor 339 causes the rotation of drive shaft 340, bevel gear 341, and bevel gear 338, so that the flexible material lead-in mechanism 336 is operated and then the flexible material 12 is fed into the flexible material lead-in path 318. On the other hand, the ring shaped guide member 330 is vibrated due to the rotation of the drive shaft 340, bevel gear 342, vibration generating bevel gear 343, through the medium of the arm 333. During this time, the flexible material 12 is unwound from a flexible material magazine 379 and forced through the guide channels 380 according to a combination of forced feeding of the flexible material lead-in mechanism 336 and vibrations even to the ring shaped guide member 330, and the flexible material 12 is eventually forced out of the flexible material lead-out path 324. FIG. 46 shows the operation thus described.

Figure 47:
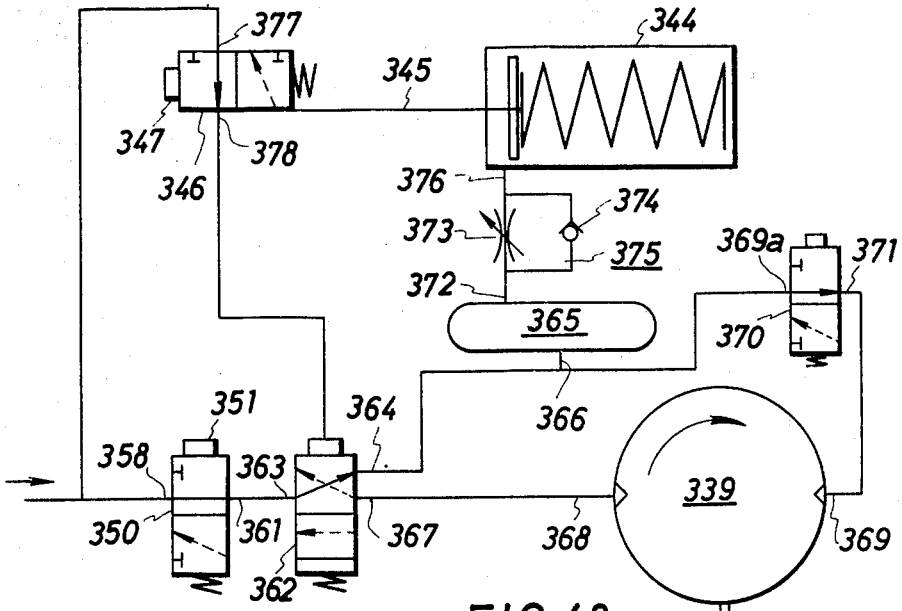

When the tip portion 12*a* of the flexible material is gripped by the pawl mechanism 337, then the push rod 347 in the flexible material gripping detecting valve 346 is forced inwardly of the valve by means of the pawl mechanism. Then, the position of the valve is switched and the input port 377 is brought into communication with the output port 378, thereby switching the pneumatic motor normal-reverse rotation switching valve 362. As a result, the input port 363 in the valve 362 is communicated with the B output port 364. Accordingly, the supply of air to the normal rotation input port 368 in the pneumatic motor 339 is interrupted, and then air is supplied by way of the accumulator 365 and the pneumatic motor reverse-stop switching valve 370 to the reverse rotation input port 369 in the pneumatic motor 339, thereby causing the rotation of the pneumatic motor 339 in the reverse direction i.e., in the clockwise direction. The reverse rotation of the pneumatic motor 339 causes the flexible material lead-in mechanism 336 to pay out the flexible material 12 in the reverse direction, so that the flexible material 12 may be wound around a bundle of a material 35 within the central hole 325 in the ring-shaped guide member 330. Upon the completion of winding, then a tightening resistance is rapidly increased, so that the reverse rotation of the pneumatic motor 339 may be stopped. The stoppage of the pneumatic motor 339 increases an air pressure in the accumulator 365, and then air is supplied from the output port 372 by way of the flow rate control valve 373 to the input port 376 in the second tightening cylinder 344, and then into the secondary tightening air cylinder 344 so as to retract the piston rod 345. The retraction of the piston rod 345 causes the tip portion 12*a* of the flexible material to be pulled backwards, being gripped by the pawl mechanism 337. This operation is referred to as the secondary tightening operation herein. In the course of the retracting movement of the piston rod 345, the flexible material 12 is cut at two points by means of the cutters 335. At this time, the pneumatic motor reverse-stop valve 370 is switched due to its disengagement from the piston rod 345, and then the supply of air to the pneumatic motor 339 is interrupted. In this case, the air is discharged from the pneumatic motor 339 by way of the pneumatic motor reverse rotation stopping valve 370 to the atmosphere. The tightening and cutting operations of the flexible material are shown in FIGS. 47 and 48.

When the trigger lever 354 is released, then the trigger valve 350 is returned to the initial position by a force of a spring, so that the air is discharged from the secondary tightening air cylinder 344 by way of the check valve 374, accumulator 365, pneumatic motor normal-reverse rotation switching valve 362 and trigger valve 350 to the atmosphere. As a result, the secondary tightening air cylinder 344 allows the piston rod 345 to return to the initial position by a spring force, while switching the pneumatic motor reverse-stop switching valve 370 on the advancing stroke of the piston rod 345. A waste cut, or the tip portion 12*a* of the flexible material is removed by a suitable means from the pawl mechanism 357, and then the flexible material gripping detecting valve 346 is returned to the initial position by a spring force. In cooperation with the return movement of the valve 346, the pneumatic motor normal-reverse rotation switching valve 362 assumes the initial position. In other words, the valve 362 is returned from the condition shown in FIG. 48 to the condition shown in FIG. 45. The condition where a bundle of a material has been bound with the flexible material is similar to that shown in FIG. 40.

Figure 49:
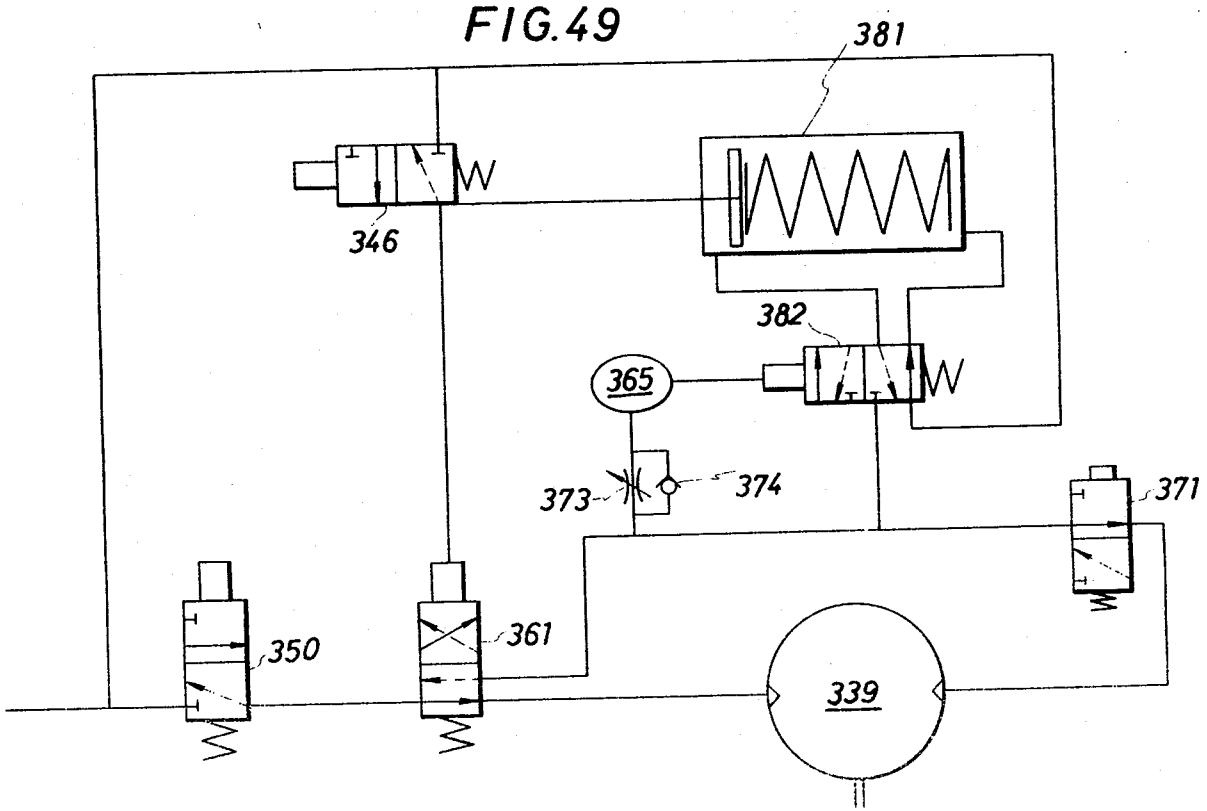
FIG. 49 is a circuit diagram of a binding-drive control circuit for use in a still further embodiment of the automatic binder according to the present invention, showing the initial condition of a trigger level before being actuated.
Figure 50:
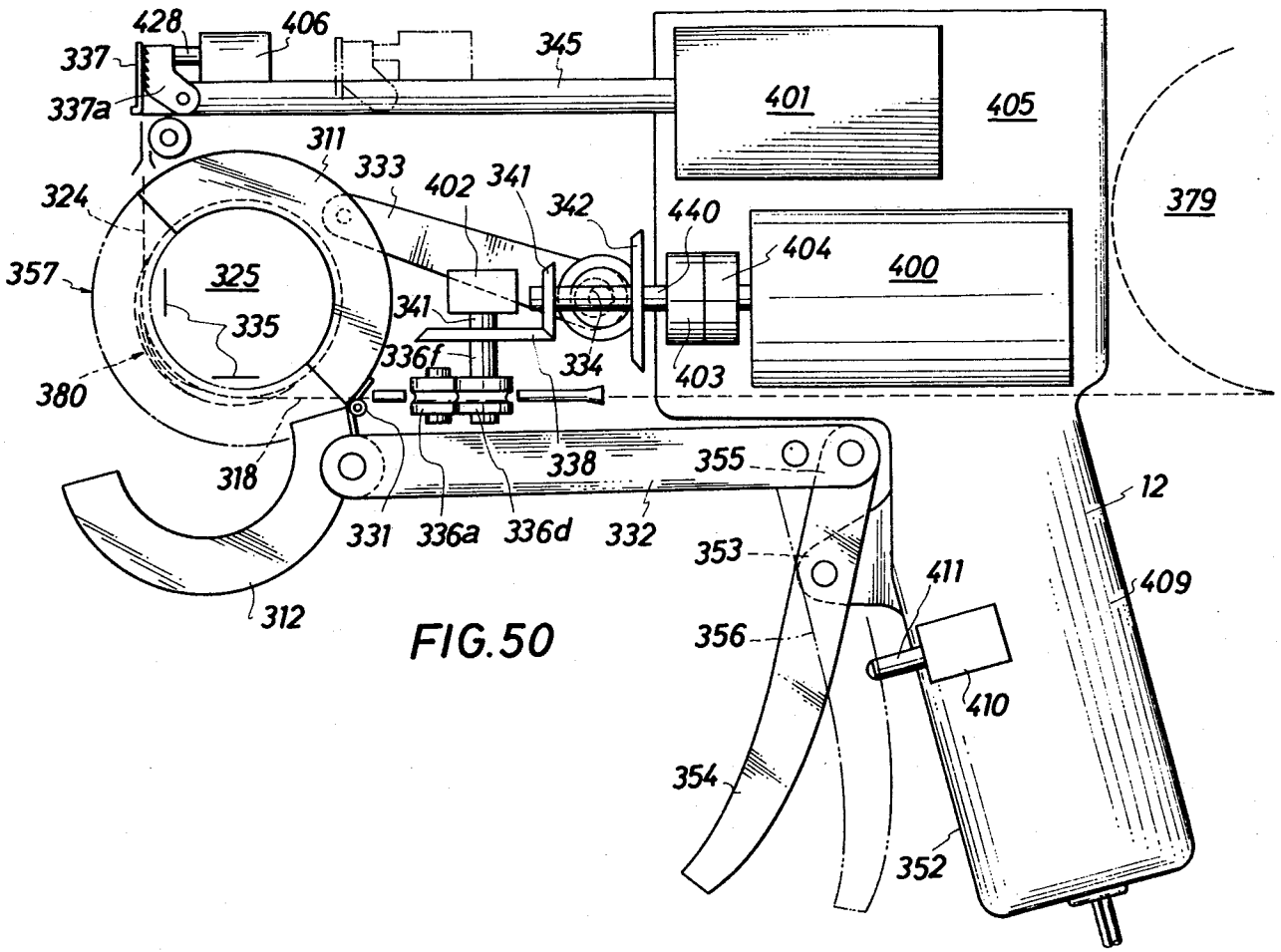
FIG. 50 is a view illustrative of the entire construction of a still further embodiment of the automatic binder according to the present invention.
Figure 51:
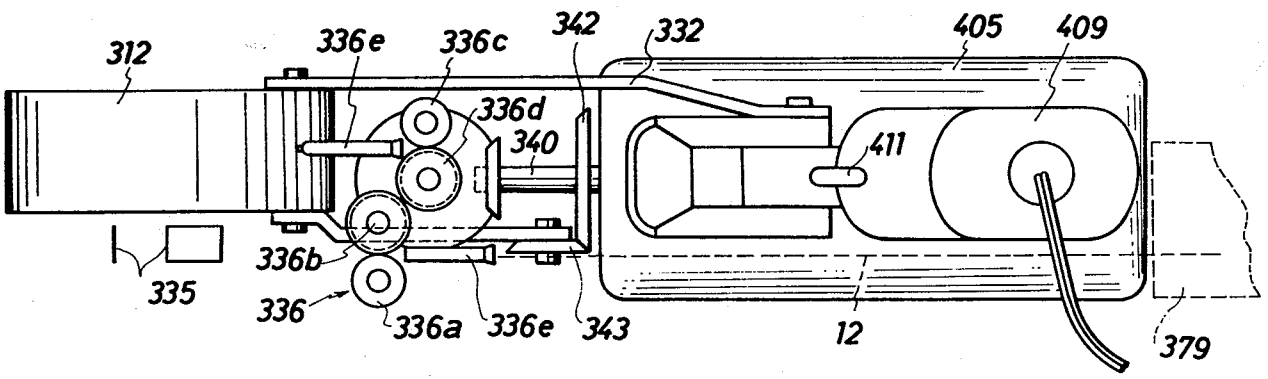
FIG. 51 is a bottom view of the automatic binder.

FIG. 49 shows another binding control circuit in this embodiment. This circuit uses a secondary tightening air cylinder 381 of a double acting air cylinder type, and an air cylinder drive switching valve 382 of a two position four port spring offset type for driving the secondary tightening air cylinder 381. The use of the double acting type, secondary tightening air cylinder 381 insures its positive operation and improves power loss, because of the absence of a spring in the secondary tightening air cylinder 381. While description has been given of the handy type automatic binder, a binder of a table or a permanent set-up type may be used.

FIGS. 50 to 55 show still another embodiment of the automatic binder according to the present invention. The operation and control of an automatic binder of this type is accomplished electrically. In this embodiment, the air motor 339 shown in FIGS. 41 to 49 is replaced by an electric motor 400, and the secondary tightening air cylinder 344 is replaced by a secondary tightening solenoid 401, and some modifications accruing from this is incorporated therein. Thus, like parts are designated like reference numerals for the common use.

A flexible material lead-in mechanism 336 is positioned in the vicinity of a ring-shaped guide member 357. Coaxially coupled to a roller 336*d* in the flexible material lead-in mechanism 336 is a bevel gear 338, with which meshes a bevel gear 341 that is integrally coupled a drive shaft 340 of the electric motor 400. The bevel gears 341 is fitted on a shaft 336f which is equipped with an electromagnetic brake 402.

Interposed between the electric motor 400 and the drive shaft 340 are an electromagnetic clutch 403 and a reverse rotation electro-magnetic clutch 404. Interposed between the bevel gear 342 and the drive shaft 340 is a one way clutch not shown in a manner that when the electric motor 400 causes the reverse rotation, the bevel gear 342 may be disengaged from the drive shaft 340, thereby stopping the vibratory operation of the ring-shaped guide member 357.

A secondary tightening solenoid 401 is secured to a body proper 405 above the electric motor 400, while a rod 345 is moved back and forth along the length of the body proper 405. The secondary tightening solenoid 401 is returned to its initial position by means of a spring not shown. The rod 345, when moved to its most advanced position, is positioned substantially above the flexible material lead-out path 324 provided in a second semi-circular guide element 312. Secured to the tip of the rod 345 are a pawl mechanism 347 and a flexible material gripping detecting switch 406. The detecting switch 406 is provided with a contact *a* (407) and a contact *b* (408) and actuated by means of a pawl 337*a* of the pawl mechanism 337. As a result, the flexible material 13 is gripped by the pawl mechanism 337, then the detecting switch 406 is switched from the contact *b* (408) to the contact *a* (407).

An operating push rod 411 for the self-return type trigger switch 410 projects forwards in the direction 412 of the grip portion 409. Pivoted to the front surface 412 of the grip portion through the medium of a bracket 353 is a trigger lever 354.

Figure 52:
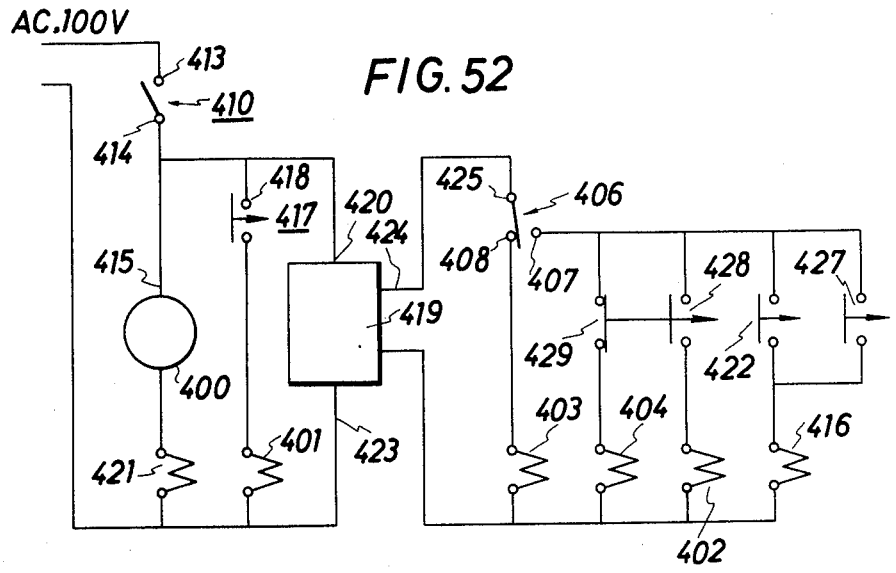
FIG. 52 is a bottom view of the automatic binder.

Description will be turned to the drive-binding operations of the automatic binder. Referring to FIG. 52, a trigger switch 410 is equipped with a contact *a*, while one terminal 413 is connected to an electric power source not shown. The voltage in the electric power source in A.C. 100V. A terminal 414 is connected to a terminal 415 of the electric motor 400, a terminal 418 for a contact *a* of an electric relay 416, a terminal *a* (417) of an electromagnetic relay 416, and a terminal 420 of a D.C. electric power source 419. The D.C. electric power source 419 is intended to drive electric relay groups used in the circuit, and a rectifier is used in this circuit. A current relay 421 is connected in series to the electric motor 400. The current relay 421 is actuated, when a current flowing through the electric motor 421 exceeds a given value, so that the contact *a* (422) is closed. A secondary tightening solenoid 401 is connected in series to the contact *a* (417) of the electromagnetic relay 416. The other terminal 423 of the D.C. electric power source 419 is connected to an A.C. electric power source not shown. A terminal 424 of the D.C. electric power source 419 is connected to a terminal 425 of a flexible material gripping detecting switch 406. Connected to the contact *a* (407) of the flexible material gripping detecting switch 406 are a contact *b* (426) of the electromagnetic relay 416, a contact *a* (417, a contact *a* (422) of the current relay 421, and one end of a self-maintaining contact 427. Connected in series to a contact *b* (408) of the flexible material gripping detecting switch 406 is a normal rotation electromagnetic clutch 403. Connected in series to a contact *b* (429) is a reverse rotation electromagnetic clutch 404. An electromagnetic brake 402 is connected in series to a contact a (428) which cooperates with a contact *b* (429) mechanically. Connected to the contact (422) is an electric relay 416. A self-maintaining contact 427 is connected in parallel to a contact *a* (422).

The drive and binding control circuits of a binder will be described in the order of the steps involved. FIG. 52 shows the initial condition of the binding operation. Firstly, when a bundle of a material 35 is admitted in the central hole 325 and the trigger lever 354 is pulled towards the grip portion 409, then the trigger lever 354 is rotated about the supporting portion 356, and then the arm 332 is moved forwards along the length of the body proper 1, so that the second semi-circular guide element 312 is rotated about the hinge 331 so as to close the ring-shaped guide member 330. At this time, when the trigger lever 354 presses the trigger switch actuating push rod 411, then the trigger switch 410 is closed so as to start the electric motor 400. At this time, the normal rotation electromagnetic clutch 403 is supplied with a current by way of the contact *b* (408) of the flexible material gripping detecting switch 406 from the D.C. electric power source 419, so that the drive shaft 340 is rotated in the normal direction, then the bevel gear 338 is rotated so as to actuate the flexible material lead-in mechanism 336, so that the flexible material 12 is fed into the flexible material lead-in path 318. On the other hand, the ring shaped guide member 330 is variated due to the rotation of the drive shaft 340, bevel gear 342, and vibration generating bevel gear 343 with the aid of the arm 333. During this time, the flexible material 12 is unwound from the flexible material magazine 379 and travels along the guide channel 380 under the cooperation of a forced feeding force of the flexible material lead-in mechanism 337 and the vibrations of the ring shaped guide member 330, with the result that the flexible material 12 is led out from the flexible material lead-out path 324.

When the tip portion 12*a* of the flexible material 12 is gripped by the pawl mechanism 337, then the push rod 428 of the flexible material gripping detecting switch 406 is pushed, so that the connection is switched from the contact *b* (408) to the contact *a* (407), and the normal rotation electromagnetic clutch 403 is disengaged, and the reverse rotation electromagnetic clutch 404 interconnects the drive shaft 340 and the electric motor 400. As a result, the drive shaft 340 is rotated in the reverse direction, so that the flexible material 12 is pulled back from the flexible material lead-in mechanism 336 so as to wind around the periphery of a bundle of the material 35. Upon the completion of winding, a tightening resistance of the flexible material 12 is increased, so that the amount of a current supplied to the electric motor 400 is increased. An increase in current actuates the current relay 421 to close the contact *a* (422). When the contact *a* (422) is closed, then the electromagnetic relay 416 is actuated, and the self maintaining contact 427 is closed and so self-maintained hereafter, whereupon the interlocking contact *b* (429) is opened and the interlocking contact *a* (428) is closed. As a result, the reverse rotation electromagnetic clutch 404 disengages the electric motor 400 from the drive shaft 340, whereupon the electromagnetic brake 402 is actuated, and the flexible material 12 is maintained in a primary tightened condition.

At this time, the contact *a* (417) of the electromagnetic relay 416 is closed, so that the secondary tightening solenoid 401 actuates so as to retract the rod 345 along the length of the body proper 405. This operation is referred to as a secondary tightening operation. The cutters 335 are operated during the above retraction so as to cut the flexible material 12 at two points.

When the trigger lever 354 is released, then the trigger switch 410 is opened, and the secondary tightening solenoid 401 is returned to the initial condition under the action of a spring. During this phase of operation, a waste cut or the tip portion of the flexible material 12 is removed from the pawl mechanism 337, and then the flexible material gripping detecting switch 406 is returned to the initial condition. As a result, the binding control circuit in its entirety is returned to its initial condition. According to the binding operation described, even if the flexible material fails to wind around the end of a long, bundle of a material, a bonding condition as shown in FIG. 40 will not result.

Figure 53:
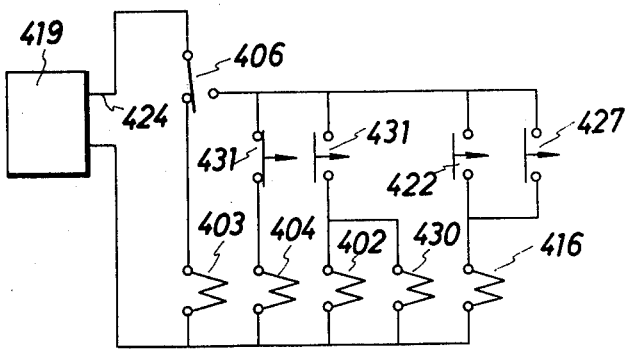

FIGS. 53 to 55 show another embodiment of the binding control circuit according to the present invention. With the embodiment shown in FIG. 53, the electromagnetic relay 430 is connected in parallel with the electromagnetic brake 402, and the contact *b* (431) of the electromagnetic relay 430 is replaced by the contact *b* (429). In addition, the contact *b* (431) is actuated independently of the contact *a* (429).

Description will now be given of the operation of the circuit having the aforesaid connection. When the tightening resistance of the flexible material 12 is increased, then the amount of a current flowing through the current relay 400 is increased, so the current relay 421 detects an increase in current and is actuated so as to close the contact *a* (422). The closure of the contact *a* (422) causes the electromagnetic relay 416 to be actuated, so that the self-maintaining contact 427 is closed and so self-maintained thereafter, whereupon the contact *a* (431) is closed. As a result, the electromagnetic brake 402 is actuated, and the electromagnetic relay 430 is actuated so as to open the contact *b* (431). In other words, after the electromagnetic brake 403 is actuated, the reverse rotation electromagnetic clutch 404 is disengaged. As can be seen from the foregoing description, due to the quick operation of the electromagnetic brake 402, slack in the flexible material 12, which takes place between the pawl mechanism 337 and the flexible material lead-out path 324 due to the delayed operation of the electromagnetic brake 402 as compared with that of the reverse rotation electromagnetic clutch 404, may be eliminated, and the secondary tightening operation by means of the secondary tightening solenoid 401 may be effectively carried out by a short stroke.

With the embodiment of FIG. 54, a lamp 433 as an indicmeans is connected in parallel to the current, to which is in series connected the electric motor 400 and the current relay 421, while a lamp lighting switch 436 having a contact A (434) and a contact B (435) is interposed between the electric motor 400 and the lamp 433. A contact B (435) is connected to a terminal 415 of the electric motor 400, while a contact A (434) is connected to a lamp 433. A lamp lighting switch 436 is actuated so as to be switched at the rearmost position of a rod 345. After the completion of the secondary tightening operation and the cutting of the flexible material by means of cutters 335, the lamp 433 is lit, serving as an operation confirming lamp.

With the embodiment of FIG. 55 a contact B (438) of the electro-magnetic relay 437 is interposed between the trigger switch 410 and the terminal 415 of the electric motor 400. A circuit including the lamp 439 and the contact B (440) of the electromagnetic relay 437 which are connected in series relation is connected in parallel to the circuit including the electric motor 400 and the current relay 421. In addition, a circuit including the operating switch 441 and an electromagnetic relay 437, which are connected in series, is connected in parallel thereto. The operating switch 441 is so designed as to be closed in the most retracted position of the rod 345. With the circuits thus arranged, the lamp 439 serves as a power lamp, which is lit when a current is supplied to the binding control circuits. In addition, the lamp 439 is turned off, when the operating switch 441 is opened by means of the rod 345, after the secondary tightening of the flexible material 12 and the cutting of the flexible material 12 by means of cutters 335. Thus, the lamp 439 serves combined functions as a confirming lamp indicating the completion of operation.

FIGS. 56 to 74 show a yet another embodiment of the automatic binder according to the present invention. Accordin to the this embodiment, the guide means is so designed as to be vibrated by means of a vibration generating valve.

Figure 56:
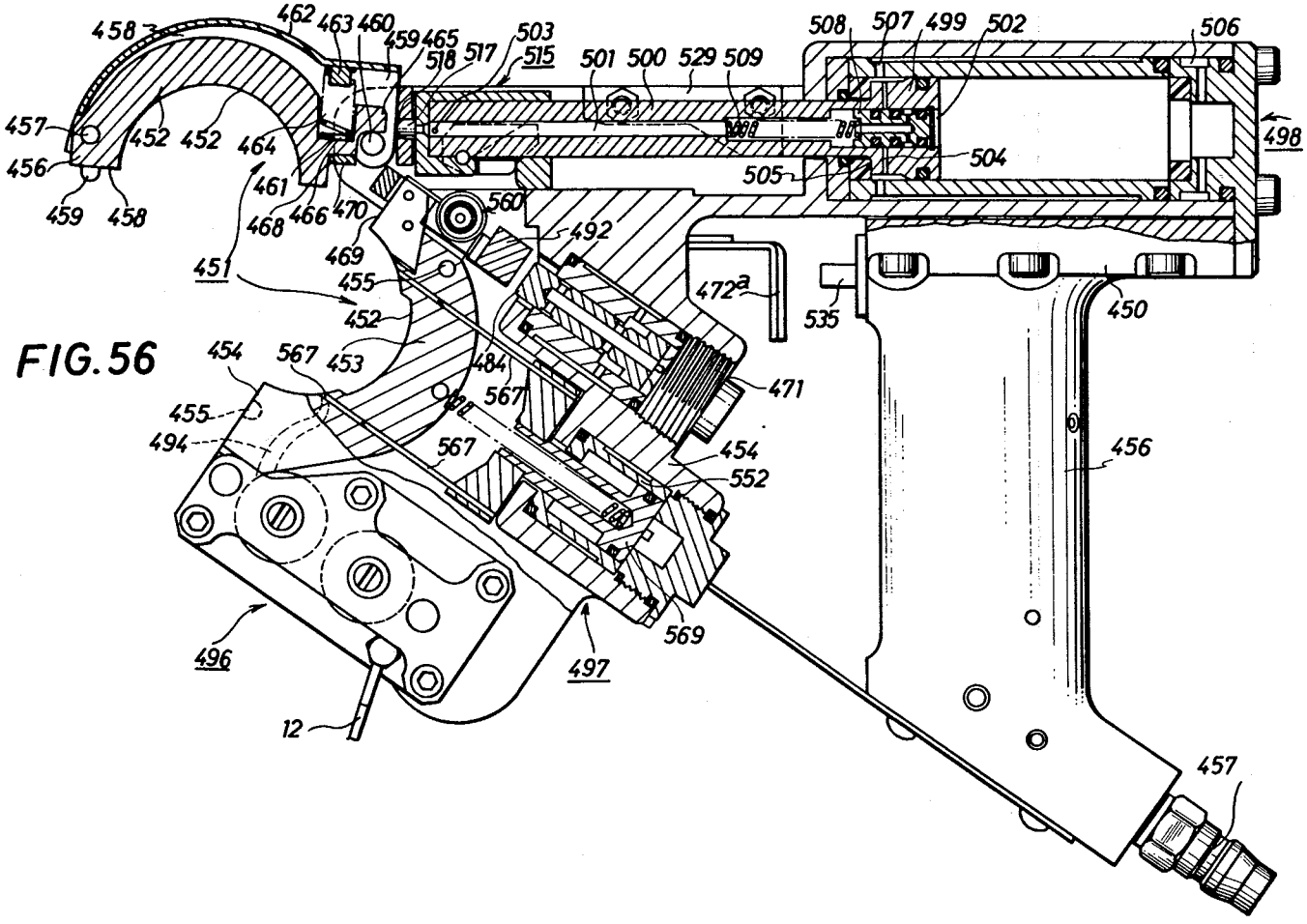
FIG. 56 is a front view, partly in cross section, of further embodiment of the automatic binder according to the present invention.

Description will be given of this embodiment by referring to FIGS. 56 to FIG. 74. FIG. 56 shows the entire arrangement of the automatic binder incorporating binding drive and control circuits. As shown in FIG. 56, a ring-shaped guide member 451 is positioned in the tip portion of a body proper 450 of a gun type. Guide channels 314 defined in an inner peripheral surfacr 452 of the ring-shaped guide member 451 are of the same arrangement as that shown in FIG. 37, and thus like parts are designated like reference numerals for common use. The ring-shaped guide member 451 consists of a movable guide element 452 and a stationary guide element 453. The stationary guide element 453 is secured through the medium of an attaching hole 455 to a depending portion 454 of the body proper, which serves as a supporting portion that projects downwards from the tip of the body proper 450. A grip portion 456 projecting downwards is provided on a rear end portion of the body proper 450. An air plug 457 is provided in the rear end portion of the grip portion 456 for introducing working air. A locating projection 459 is provided on a mating surface 458 of the stationary guide element 453 in the position facing the tip portion of the movable guide element 452. A concave portion 455 is provided in a mating surfacr 454 of the stationary guide element in a position to mate with the aforesaid locating projection 459. Thus, the locating projection 454 is fitted in the concave portion 455, so that the guide channels in the movable guide element 452 become accurately continuous with the guide channels 314 in the stationary guide element 453. A vibration-fulcrum shaft 457 is formed on a side surface 456 of the movable guide element 452 in the tip portion thereof, and the movable guide element 452 is pivotally supported by a guide casing 458 by means of the vibration fulorum shaft 457. The guide casing 458 is rotatably supported by a root portion 450 by means of a pin 460. The width of the root portion 459 is sufficiently large, such that the movable guide element 452 may vibrate in the widthwise direction of the element 452. A side wall 462 extends from the tip to the root portion of the guide casing 458 on the side facing a back surface 461 of the movable guide element 452. A spring mounting projection 463 is formed on the root portion of the side wall 462.

On the other hand, a spring attaching concave portion 464 is provided in the root portion of the movable guide element 452 on the back surface 461 in a manner to fact the spring mounting projection 463. An engaging projection 465 is formed on the root portion of the back surface 461 in parallel with the spring attaching concave portion 464. A compression spring 466 is confined between the spring mounting projection 463 and the spring attaching concave portion. The engaging projection 467 is urged against the pin 460 under the action of the spring 466, thereby urging a root mating surface 468 of the movable guide element 452 towards a root mating surface 469 of the stationary guide element 453. A back surface of a bottom of the spring attaching concave portion 464 is deeper than the level of the root mating surface 468 of the movable guide element 452, and a buffer member 470 is positioned on the aforesaid back surface. A vibration-generating valve 471 imparts vibrations to the movable guide element 452 through the medium of the buffer member 470, and is built in the body-proper depending portion 454.

Figure 57:
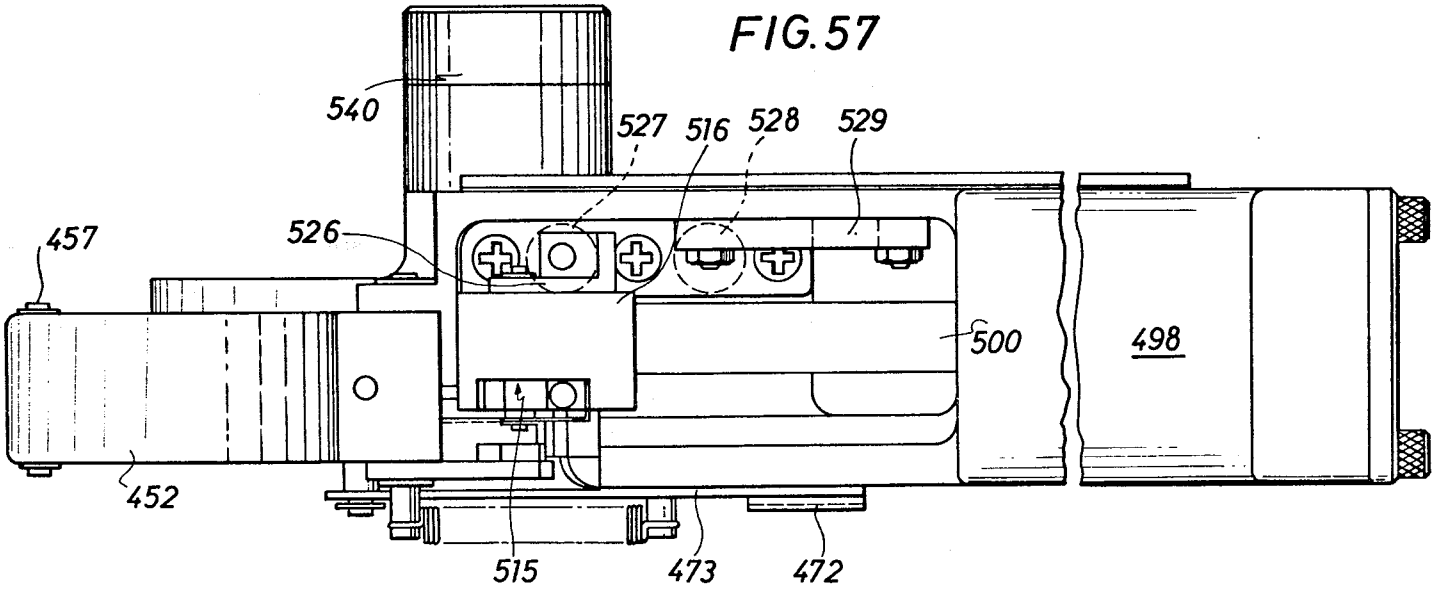
FIG. 57 is a plan view of the binder.

The movable guide element 452 and the stationary guide element 453 are coupled to each other by means of a connecting arm (not shown) which extends between an attaching hole of the stationary guide element 453 and the pin 460 on the movable guide element 452. As shown in FIG. 57, the rotational center of the movable guide element 452 is positioned closer to the root mating surface 468 of the movable guide element 452 than the pin 460 and connected to the trigger through the medium of an opening and closing arm. The aforesaid positional relationship is the same as that shown in the embodiment of FIG. 3.

The ring-shaped guide member 451 may be opened by utilizing a spring force acting on the movable guide element 452.

Figures 58, 59:
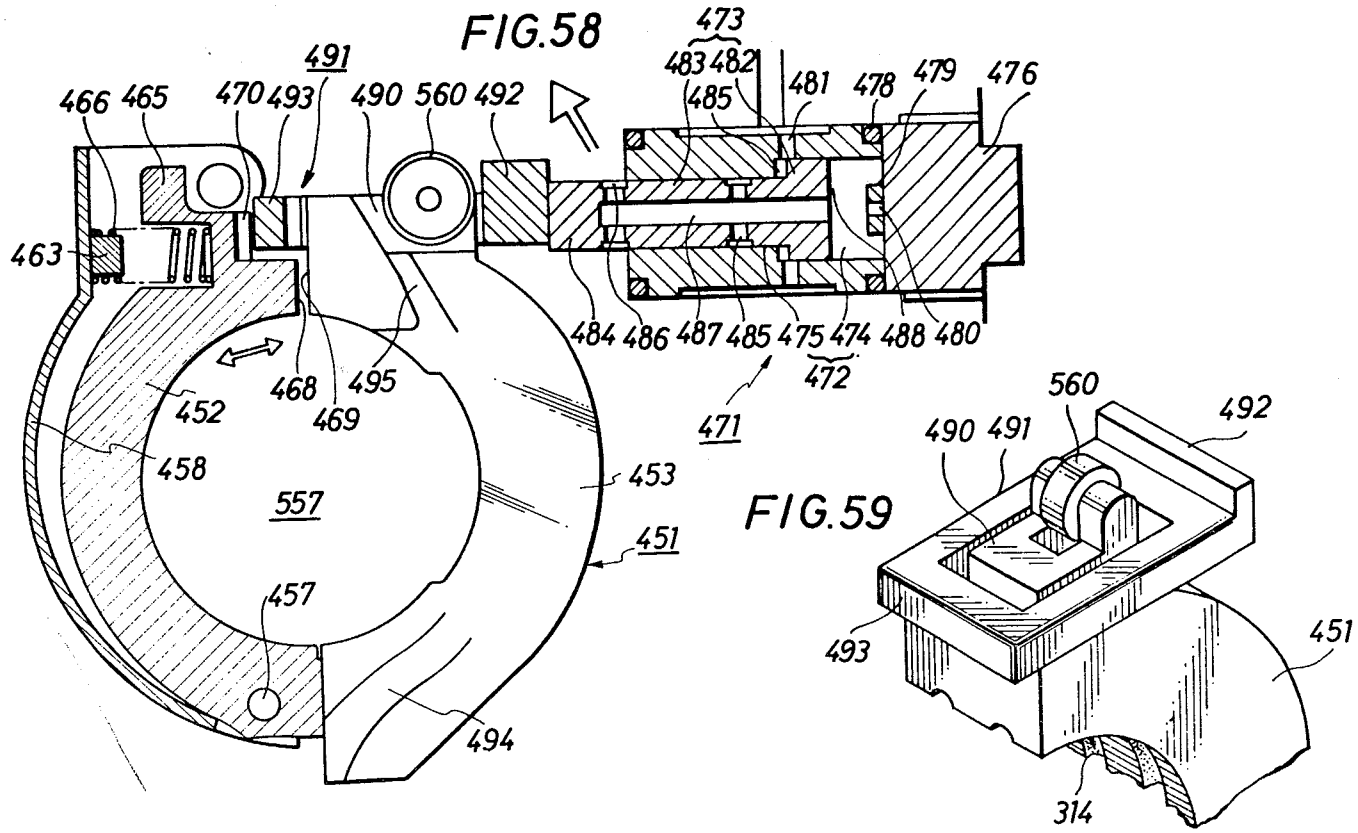
FIG. 58 is a view, partly in cross section, of a vibration generating mechanism adapted to vibrate the ring shaped guide member.
FIG. 59 is a perspective view showing the relationship between the stationary guide element and a vibrating slider.

FIGS. 56, 58, 59 show a vibration generating valve 471 as a vibration generating mechanism. The vibration generating mechanism will be described with reference to FIGS. 58 and 59. The construction of the vibration generating valve 471 is such that a valve stem 473 is fitted in a valve cylinder 472 in reciprocable manner. The valve cylinder 472 consists of a large diameter cylinder portion 474 and a small diameter cylinder portion 475, while a cylinder cap 476 is threaded through the medium of O-ring 478 into the right-hand end of the large diameter cylinder portion 474. A bumper 479 is secured to the cylinder cap 476. An air lead-in groove 480 is provided in the bumper 479 for introducing air into the large diameter cylinder portion 474. An air pressure supply port 481 is provided in the large diameter cylinder portion 474 adjacent to the small diameter portion 475.

Meanwhile, the valve stem 473 consists of a large diameter stem portion 482 and a small diameter stem portion 483. A vibration drive 484 is provided in the tip portion of the small diameter stem portion 483. An air admitting transverse hole 485 an air discharge transverse hole 486 are provided in the small diameter stem portion 483 in the transverse direction. Each end of the air admitting transverse hole 485 and air discharge transverse hole 486 is defined by the surface of the vibration drive 484, while the other ends thereof are communicated with each other by way of an air admitting longitudinal hole 487.

When the valve stem 473 assumes the right end position, then the air admitting hole 485 is communicated with the air supply port 481, and the air discharge transverse hole 486 is retracted into the small diameter cylinder portion 475 and shut off from the communication with atmosphere. As a result, working air is applied as a leftward thrust to the right-hand end surface 488 of the large diameter stem portion 482 through the air supply port 481, air admitting transverse hole 485, air admitting longitudinal hole 487 and air lead-in groove 480. The working air acts as a rightward thrust F2 on a stepped portion 489 between the large diameter stem portion 482 and the small diameter stem portion 483, and in addition working air acts on the vibration drive 484 positioned at the left end of the air admitting longitudinal hole 487 as a leftward thrust. As a result, a leftward thrust F1 is produced by a working-air pressure acting on a cross section of the small diameter stem portion 483, thereby displacing the valve stem 473 to the left.

In the course of the leftward movement of the valve stem 473, the moment the air discharge transverse hole 486 peeps out of the end of the small diameter cylinder portion 475 to an atmosphere, then the working air which has been filled or compressed in the large diameter cylinder portion 474 and air admitting longitudinal hole 487 is bled through the air discharge transverse hole 486 into atmosphere, so that a thrust F1 disappears. During this time, the working air, which is being introduced through the air supply port 481, urges the stepped portion 489 to the right, thereby producing a thrust F2. Accordingly, when a thrust F2 becomes higher than the thrust F1, the valve stem 473 is subjected to the rightward thrust F2 to move to the right. When the right-hand end surface 488 of the large diameter stem portion abuts the bumper 479, the air admitting hole 485 is brought into communication with the air supply port 481. As a result, working air is charged into the air admitting longitudinal hole 487 and large diameter cylinder portion 474, so that the leftward thrust F1 is applied to the valve stem 473 to move same to the left. In this manner, the valve stem 473 reciprocates or vibrates.

A vibration slider 491 is reciprocably fitted in the root portion 490 of the stationary guide element 453, and the slider 491 is adapted to receive blows from the valve stem 473. The tip portion 493 of the vibration driver 484 continuously strikes the buffer member 470 on the movable guide element 452. As a result, the movable guide element 452 is vibrated about the vibration fulcrum shaft 457, with the root mating surfaces 468 being oscillated relative to the root end portion 490 of the stationary guide element 452. At this time, the stationary guide element 453 is not directly vibrated and driven by means of the vibration slider 491, but receives vibrations from the movable guide element 452 to some extent. Alternatively, the stationary guide element 453 may be directly vibrated as in the case of the movable guide element 452, as required.

Due to vibrations of the movable guide element 452, the flexible material 12 may be smoothly guided along the guide channels 314 in the ring-shaped guide member 451 for a short time from the flexible material lead-in hole 494 towards the flexible material lead-out hole 495.

As shown in FIG. 56, a feed-in, primary tightening roller mechanism 496 of the type the same as that shown in FIG. 8 is provided in the lowermost portion of the body-proper-depending portion 454 adjacent to the flexible material lead-in hole 494 in the stationary guide element 453. The aforesaid roller mechanism 496 is adapted to feed the flexible material 12 into the stationary guide element 453 for the primary tightening. A cutter mechanism 497 is positioned adjacent to the feed-in, primary tightening roller mechanism 496. The cutter mechanism 497 is of the same type as that shown in FIG. 1. A secondary tightening of the flexible material 12 is provided on top of the grip portion 456 and extends towards the stationary guide element 452. The secondary tightening cylinder 498 is of a double acting type and actuated by a secondary tightening cylinder switching valve 536. A secondary tightening piston 499 is slidingly fitted in the secondary tightening cylinder 498, with a long piston rod 500 coupled thereto integrally. A through hole 501 runs through the secondary tightening piston 499 as well as the piston rod 500 along the length thereof. An air bleed valve cylinder 502 is provided on a side of the secondary tightening piston 499 with respect to the through hole 501. A flexible-material-waste-cut-blowing hole 503 is provided in the tip portion of the piston rod 500 in communication with the through-hole 501 in the transverse direction and open to the atmosphere. In addition, a communicating hole 504 is provided in the secondary tightening piston 499. One end of the communicating hole 504 is open to the secondary tightening cylinder 498 and the other end thereof is open to the air bleed valve cylinder 502. The communicating hole 504 is open from the stepped portion 505 between the secondary tightening piston 499 and the piston rod 500. An advancing air supply port 506 is provided in the right-hand end portion of the secondary tightening cylinder 498, and the air supply port 506 can supply working air, even if the secondary tightening piston 499 assumes a right-hand extremity of a stroke. A retracting air supply port 507 is provided in the left end portion of the cylinder 498 and adapted to be communicated with the communicating hole 504, when the secondary tightening piston 499 assumes the left-hand extremity of a stroke.

An air bleed valve stem 508 is slidingly fitted in the air bleed valve cylinder 502. The air bleed valve stem 508 is urged by the compression coil spring 509 from the left, and the rightward movement of the air bleed valve stem 508 is stopped by a retaining ring 510 fitted in the air bleed valve cylinder 502 at the right-hand thereof. The air bleed valve stem 508 has three O-rings 511, 512, and 513 fitted thereon. A communicating hole 514 runs between the O-ring 511 and 512. The communicating hole 514 is communicated with the air bleed valve cylinder 502 within the piston rod 500. When the air bleed valve stem 508 is positioned at the right-hand extremity of a stroke under the action of the compression coil spring 509, the communicating hole 514 is closed to the communicating hole 504, and when positioned at the left-hand extremity of the stroke, the communicating hole 514 is communicated with the communicating hole 504.

Figures 60, 61:
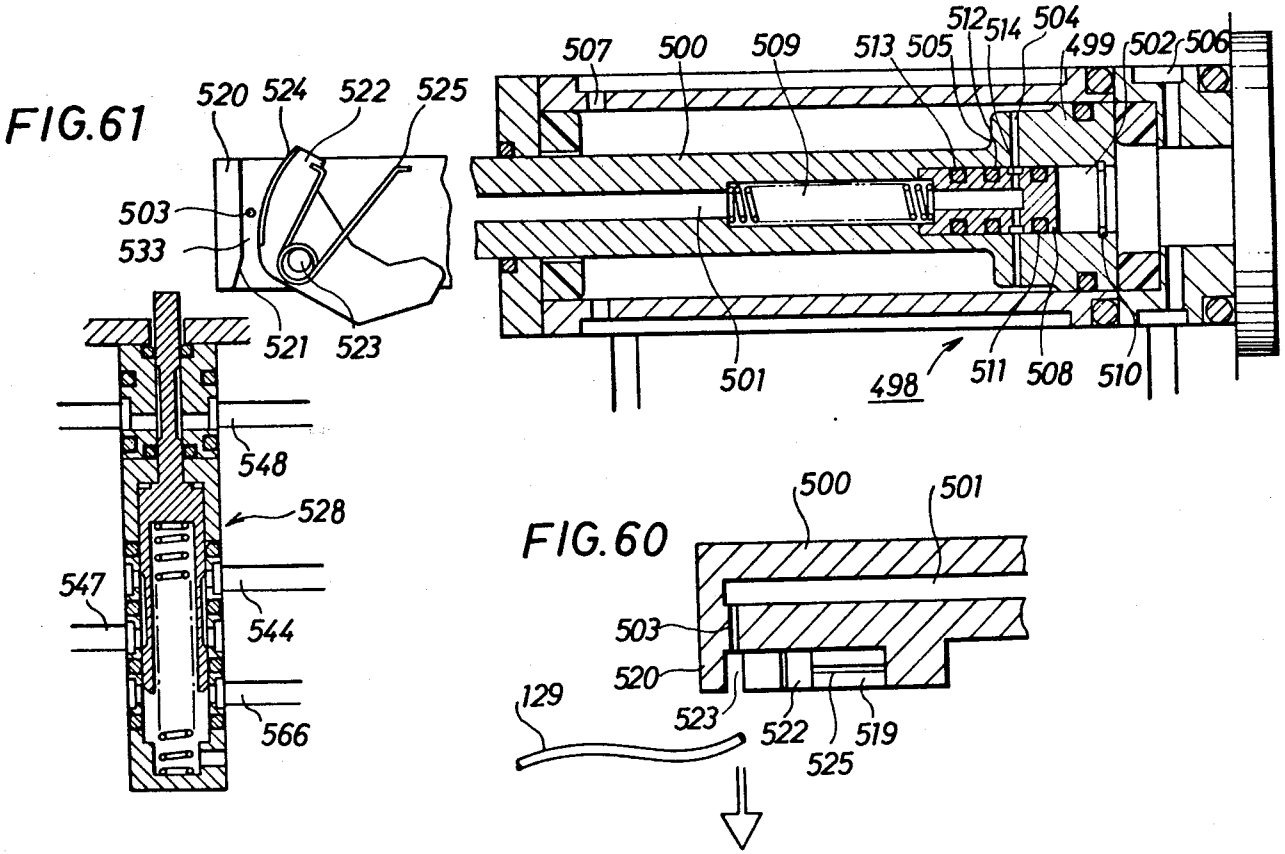
FIG. 60 is plan and cross-sectional views illustrative of the neighborhoold of a stationary pawl and a rotatable pawl in a flexible material blowing mechanism.
FIG. 61 is a front view, partly in cross section, showing the positional relationship of respective parts of the blowing mechanism for a waste cut of a flexible material, when the secondary tightening cylinder assumes its rearmost position.

As clearly shown in FIG. 57, a casing 516 of the flexible material gripping mechanism 515 is threaded on the tip portion of the piston rod 500. A retaining pin 517 is secured to the left end surface of the casing 516, so that when the piston rod 500 assumes the most advanced position, the retaining pin 517 is inserted into a retaining hole 518 provided in the body proper 450, whereby the swinging of the piston rod 500 in both the vertical and horizontal directions is prevented. This positional relationship is clearly shown in FIG. 56. The through-hole 501 is closed with the casing 516 at the left and thereof. As a result, working air which has been charged in the through-hole 501 is injected through a flexible material waste cut blowing hole 503. As shown in FIG. 60, a recessed portion 519 is provided in the front surface of the casing 516, and a fixed pawl 520 is formed on the tip portion thereof in projecting relation. The lower portion of the fixed pawl 520 is tapered as shown at 521. The tapered surface 521 functions to guide the tip portion 12*a* smoothly. A rotatable pawl 522 is rotatably supported on a pin 523 in opposing relation to the fixed pawl 520. A flexible-material-waste-cut-blowing hole 503 is open between the fixed pawl 520 and the rotatable pawl 522. An arcuate edge 524 of the rotatable pawl 522 is urged against the fixed pawl 520 by means of a spring 525. An operating piece 526 integral with the rotatable pawl 522 is disposed on the back side of the casing 516. The operating piece 526 actuates a gripping detecting valve 527 adapted to detect the fact that the tip portion 12*a* of the flexible material 12 is gripped, and a cutter operating valve 528.

FIGS. 57 to 62 show in detail the positional relationship of the operating piece 526, gripping detecting valve 527, and cutter operating valve 528. Referring to FIG. 62, a rotatable pawl operating block 529 is mounted on a body proper 450 above the cutter operating valve 528. The rotatable pawl operating block 529 is continuous with a horizontal surface portion 530 which is formed with a tapered surface 531 aslant downwards. As a result, during a retracting stroke of the piston rod 500 for secondarily tightening the flexible material 12, when an upper end portion 532 of the operating piece 526 actuates the cutter operating valve 528 under the guidance of the horizontal lower portion 530 to rotate the rotatable pawl 522 in the clockwise direction under the guidance of the tapered surface 531 of the rotatable pawl operating block 529, then a clearance 533 between the rotatable pawl 522 and the fixed pawl 520 is enlarged gradually. Thus, when the secondary tightening piston 499 reaches the right end of the secondary tightening cylinder 498, the aforesaid clearance 533 is increased to its maximum.

The gripping detecting valve 527, and cutter actuating valve 528 are of the same construction and features as those of the pneumatic motor normal-reverse-rotation-switching valve 172. A trigger stem 535 of a trigger valve 534 projects from the grip portion 456 in opposing relation to the trigger 472. In addition, a secondary tightening cylinder switching valve 536 is built between the trigger valve 535 and the air plug 457, although not shown.

Description has been thus far given of the mechanical operating portions of the binder. Now, the drive and control circuits using a pneumatic pressure in the binder will be described by referring to FIGS. 65 to 74.

Figure 65:
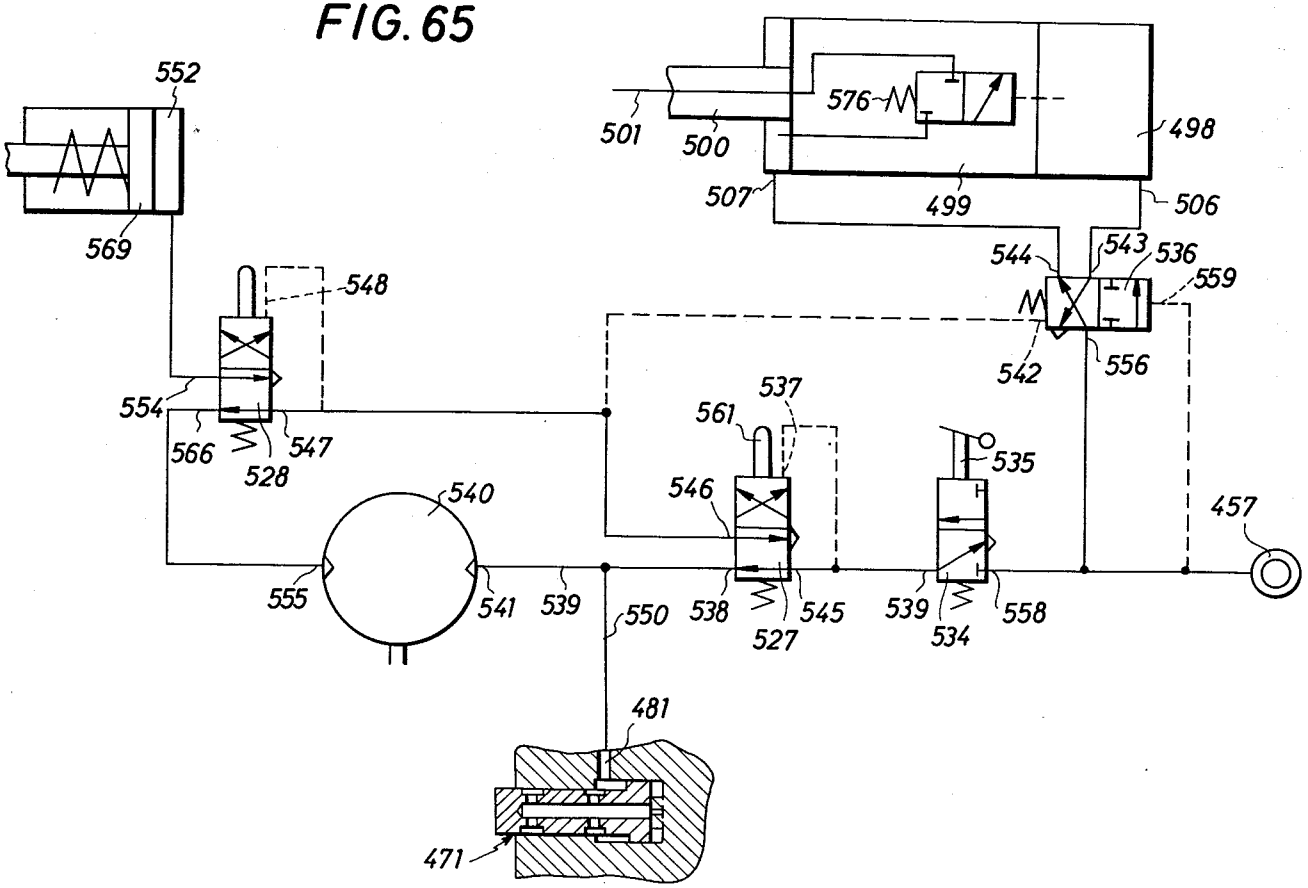
Figure 66:
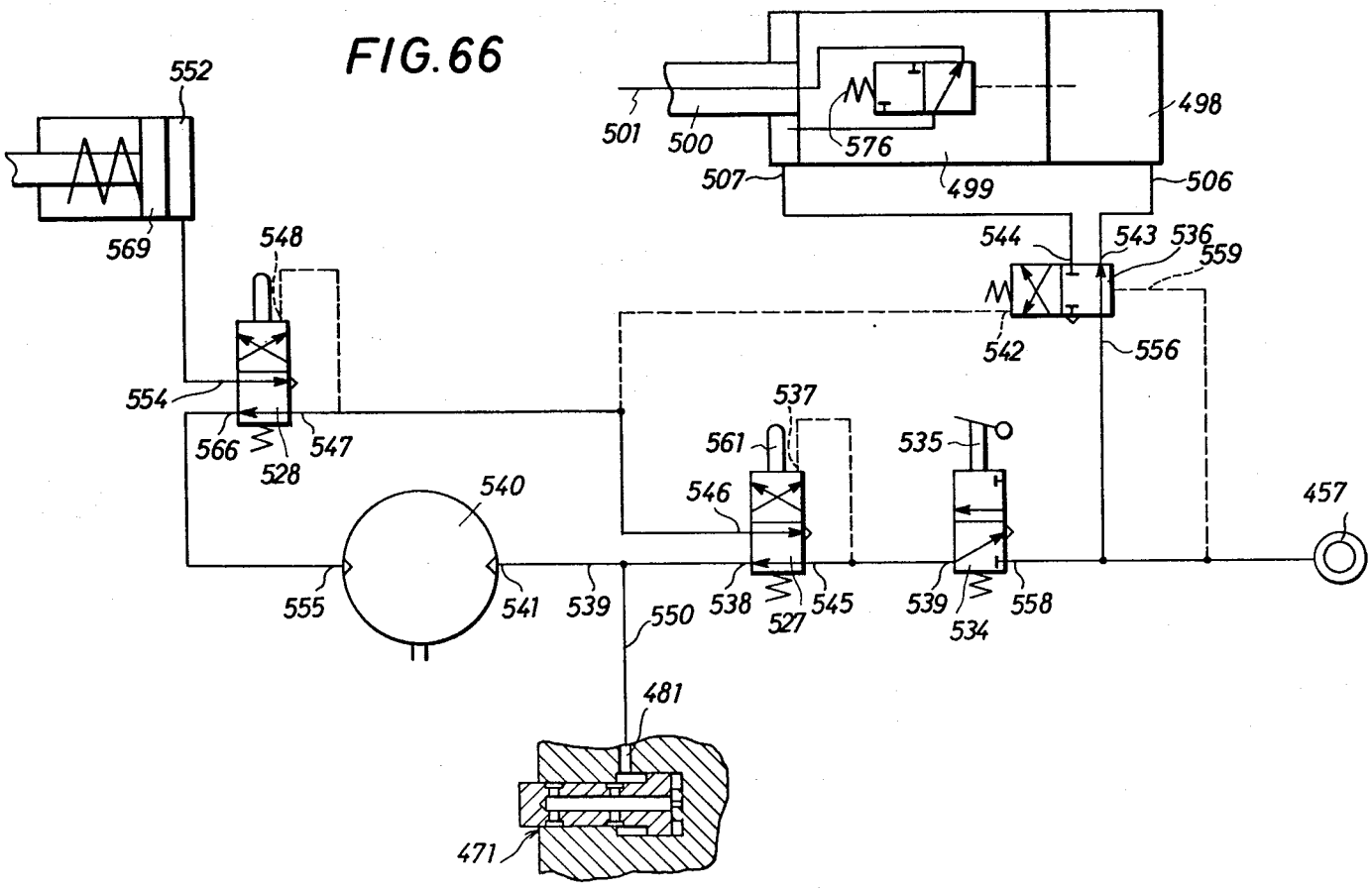

Referring to FIGS. 65 and 66, an input port 558 in a trigger valve 534 is communicated with the air plug 457. Working air is supplied by way of the air plug 457 from an air source not shown. An output port 539 in the trigger valve is concerned by way of a polit port 537, and an output port 538 in the gripping detecting valve 527 and air passages 539 to a normal rotation input port 541 in the feed-in, primary tightening roller mechanism 496.

The trigger valve 534 is of a two-position three-port type, and may be returned to its initial position under the action of a spring.

The air plug 457 is connected to an input port 558 in the trigger valve 535, as well as to an input port 556 in the secondary tightening cylinder switching valve 536, and a self-maintaining input port 559. The secondary tightening cylinder switching valve 536 is of a two-position four-port type, and is provided with a self-maintaining input port 559 and a return input port 542. For a return stroke of the valve, a force of a spring and working air supplied through the return input port 542 are used. An advancing output port 543 in the secondary tightening cylinder switching valve 536 is communicated with an advancing air supply port 506 in the secondary tightening cylinder 498, while a retracting output port 554 is communicated with a retracting air supply port 507. A return input port 545 is communicated with an output port 546 in the gripping detecting valve 527, input port 547 a pilot port 548 in the cutter operating valve 528.

Branched from the air passage 549 in an air passage 550 leading to the air supply port 481 in the vibration valve 471. Accordingly, the working air to drive the pneumatic motor 540 and the vibration valve 471 are automatically distributed and adjusted, commensurate with a load acting on the pneumatic motor 540. For instance, when a travelling resistance of the flexible material 12 along the guide channels in the ring-shaped guide member 451 is high, then there results an increase in a load exerted on the pneumatic motor 540, with the result that the r.p.m. of the pneumatic motor 540 is lowered, and the amount of working air to be supplied to the normal rotation input port 541 is reduced. The working air of an amount thus reduced is supplied additionally to the vibration valve 471, thereby increasing the vibration frequency of the vibration valve 471, and enabling smooth travelling of the flexible material 12.

An output port 551 in the cutter operating valve 528 is communicated with a cutter drive cylinder 552, and two cutters 567 are driven into or from a flexible material lead-in hole 494 as well as a flexible material lead-out hole 495 provided in the ring-shaped guide member 451, under the pressure of working air fed from the output port 551. An output port 554 in the cutter operating valve 528 is connected to a reverse rotation input port 555 in the pneumatic motor 540.

Description will now be turned to the operation of drive and control circuits of the binder, according to the order of binding operations. FIG. 65 shows the initial condition of the binder, while FIG. 66 shows a condition where the air plug 47 is connected to an air source such as a compressor or the like. At this time, working air is supplied to the self maintaining input port 559 in the secondary tightening cylinder switching valve 536, whereupon the input port 556 is communicated with the advancing output port 543, so that working air is supplied by way of the advancing air supply port 506 into the secondary tightening cylinder 498.

Figure 67:
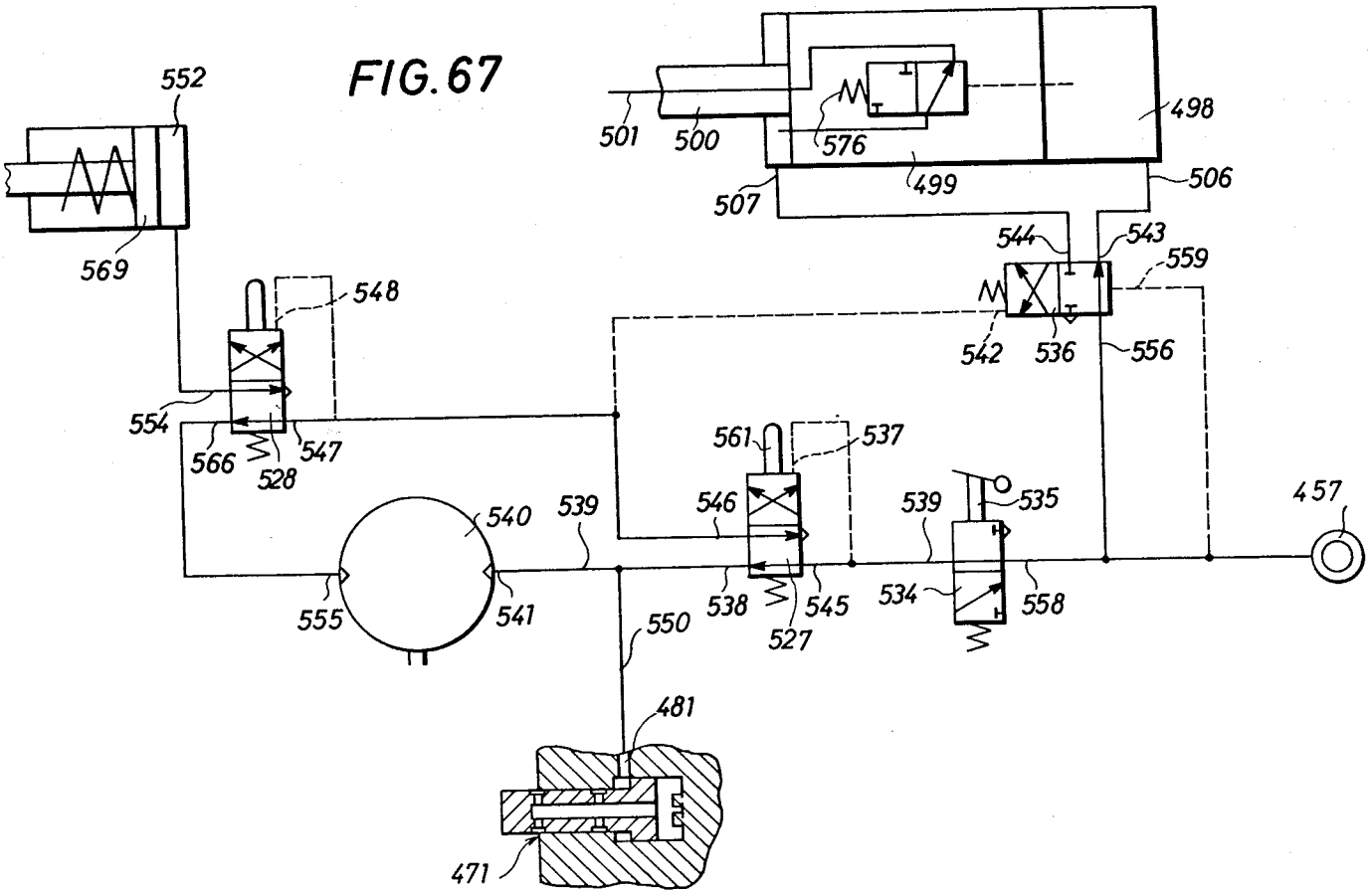

When a bundle of the material 35 is admitted in the central hole 557 from this condition as shown in FIG. 67 and the trigger 472 is pulled towards the grip portion 456, then the movable guide element 452 is rotated so as to close the ring-shaped guide member 451. Thereafter, when the trigger 472 is further pulled, the trigger presses the trigger valve stem 535 to switch internal flow paths in the trigger valve 534. At this time, the input port 558 in the trigger valve 534 is communicated with the output port 539, input port 140 in the gripping detecting valve 527, output port 538, and then with the normal rotation input port 541 in the pneumatic motor 540, so that working air is supplied in this order, thereby rotating the pneumatic motor 540 in the normal direction, i.e., in the clock-wise direction as viewed in the drawing. The direction of the pneumatic motor 540 in the normal direction causes the rotation of the feed-in primary tightening roller mechanism 496 in the normal direction.

On the other hand, working air is supplied by way of air passages 549, 550 to the vibration valve 471, so that the vibration drive 484 continuously hits the vibration slider 491, with the result that the buffer piece 470 is striken through the medium of the vibration slider 491. As a result, the movable guide element 452 is vibrated about the vibration fulcrum shaft 457. Under the cooperation of the forced feeding of the feed-in, primary tightening roller mechanism 496 with the vibrations of the movable guide element 452, the flexible material 12 may be unwound from a bobbin and fed through the feed-in, primary tightening roller mechanism 496, and flexible material lead-in hole 494, along the guide channels 9 provided in the inner peripheral surface of the ring-shaped guide member 451, then out of the flexible material lead-out hole 495, and then through the flexible material receiving roller 560 into the flexible material gripping mechanism 515 to be gripped thereby.

During this time, the r.p.m. of the pneumatic motor 540 and the vibration frequency of the vibration valve 471 are suitable adjusted according to automatic distribution and adjustment of working air.

Figure 68:
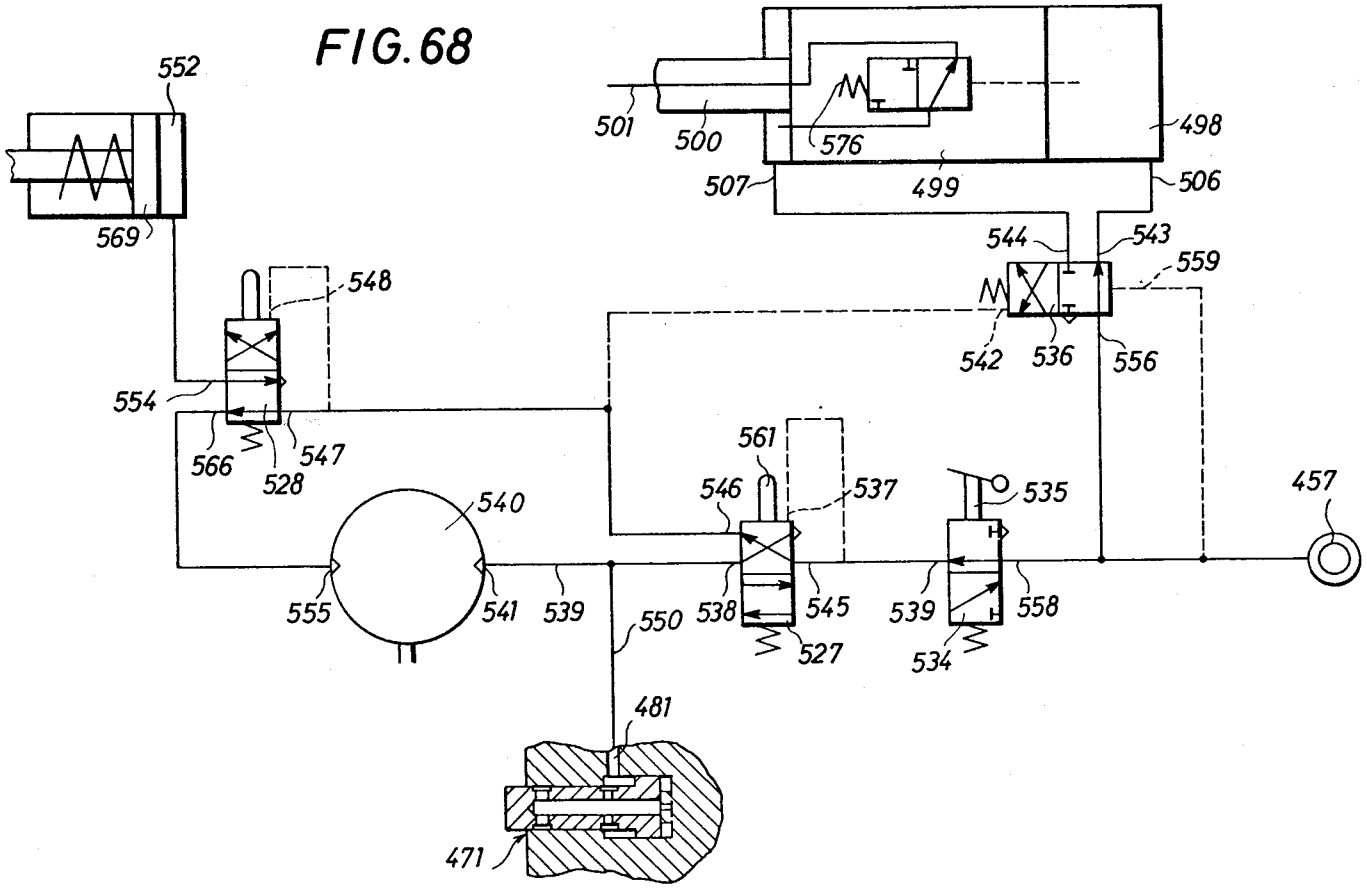
Figure 69:
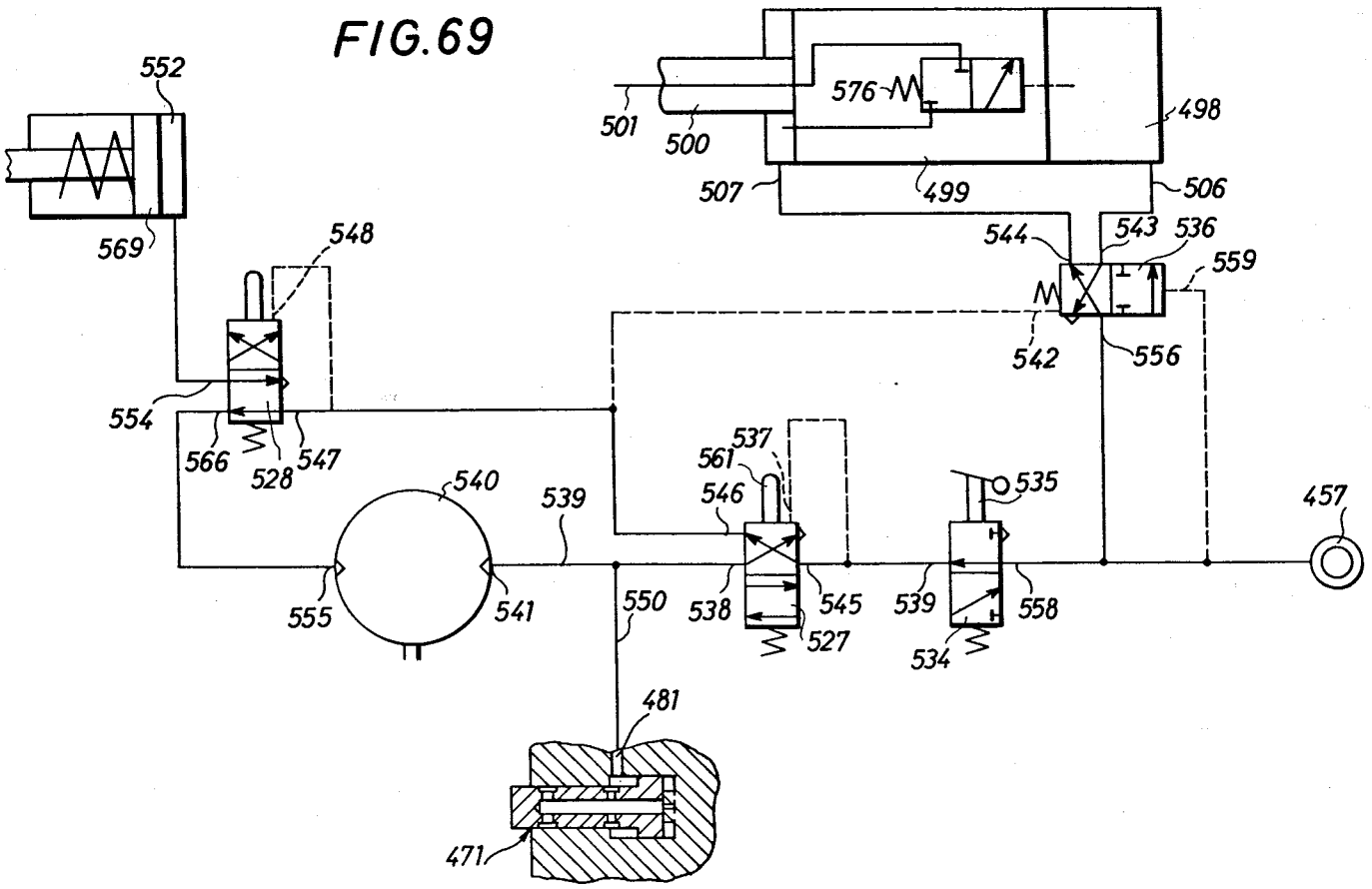

As shown in FIG. 68, the tip portion 12*a* of the flexible material 12 is inserted into the clearance 533 defined between the fixed pawl 520 and the rotatable pawl 522, and then the rotatable pawl 522 is slightly rotated in the clockwise direction, so that the operational tip end portion 561 of the gripping detecting valve 527 is lifted by the operating piece 526. This causes the switching of the internal flow paths in the gripping detecting valve 527, so that the input port 538 is brought into communication with the output port 546. Simultaneously therewith, the supply of working air to the vibration valve 471 is interrupted, so the vibration of the movable guide element 452 is stopped. As a result, working air is supplied by way of input port 140, output port 546, input port 457 in the cutter operating valve 528, and output port 566, to the reverse rotation input port 555 in the pneumatic motor 540, so that the pneumatic motor 540 is rotated in the reverse direction. This drives the feed-in, primary tightening roller mechanism 496 in the reverse direction, thereby causing the primary tightening operation to start. Due to the reverse rotation of the feed-in, primary tightening roller mechanism 496, the flexible material 12 is fed out of the flexible material lead in hole 494 in the stationary guide element 453 so as to be bound around the periphery of a bundle of the material 35. Upon completion of the primary tightening operation, a tightening resistance of the flexible material is suddenly increased, so the reverse rotation of the pneumatic motor 540 is stopped. When the pneumatic motor 540 is stopped, then there takes place a rise in working-pressure in a flow passage including the output port 554 to the cutter operating valve 528, input port 547, and return input port 542 in the secondary tightening cylinder switching valve 536, so that the aforesaid working air is raised to the same level as that of the working air being supplied to the advancing input port 543 in the secondary tightening cylinder switching valve 536. As a result, as shown in FIG. 69, a force of a spring adds to an air pressure acting on the return input port, so that internal flow paths in the secondary tightening cylinder switching valve 536 is switched, so working air is supplied by way of the input port 556 and retracting the output port 544 to the retracting air supply port 507 in the secondary tightening cylinder 498, and thus the secondary tightening piston 499 is retracted to the right as shown in FIG. 56. Due to the movement of the secondary tightening piston 499 as above, the piston rod 500 further tightens the flexible material bound around a bundle of the material 35, with the tip portion 12*a* of the flexible material 12 being fast gripped by the flexible material gripping mechanism 515. The secondary tightening operation is completed through the aforesaid series of operations.

Figure 70:
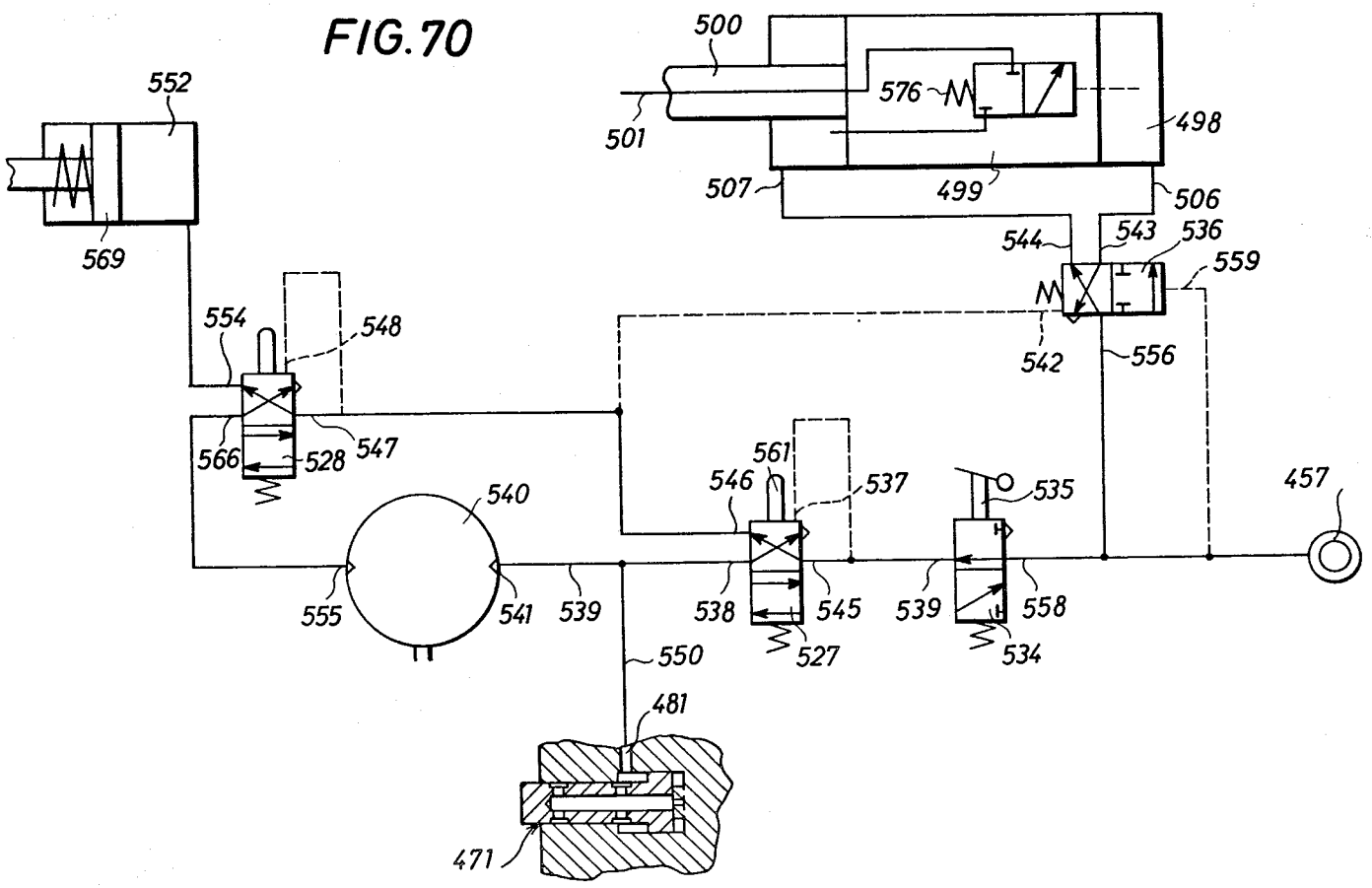

During a retracting stroke of the piston rod 500, as shown in FIG. 70, the operating piece 526 switches the cutter operating valve 528 under the guidance of the horizontal lower surface portion 530 of the rotatable pawl operating block 529, so that a flow path is established in a manner that working air may be supplied to the cutter drive cylinder 552, the aforesaid flow path leading by way of, in turn, air plug 457 and input port 558, output port 539 in the trigger valve 534, input port 538 and output port 538 and output port 546 in the gripping detecting valve 527, and input port 547 and output port 551 in the cutter operating valve 528, to the cutter drive cylinder 552. As a result, the cutters 557 are advanced along the cutter guide hole 568 in the stationary guide element 453, thereby cutting the flexible material 12 at two points after the completion of binding operation. Then, the tip portion 12*a* of the flexigle material 12 which has been retained between the stationary pawl 520 and the rotatable pawl 522 remains intact.

Figure 71:
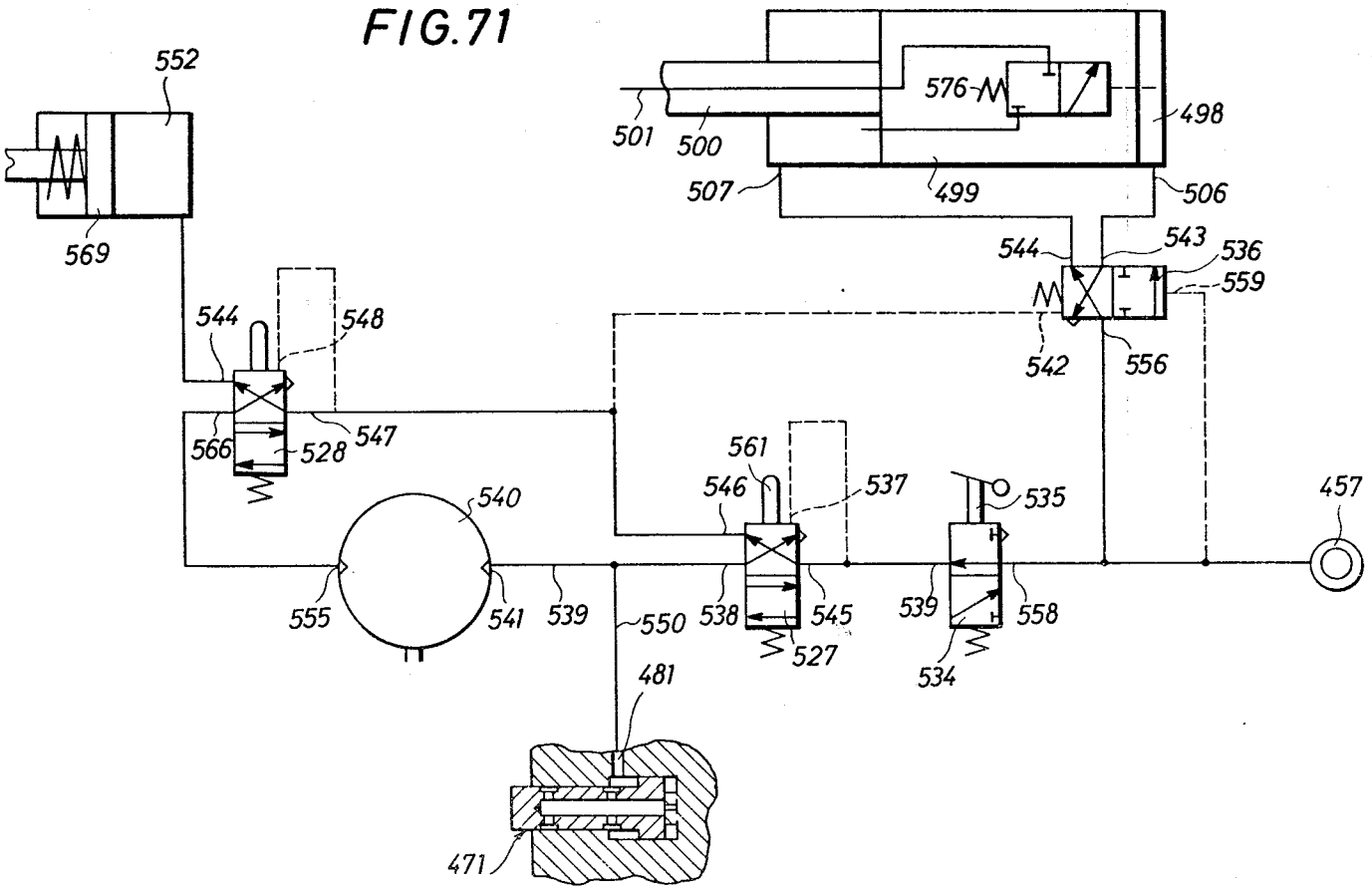

As shown in FIG. 71, when the secondary tightening piston 499 reaches a right end portion of the secondary tightening cylinder 498, then the operating piece 526 is rotated in the clockwise direction by means of the tapered surface 531 of the rotatable pawl operating block 529, with the result that a clearance between the fixed pawl 520 and the rotatable pawl 522 is maximized. As a result, the flexible-material-waste-cut-blowing hole 503 is opened into the clearance 533.

Figure 72:
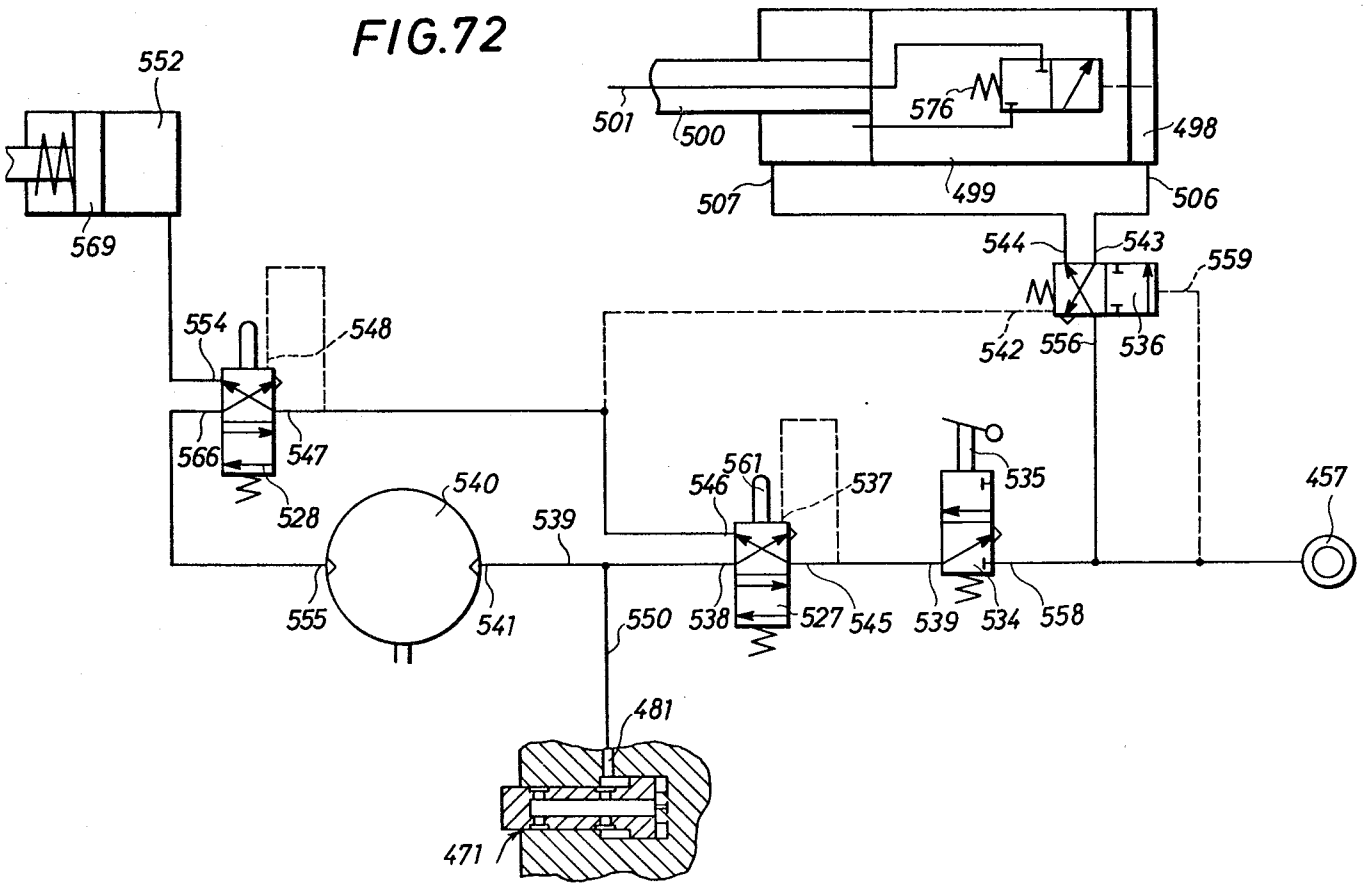

As shown in FIG. 72, when the trigger 472 is released, then the trigger 472 and trigger valve stem 535 are returned to this initial conditions unser the action of a spring, while the output port 539 in the trigger valve 534 is open to the atmosphere. In addition, when the trigger 472 is returned to its initial position completely, then the ring-shaped guide member 451 is opened. When the output port 539 is opened to the atmosphere, then the pilot port 537 in the gripping detecting valve 527 is opened to the atmosphere, the valve stem 572 is returned to its initial position the action of the compression spring 571, the pilot port 574 in the cutter operating valve 528 is communicated by way of the exhaust 573 in the gripping detecting valve 527 with the atmosphere, the valve stem 575 in the cutter operating valve 528 is returned to its initial position under the action of a spring, and the return input port 542 in the secondary tightening cylinder switching valve 536 is also open to the atmosphere by way of the pilot port 574.

Figure 73:
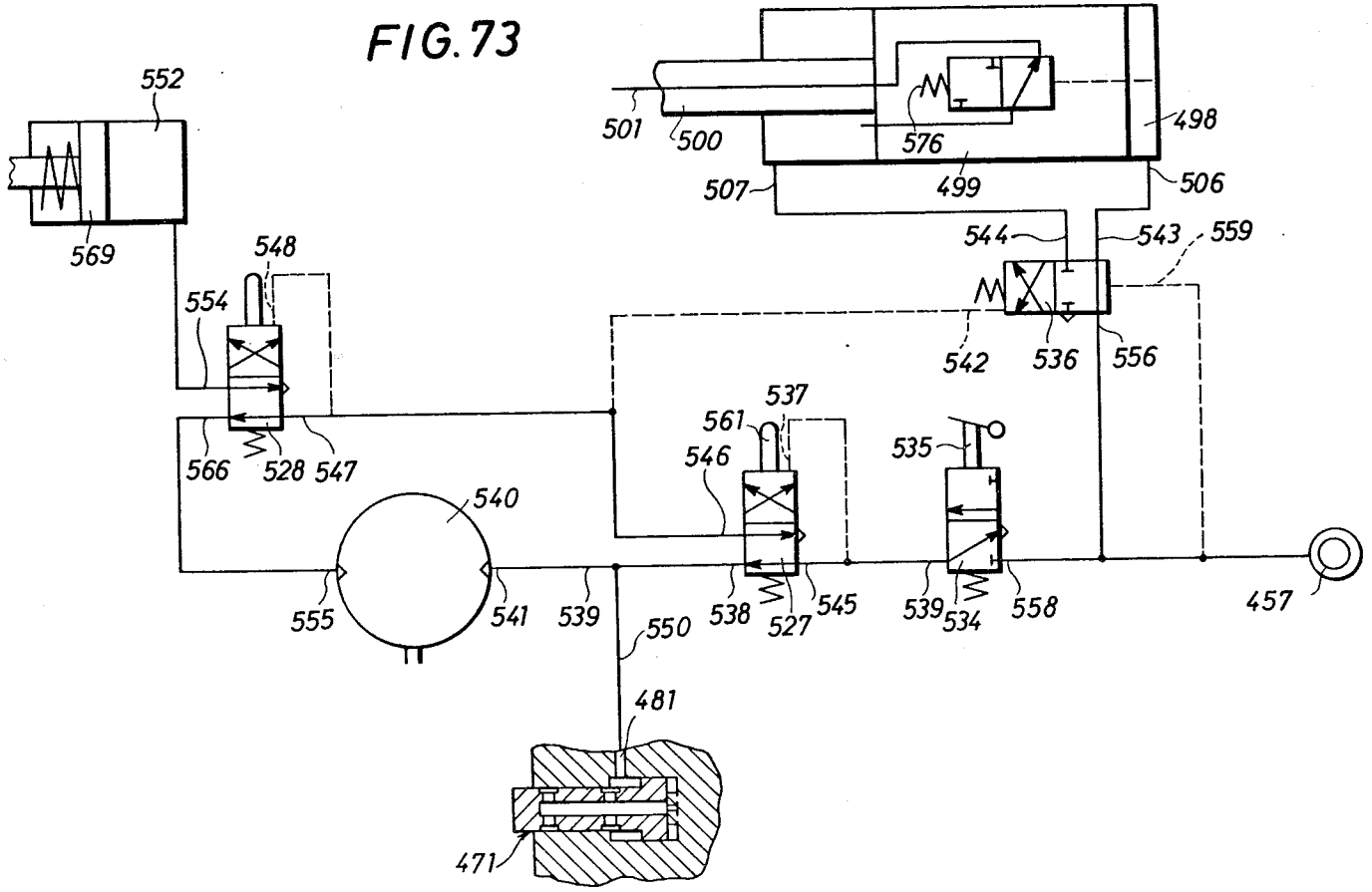

When a pressure of working air acting on the return input port 542 is dropped to an atmospheric pressure, the secondary tightening cylinder switching valve 536 is switched as shown in FIG. 73, the working air, which has been supplied by way of the air plug through the input port 556 and retracting output port 544 into the reacting air supply port 507 in the secondary tightening cylinder 498, is supplied by way of the input port 556 and retracting output port 543, to the retracting air supply port 506 in the secondary tightening cylinder 498. As a result, the air bleed valve stem 508 is urged under the pressure of working air acting on the right and surface of the tightening piston 499 against a force of the compression coil spring 576, so that the communicating hole 504 in the secondary tightening piston 499 is brought into communication with the hole 514 in the air bleed valve stem 508, so the working air residual in the secondary tightening cylinder 498 is in jetted through the through-hole 50 to the atmosphere through the flexible-material-waste-cut-blowing hole 503 which is open to the tip portion of the piston rod. The jet of this working air blows off the tip portion 12*a* of the flexible material which has remained in the clearance between the fixed pawl 520 and the rotatable pawl 522.

During this time, working air in the cutter drive cylinder 522 is discharged through an exhaust port in the cutter operating valve 528 due to the return movement of the cutter cooperating valve 528 to its initial position, the cutter drive piston 569 is returned to its initial position under the action of the spring 570, and the cutters 567 are retracted from the central hole 557.

In addition, when working air is supplied to the advancing air supply port 506 in the secondary tightening cylinder 498, the secondary tightening piston 499 is returned towards the movable guide element 452. Then, when the piston 499 reaches its left-hand extremity of a stroke, the retaining pin 517 on the tip portion of the piston rod 500 is inserted into the hole 518 in the body proper 450, so that the piston rod 500 may be retained in a stable manner.

Figure 74:
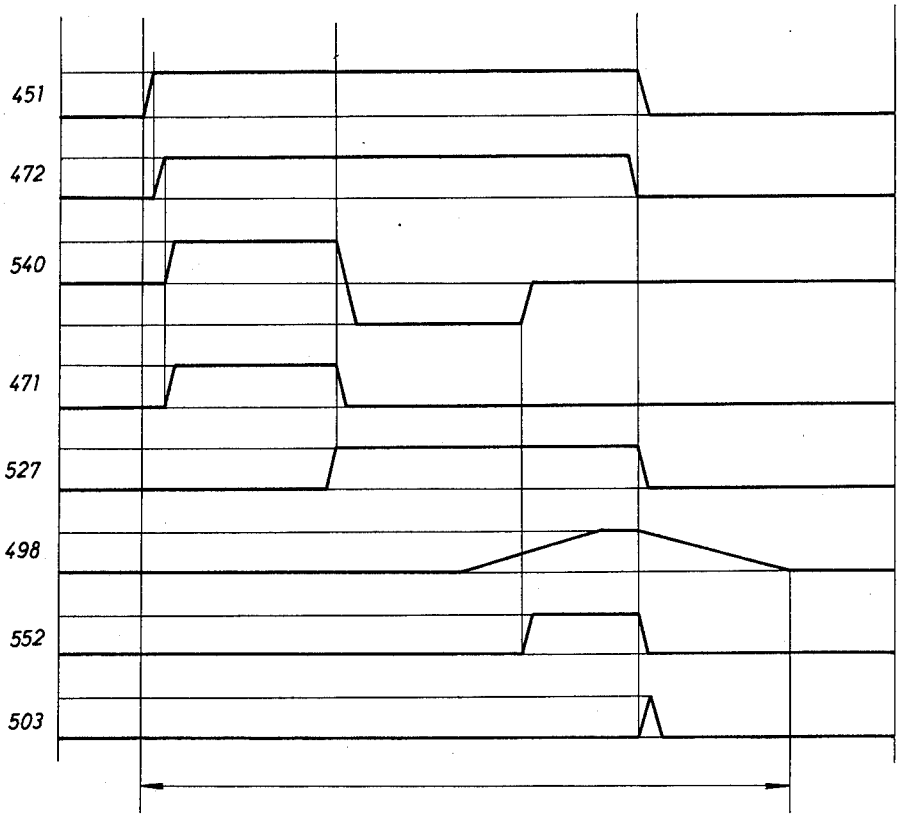
FIG. 74 is a plot showing the sequence of operations using working air, of the respective parts of the binder.

When a binding operation is started again, a bundle of the material 35 is admitted in the central hole 557 in the ring-shaped guide member 451, and the aforesaid cycle of operations will be repeated. FIG. 74 shows the operational sequence of the respective components of the binder.

Figure 75:
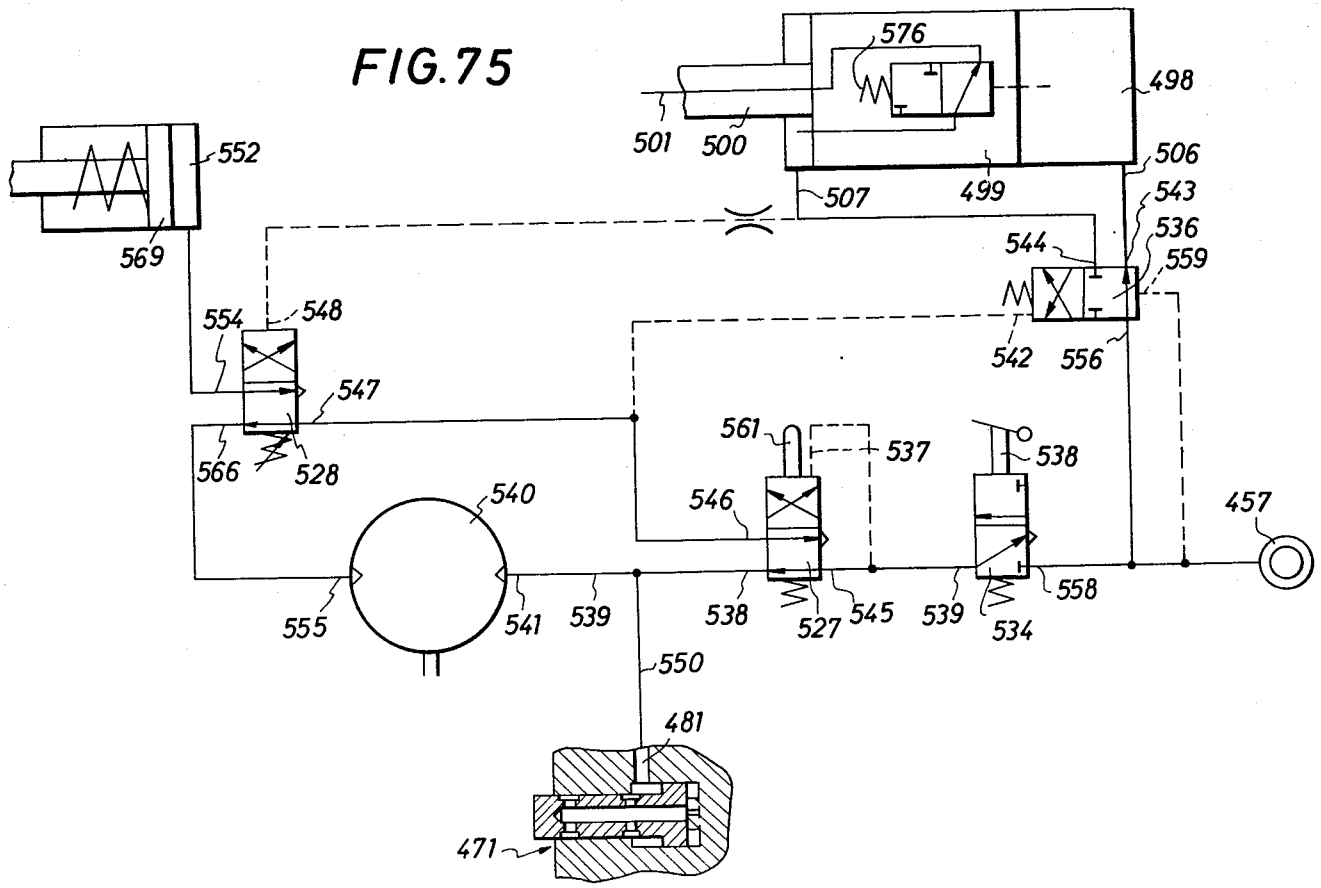
FIG. 75 is a drive and control circuit diagram of a further embodiment of the binder according to the present invention.

FIG. 75 shows the binding, drive and control circuits according to another embodiment of the invention. In this circuit, an air passage 565 leads from a retracting air supply port 506 in the secondary tightening cylinder 498 towards a pilot port 564 in the cutter operating valve 563, and a throttle portion 566 is provided in the air passage 565. This throttle portion may be of variable type, but a foxed type may be well used.

The cutter operating valve 563 is of the type, which may be operated only by a working-air pressure supplied to the air passage 565.

In this manner, due to the provision of the air passage 565, the secondary tightening piston 499 is stopped completely. After the opposite ends of the flexible material 12 have been pulled, working air is supplied to the pilot port 564 due to a rise in internal pressure in the secondary tightening cylinder 498, so that the cutter operating valve 563 is switched so as to allow the cutters 567 to go into the central hole 557. As a result, even if the diameter of a bundle of the material 35 is varying, a bundle of the material 35 may be bound by a given binding force, and in addition, the operation of the cutters 567 are carried out at a predetermined timing, so precluding an accident incident thereto. In addition, the cutter operating valve 563 need not be operated by a mechanical external force of the operating piece 526, and hence the construction of the binder may be simplified.

As is apparent from the foregoing description of the automatic binder according to the present invention, when the flexible material 12 is threaded through the guide channels provided in the ring-shaped guide member 451, the ring-shaped guide member 451 is vibrated, so that the travelling or threading of the flexible material 12 may be accomplished smoothly, thus enabling double, tripple or multiple binding guide member as shown in FIG. 44. In addition, the flexible material 12 may be smoothly fed into the ring-shaped guide member 451 according to the automatic adjustment of vibration of the ring-shaped guide member as well as the feed speed of the flexible material 12, in association with a travelling resistance of the flexible material 12.

What is claimed is:

1. An automatic binder for binding an object with a continuous flexible lacing material, comprising:

a main body;

guide means within said body for guiding said lacing material around the object to be bound, comprising mating guide elements, defining a central opening therewithin in a closed position of said mating guide elements, and being provided with lacing material lead-in and lead-out holes, said holes being connected with a continuous guide channel having the configuration of a knot;

feed-in primary tightening means for feeding said lacing material into said guide channel and rewinding said lacing material on said object to be bound to form a knot in a primary tightening operation;

lacing material gripping means actuated by a free end of said lacing material for gripping said free end of said lacing material during primary and secondary tightening operations, said means generating a first pilot signal for actuating said feed-in primary tightening means to effect said primary tightening operation and a second pilot signal for actuating a secondary tightening means to effect said secondary tightening operation; said secondary tightening means effecting said secondary tightening operation by moving said lacing material gripping means away from said lacing material lead-out hole;

cutting means for cutting a portion of said lacing material which has been used for binding said object from the excess portion of said lacing material after said secondary tightening operation; and means for driving and controlling said guide means, said feed-in primary tightening means, lacing material gripping means, secondary tightening means, and cutting means in said closed position of said mating guide elements.

2. An automatic binder as set forth in claim 1 wherein said mating guide elements comprise a first guide element provided with intersecting guide channels including a deep guide channel and a second guide element provided with two parallel guide channels in which a plurality of rollers are positioned at the front and rear of said parallel guide channels and connected with said deep guide channel for aiding smooth flow of said lacing material in said deep guide channel.

3. An automatic binder as set forth in claim 2, wherein said intersecting guide channels include a first guide channel crossed by a second guide channel deeper than said first guide channel, whereby a first end-opening and a second end-opening of said first guide channel are positioned opposing each other at both sides of said second guide channel, the diameter of said first end-opening through which said lacing material is fed out being no larger than that of said second end-opening which admits said lacing material therein.

4. An automatic binder as set forth in claim 2, wherein said guide channels have substantially the same radius of curvature over the entirety of said guide channels.

5. An automatic binder as set forth in claim 1, wherein said mating guide elements include a semi-circular ring-shaped movable guide element and a semi-circular ring-shaped stationary guide element which define a circular central opening for said object to be bound, said semi-circular ring-shaped stationary guide element having an inner peripheral wall facing said circular central opening and an outer peripheral wall opposing said inner peripheral wall, and being provided with a lacing material lead-in hole and lead-out hole, with two guide openings for a cutter between said lacing material lead-in and lead-out holes, the most rearward portion of said inner peripheral wall being positioned midway between said guide openings for said cutter, said guide openings for said cutter being provided with two open ends facing said circular central opening, a lacing supporting portion positioned in said inner peripheral wall adjacent to said opening-end and between said open ends, so that said lacing supporting portion is more forwardly projected toward said central opening than said most rearward portion of said inner peripheral wall, thereby to assure the formation of a tight knot.

6. An automatic binder as set forth in claim 1, wherein said mating guide elements are relatively moved to corresponding mating guide elements in a radial direction of said central opening, so that the entire length of said guide channel is changed to direct said lacing material from said lacing material lead-in hole to said lacing material lead-out hole.

7. An automatic binder as set forth in claim 1, wherein said guide means includes vibrating means imparting a vibration to at least one of said mating guide elements to forward said lacing material from said lacing material lead-in hole to said lacing material lead-out hole in cooperation with said feed-in primary tightening means.

8. An automatic binder as set forth in claim 7, wherein said vibrating means includes a pneumatic vibration valve, said feed-in primary tightening means comprising rollers driven by a reversible pneumatic motor feeding said lacing material into said guide channel through said lead-in hole during the forward rotation of said reversible, pneumatic motor and pulling back said lacing material through said lead-in hole upon reverse rotation of said reversible, pneumatic motor to effect a primary tightening operation, said pneumatic vibration valve and said reversible, pneumatic motor being connected by means of a pneumatic distribution circuit in said driving and controlling means, whereby when the resistance of said guide channel against travelling lacing material decreases the velocity of rotation of said reversible, pneumatic motor increases, and at the same time the number of vibrations of the vibration valve decreases, and when the resistance of said guide channel increases the velocity of rotation of said motor decreases, and at the same time that the number of vibrations of the vibration valve increases, so that said lacing material is smoothly guided in said guide channel.

9. An automatic binder as set forth in claim 1, wherein said lacing material gripping means removes the cut end of said lacing material upon detecting a signal representing the completion of the cutting operation of said cutting means.

10. An automatic binder as set forth in claim 1, wherein said driving and controlling means includes a timer therein, whereby said second pilot signal is produced from said first pilot signal by said timer at a fixed later period of time.

11. An automatic binder as set forth in claim 1, said feed-in, primary tightening means including roller means driven by a reversible motor, feeding said lacing material into said guide channel in the forward rotation of said reversible motor and pulling back said lacing material in the reverse rotation of said reversible motor to effect a primary tightening operation, said reversible motor maintaining a torque in the reverse rotation thereof to impart a tightening force to said lacing material until the completion of a secondary tightening operation of said secondary tightening means, whereby said object to be bound is substantially positioned in the middle portion between said lacing material lead-in hole and said lacing material lead-out hole within said central opening.

12. An automatic binder as set forth in claim 11, wherein said cutting means is positioned adjacent to said lacing material lead-in hole and lead-out hole, and traverses said holes to cut said lacing material at the both sides of a knot of said lacing material, leaving said lacing material at equal lengths.

13. An automatic binder as set forth in claim 1, said cutting means being actuated while said secondary tightening means moves away from said lacing material lead-out hole, by accepting a signal detecting a fixed tension on said lacing material rewound on said object to be bound.

14. An automatic binder as set forth in claim 1, wherein the main body of said automatic binder is substantially formed in the shape of a gun, including a supporting portion projecting downwardly from a muzzle portion of said body and a grip portion in the rear of said body, said mating guide elements including a movable guide element and a stationary guide element, said stationary guide element including a lacing material lead-in hole and lead-out hole secured to said supporting portion, said feed-in primary tightening means being positioned on said supporting portion adjacent to said lacing material lead-in hole, said cutting means being positioned on the side of said stationary guide element opposite the side of said stationary guide element facing said central opening in the supporting portion thereof, said second tightening means including a cylinder and a piston rod secured to a piston in said cylinder and positioned between said muzzle portion and said grip portion of the body, said piston rod moving reciprocably away from and near to said lacing material lead-out hole, said lacing material gripping means being secured to a tip portion of said piston rod, and said driving and controlling means comprising a pneumatic pressure circuit.

15. An automatic binder as set forth in claim 1, wherein said driving and controlling means comprises an electrical circuit.

16. An automatic binder as set forth in claim 1, wherein said mating guide elements are comprised of a first guide element provided with intersected guide channel elements including a deep guide channel and a second guide element provided with two parallel guide channels, said deep guide channel cooperating with a plurality of rollers for aiding a smooth pass-through of said lacing material.

17. An automatic binder as set forth in claim 1, said feed-in primary tightening means including roller means driven by a reversible motor and feeding a predetermined amount of said lacing material into said guide channel until said free end of said lacing material is gripped by said lacing material gripping means in the normal rotation of said reversible motor to withdraw any excess amount of said lacing material from the object to be bound during the reverse rotation of said reversible motor until movement of said object to be bound is interrupted by said mating guide element, thereby to effect primary tightening of said feed-in primary tightening means.

* * * * *